US006357348B1

(12) United States Patent
Nakamura et al.

(10) Patent No.: US 6,357,348 B1
(45) Date of Patent: Mar. 19, 2002

(54) HEAT-SENSITIVE STENCIL MASTER MAKING APPARATUS

(75) Inventors: Jun Nakamura; Hideyuki Kinoshita; Yukio Irie; Kunio Nomura; Atsushi Takata; Shinichi Takizawa; Yoshiyuki Okada; Hikaru Oike, all of Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/441,780

(22) Filed: Nov. 17, 1999

(30) Foreign Application Priority Data

Nov. 18, 1998 (JP) ..... 10-327938

(51) Int. Cl.[7] ..... B41J 2/37

(52) U.S. Cl. ..... 101/128.4; 347/186; 347/192; 400/120.12

(58) Field of Search ..... 101/128.21, 128.4; 347/180–182, 185–187, 192, 195–196; 400/120.05, 120.06, 120.08, 120.12, 120.14, 120.15

(56) References Cited

U.S. PATENT DOCUMENTS

| | | | | |
|---|---|---|---|---|
| 4,376,942 A | * | 3/1983 | Toth et al. | 347/186 |
| 4,675,695 A | | 6/1987 | Sammuel | 347/194 |
| 5,025,267 A | | 6/1991 | Schofield et al. | 347/194 |
| 5,085,933 A | | 2/1992 | Katoh et al. | 428/332 |
| 5,172,130 A | * | 12/1992 | Takahashi | 347/186 |
| 5,291,219 A | | 3/1994 | Ono et al. | 347/185 |
| 5,734,411 A | * | 3/1998 | Michielson et al. | 347/186 |
| 5,809,879 A | | 9/1998 | Yokoyama et al. | 101/128.4 |
| 5,963,241 A | * | 10/1999 | Higa et al. | 347/186 |

FOREIGN PATENT DOCUMENTS

| | | |
|---|---|---|
| JP | 60-161163 | 8/1985 |
| JP | 62-051465 | 3/1987 |
| JP | 62-227663 | 10/1987 |
| JP | 62-282984 | 12/1987 |
| JP | 04-085050 | 3/1992 |

OTHER PUBLICATIONS

Output Devices 2: Untegrated–type, "Thermal Head Array" (with partial English translation ) by Masahiro Hayama, pps. 44–54.

* cited by examiner

*Primary Examiner*—Stephan R. Funk
(74) *Attorney, Agent, or Firm*—Nixon Peabody LLP; Donald R. Studebaker

(57) ABSTRACT

A heat-sensitive stencil master making apparatus for making a stencil master by imagewise perforating thermoplastic film of heat-sensitive stencil master material according to an image on an original includes a thermal head which has an array of a plurality of heater elements and is brought into thermal contact with the thermoplastic film. Heater elements selected from the array of the heater elements according to the image on the original are applied with an electric voltage so that perforations are formed in the parts of the thermoplastic film of the heat-sensitive stencil master material in contact with the selected heater elements. A continuous electric voltage is applied to each of the selected heater elements to heat the heater element to a predetermined temperature in a predetermined temperature range adequate to thermally perforate the thermoplastic film and then an intermittent electric voltage is applied to the heater element so that the temperature of the heater element is held in the predetermined temperature range for a predetermined time interval adequate to thermally perforate the thermoplastic film.

9 Claims, 36 Drawing Sheets

HEAT-SENSITIVE STENCIL MASTER MAKING APPARATUS

BACKGROUND OF THE INVENTION

1. Field of the Invention

This invention relates to a heat-sensitive stencil master making apparatus in which a stencil master is made by imagewise perforating a heat-sensitive stencil master material by a thermal head.

2. Description of the Related Art

There has been known a heat-sensitive stencil master making apparatus in which a thermal head having an array of heater elements is pressed against the thermoplastic film side of a heat-sensitive stencil master material while selectively energizing the heater elements, thereby perforating the thermoplastic film in a pattern representing image data.

FIG. 24 shows an example of such a stencil master making apparatus. In FIG. 24, the stencil master making apparatus 90 of this example comprises a thermal head 4 having an array of a plurality of heater elements 5 (only one is visible in FIG. 24), and a platen roller 3. A heat-sensitive stencil master material 1 is conveyed in the direction of arrow A when the platen roller 3 is driven by an electric motor (not shown) and passed between the platen roller 3 and the thermal head 4 with the side of a thermoplastic film 1*a* of the stencil master material 1 facing the thermal head 4. Thus the heater elements 5 of the thermal head 4 are pressed against the thermoplastic film 1*a* of the stencil master material 1 and the thermoplastic film 1*a* is perforated in a pattern representing image data by selectively energizing the heater elements 5 by a head drive means (not shown).

Each of the perforations is formed in the following steps. When a heater element 5 starts to be energized and heated, the temperature of the part of the thermoplastic film 1*a* in contact with the heater element 5 is elevated. Since the temperature of the heater element 5 is the highest at the center thereof, the temperature of the thermoplastic film 1*a* is maximized at the part in contact with the center of the heater element 5. When the temperature of this part reaches a perforation generation temperature to be described later, a small perforation is generated at this part. The small perforation is enlarged over an area circumscribed by an isothermal line at a shrinkage initiation temperature to be described later. After the heater element 5 is de-energized, the area circumscribed by the shrinkage initiation temperature line once enlarges and then narrows, and accordingly enlargement of the perforation stops.

When perforations are to be formed, each heater element 5 is generally applied with target power (more specifically, a voltage calculated on the basis of the mean resistance for all the heater elements 5 of the thermal head 4 and target power to be applied to the heater element 5) continuously for a predetermined time as shown in FIG. 25A. The power applied to each heater element 5 will be referred to as "the heater drive power" and the time for which the heater drive power is applied to the heater element 5 will be referred to as "the duration of heater drive power", hereinbelow.

When the heater drive power is applied to the heater element 5, the surface of the heater element 5 has a temperature distribution such that the temperature is the highest at the center of the heater element 5 and lowers as the distance from the center increases as shown in FIG. 26. The temperature distribution changes depending on the shape and structure of the heater element 5 and the heater drive power and/or the time, and is an important factor which affects the shape of the perforation. In the following description, the temperature at the center of the surface of the heater element 5 is taken as a representative of the temperature of the heater element 5, and "the temperature of the heater element 5" as used hereinbelow means the temperature at the center of the surface of the heater element 5 unless otherwise noted.

So long as the shape and/or the structure are the same, the surface temperature distribution is similar, and accordingly, the temperature of the heater element 5 represents the state of heating of the heater element to some extent.

Since the heater drive power is of a square wave as shown in FIG. 25A, the temperature of the heater element 5 changes like an exponential function and asymptotically approaches a certain temperature with time as shown in FIG. 25B while the heater element 5 is energized. That is, the temperature of the heater element 5 is low at the beginning of application of the heater drive power, is monotonically increased and is maximized at the end of the application.

In order to improve quality of printed images, it is required that the perforations are as uniform as possible in shape. Nonuniformity in shape of the perforations is caused partly for systematic reasons and partly for random reasons. For example, the systematic reasons include the ambient temperature (when the ambient temperature is high, the perforations are enlarged, and vice versa), heat accumulation (the perforations are small at the beginning of stencil master making, and are gradually enlarged as the stencil master making process progresses due to accumulation of heat), common drop (when perforations are formed over a wide area, perforations are apt to become smaller in the end portions than in the middle portion in the main scanning direction, where the line resistance is higher), and the like. The random reasons include fluctuation in the temperature of the heater elements, dispersion of fibers in the support sheet of the stencil master material, nonuniformity in the state of contact between the thermoplastic film of the stencil master material and the heater elements due to surface roughness of the thermoplastic film, and the like. Unlike in other thermal recording such as those using heat-sensitive paper or thermal transfer, fluctuation in perforation size in the heat-sensitive stencil master is greatly affected by the random reasons. Accordingly, it is especially required in heat-sensitive stencil master making that nonuniformity in the perforation size is suppressed. Further improvement in printing durability and accuracy in the printing position, shortening the stencil master making time and the like are required. In order to meet these requirements, there have been made various studies on the material of the thermoplastic film.

For example, as disclosed in Japanese Patent Publication No. 2507612, there has been proposed use of thermoplastic film having two melting peaks in order to stabilize the shape of perforations. That is, by use of such thermoplastic film, generation of perforations is quickened by virtue of the resin component having the lower melting peak and the shape of the perforations is stabilized by virtue of the resin component having the higher melting peak. When a perforation is formed in heat shrinkable film, the perforation is generally enlarged over an area circumscribed by a shrinkage initiation temperature line (an isothermal line at a shrinkage initiation temperature) and fluctuation in size of the perforations is smaller as the temperature gradient near the shrinkage initiation temperature line is larger and as the degree to which the heat-shrinkage factor rises beyond the shrinkage initiation temperature increases. Actually, the heat-shrinkage temperature range of resin whose melting peak temperature is high is in a relatively high temperature range, and accordingly the temperature gradient near the shrinkage initiation temperature line is large. This stabilizes the shape of the perforations. However when the thermoplastic film is formed only of such high melting peak resin, sensitivity to perforation of the thermoplastic film, that is, the performance in forming perforations of a required size with low power, deteriorates. Accordingly in order to keep sufficient the sensitivity to perforation of the thermoplastic film, resin whose melting peak temperature is low is added. However, when the proportion of such low melting peak resin is increased giving precedence to the sensitivity to perforation, stability of the shape of the perforations deteriorates and when the proportion of the high melting peak resin is increased giving precedence to the stability of the shape of the perforations, the sensitivity to perforation deteriorates.

Further, as disclosed in Japanese Unexamined Patent publication No. 62(1987)-282984, there has been proposed thermoplastic film whose heat of crystalline fusion, energy of fusion and melting point are defined. Generally the sensitivity to perforation of heat-shrinkable resin is higher as the heat of crystalline fusion is smaller, the energy of fusion is smaller and the melting point is lower. However, the above identified Japanese Unexamined Patent publication says that the printing durability, that is, the number of copies which can be printed before the thermoplastic film is broken, is larger as the heat of crystalline fusion is larger, the energy of fusion is larger and the melting point is higher unless the thermoplastic film is extremely large in thickness. That is, the printing durability and accuracy in the printing position which depends upon the printing durability conflict with the sensitivity to perforation.

As can be understood from description above, thermoplastic film which contributes to stabilization of the shape of perforations and/or is excellent in mechanical strength, thereby contributing to improvement in the printing durability and the accuracy in the printing position, is generally lower in the sensitivity to perforation. Further even thermoplastic film which is high in sensitivity to perforation deteriorates in its sensitivity to perforation when the thickness thereof is increased with the aim of improving the printing durability or the accuracy in the printing position. In the case of thermoplastic film which is low in sensitivity to perforation, the energy supplied to the heater elements must be larger in order to obtain a desired shape of the perforations. The energy supplied to the heater element is a value obtained by time-integration of the heater drive power.

The energy supplied to the heater elements can be increased by increasing the heater drive power, increasing the duration of heater drive power, or increasing both the heater drive power and the duration thereof. FIG. 27 shows change with time of the temperature of the heater element when the energy supplied to the heater element is increased by a given amount by the three methods from energy represented by line a which is proper to conventional high-sensitive thermoplastic film. That is, line a represents the change of the temperature of the heater element when the heater drive power and the duration thereof are set to be suitable for thermoplastic film which is high in sensitivity to perforation. Line b represents the change of the temperature of the heater element when the heater drive power is increased as compared with that for line a with the duration of the heater drive power kept unchanged. Line c represents the change of the temperature of the heater element when the duration of heater drive power is increased as compared with that for line a with the heater drive power kept unchanged. Line d represents the change of the temperature of the heater element when both the heater drive power and the duration of heater drive power are increased as compared with those for line a.

It has been empirically known that so long as the total energy is unchanged, that is, the product (heater drive power x the duration of heater drive power) is the same, substantially the same shape of perforations can be obtained when the heater drive power or the duration of heater drive power is in ± 30% of that of a reference combination of the heater drive power and the duration of heater drive power. Further it has been empirically known that so long as the amounts of energy applied to the heater element are equal to each other, the peaks of lines b to d (the maximum temperatures of the heater element) are substantially on a curve which descends rightward as shown by the broken line in FIG. 27. Since the peak of line c is higher than that of line a, the peaks of lines b and d are also higher than that of line a.

In order to shorten the stencil master making time, it is generally necessary to shorten the duration of heater drive power. For this purpose, it is necessary to increase the heater drive power applied to the heater elements. FIG. 28 shows change with time of the temperature of the heater element when the heater drive power applied to the heater element is changed. That is, line a represents the change of the temperature of the heater element when the heater drive power and the duration thereof are set to be suitable for thermoplastic film which is high in sensitivity to perforation. Line b represents the change of the temperature of the heater element when the heater drive power is increased and the duration of heater drive power is shortened as compared with those for line a. Also in this case, the peaks of lines a and b are on a curve which descends rightward as shown by the broken line in FIG. 28, and accordingly the peak of line b is higher than that of line a.

Further, as disclosed, for instance, in Japanese Unexamined Patent publication Nos. 62(1987)-51465, 62(1987)-227663 and 4(1992)-85050, it has been proposed in the field of thermal transfer recording to apply to the heater elements chopped pulses in place of square pulses in order to improve printing quality. This is for preventing sticking of ink sheets, keeping a temperature suitable for printing and controlling the printing density.

As can be understood from description above, it is necessary to set a condition of application of heater drive power which can heat the heater elements to a temperature higher than the conventional temperature in order to satisfy the requirements from the quality of printed images.

However if the heater elements undergo an excessively high temperature, oxidation of the heater elements is promoted and the heater elements deteriorate in their heat generating performance (generally referred to as "deterioration of the heater elements") or are broken. As some of deterioration modes of heater elements are described, for instance, in "Thermal Head Array" by Uyama (an extra number of Shashinkougyou, edited by Academy of Electrophotography, Imaging, Part 3, pp.45 to 54, Shashinkougyou Shuppan, 1988), deterioration modes of the heater elements due to the temperature of the heater elements themselves include a glaze layer breaking mode, an oxidation mode and a crack mode. The glaze layer breaking mode occurs when the temperature of the heater elements exceeds 600 to 700° C., the softening point of the glaze layer, and will not occur under practical perforating conditions. The oxidation mode occurs when the heater elements are continuously operated at a temperature slightly higher than their service temperature. When the heater elements are continuously operated at a temperature slightly higher than their service temperature, they are oxidized and their resistance increases and finally the heater elements becomes incapable of generating heat. According to our experiment, in the case where a thin film thermal head is operated at a cycle of 2.5 msec, tendency of deterioration of heater elements begins to appear when the temperature of the heater elements slightly exceeds 400° C. The crack mode occurs when the heater element undergoes abrupt changes of temperature. That is, when the heater element is subjected to abrupt changes of temperature, the protective layer is cracked due to thermal shocks or displacement of layers due to difference in thermal expansion coefficient and when the protective layer is once cracked, oxidation of the heater element is rapidly promoted.

In a practical heat-sensitive stencil master making process, the thermal head is operated under the conditions that the peak temperature of the heater elements is 300 to 400° C. and the cycle time is 2 to 4 msec. Unlike in recording on heat-sensitive paper, these conditions are very severe from the viewpoint of durability of the heater elements in heat-sensitive stencil master making process.

In the case of heat-sensitive paper F50SS available from FUJI PHOTO FILM Co., the data on which is described as a representative of properties of sensitivity of heat sensitive paper in "Direct Thermal Recording Paper" by Usami and Igarashi (an extra number of Shashinkougyou, edited by Academy of Electrophotography, Imaging, Part 3, pp.165 to 176, Shashinkougyou Shuppan, 1988), color begins to be developed at about 80° C. and the density of the color is saturated at about 110° C.

In the case of fusion type thermal transfer recording, the melting point of typical fusion type thermal transfer ink is 65 to 75° C. as disclosed in "Transfer Type Color Thermal Recording Media" by Seto, Shimazaki and Kondou [Papers for 1st Non-Impact Printing Technique Symposium, 3 to 8, P61 (1984)].

Further, in the case of sublimation type thermal transfer recording, the sublimation temperature of sublimation dye is generally in the range of 140 to 200° C. though varies depending on the color of the dye as shown in "Technique of Video-Printer" by Hori [Magazine of Academy of Electrophotography, 29-p1, P77, (1990)]. As for the temperature of the heater elements of the thermal head in sublimation type thermal transfer recording, the change with time of the temperature of the center of the surface of heater element is shown in "Printing Properties of Sublimation Type Thermal Printer" by Mochizuki and Saitou [Briefs of Lectures on Thermal Technology in Japanese Academy of Mechanics, vol. 1989, P120, (1989)] and the peak of the temperature is shown to be about 280° C. The ratio of sublimation of the dye under the condition shown is about 70%, which is more than sufficient for transfer.

To the contrast, in the case of heat-sensitive stencil master making, it is necessary to heat the thermoplastic film to a temperature close to its melting point in order to generate an initial perforation as will be described in detail later. Further it is necessary to keep higher the temperature of the thermoplastic film in order to enlarge the initial perforation to a target size.

Generally polyester film is used as the thermoplastic film of the heat-sensitive stencil master material. As the polyester, copolymer of ethylene terephthalate and ethylene isophthalate, polyethylene terephthalate, and the like are used. The melting points of these materials are in the range of about 200 to 250° C. Accordingly the temperature condition applied to the thermoplastic film in heat-sensitive stencil master making is more severe than that applied to the recording medium such as heat-sensitive paper in thermal recording systems such as thermal transfer recording. When making a heat-sensitive stencil master, the heater elements cannot be microscopically brought into close contact with the thermoplastic film due to their surface roughness and an air layer is formed therebetween, which deteriorates thermal transfer efficiency. Accordingly the heater elements must be heated higher than the thermoplastic film, which results in a heater element peak temperature of 300 to 400° C. when the heater elements are continuously operated at cycles of 2 to 4 msec.

Thus, probability of deterioration or breakage of the heater elements has made it difficult to meet the requirements of shortening the stencil master making time and/or improving applicability of heat-sensitive stencil master making to various sensitivities of thermoplastic film in order to obtain a stencil master which is small in fluctuation in shape of the perforations and is high in printing durability and accuracy in printing position.

We observed the manner in which thermoplastic polyester film (employed in a heat-sensitive stencil master material) was perforated upon application of heater drive power to the heater elements of a thermal head in contact with the polyester film and found that the polyester film was perforated in the following two steps. First step was a latent step from initiation of application of heater drive power to generation of an initial perforation and the second step was a growing step during which the initial perforation grew and growth of the perforation stopped.

Polyethylene terephthalate film 1.7 $\mu$m thick was employed as the thermoplastic polyester film and the film was perforated by use of a thin film type thermal head. The thermal head was 400 dpi in resolution and 30 $\mu$m (in the main scanning direction) ×40 $\mu$m (in the sub-scanning direction) in size of each heater element. Heater drive power of 120 mW was applied to each heater element continuously for 400 $\mu$sec. The time from the beginning of the dead step to the end of the dead step was about 200 $\mu$sec and the time from the beginning of the dead step to the end of the growing step was about 800 $\mu$sec. The condition of application of heater drive power was common in current heat-sensitive stencil master making. The shape of the perforation was substantially quite round at any time during the growing step.

FIG. 29 shows the relation of measured power P, heater element temperature a, and size d of the perforation in the main scanning direction with the time t from initiation of application of heater drive power. The size d of the perforation in the main scanning direction is a length of an orthogonal projection of the perforation onto the main scanning axis as shown in FIG. 30.

The temperature of the heater element was measured by applying heater drive power to the heater element under the condition described above without anything in contact with the heater element and by use of an infrared radiation thermometer RM-2A (BARNES ENGINEERING COMPANY) with the field of view set to be a circle 7.5 $\mu$m in diameter, a band pass filter whose half-amplitude level was 4.9 to 5.4 $\mu$m used, and with the infrared emissivity $\epsilon$ taken as 1. Since wavelengths near 5 $\mu$m are in the characteristic absorption band of the glass on the surface of the heater element, the glass may be considered to be a black body and the temperature of the heater element can be calculated on the basis of the radiation intensity.

The result of the experiment described above shows that it takes a time about a half of the duration of heater drive power for an initial perforation to be generated and it takes a time about double of the duration of heater drive power for the perforation to be fixed as measured from the initiation of application of heater drive power. The reason for this fact will be as follows.

When the thermoplastic film is perforated, the thermoplastic film cannot be perfectly brought into close contact with the heater elements and a gap is formed between the thermoplastic film and the heater elements due to the surface roughness of the thermoplastic film itself and/or the surface roughness generated when bonding the thermoplastic film to the support sheet. Since the gap and the thermoplastic film in contact with the gap have a heat capacity, the temperature of the part of the thermoplastic film in contact with the center of the heater element does not change as shown by line a in FIG. 29 representing the temperature of the heater element. That is, though the temperature of the heater element begins to lower as soon as application of heater drive power is stopped, the temperature of the thermoplastic film keeps rising after application of heater drive power is stopped as shown by line b in FIG. 29 and reaches a peak somewhat later than the temperature of the heater element. Thereafter the temperature of the thermoplastic film gradually lowers.

Actually, the part of the thermoplastic film in contact with the center of the surface of the heater element is melted away and there is no part of film in contact with the center of the heater element after the initial perforation is generated. Accordingly, the part of line b representing the temperature of the thermoplastic film in the period after generation of the initial perforation represents imaginary temperatures determined on the assumption that the thermoplastic film is not perforated even if it is subjected to heat. The term "temperature of the thermoplastic film" as used hereinbelow means the imaginary temperature of the part of the thermoplastic film in contact with the center of the heater element unless otherwise noted. The reason why such imaginary temperatures are used in the following discussion is that the imaginary temperatures are a parameter representing temperature distribution on the thermoplastic film.

When it is assumed that the thermoplastic film is not perforated by heat from the heater element, the thermoplastic film exposed to heat from the heater element has a temperature distribution such that the temperature is the highest at the part in contact with the center of the heater element and lowers as the distance from the center increases as shown in FIG. 31. The temperature distribution on the thermoplastic film shown in FIG. 31 is similar to that on the heater element shown in FIG. 26 though they are different from each other in absolute values of temperature. FIG. 32 shows the cross-sections of temperature distribution on the thermoplastic film and that on the heater element taken along line A–A' (the main scanning axis, i.e., the center line of the array of the heater elements of the thermal head) at a certain time point. As can be seen from FIG. 32, the temperature of the heater element is higher than that of the thermoplastic film at this time point.

The initial perforation is generated at the part of the thermoplastic film in contact with the center of the surface of the heater element. The temperature of the thermoplastic film at the time the initial perforation is generated will be referred to as "the perforation generation temperature", hereinbelow. It has been empirically found that the perforation generation temperature is substantially equal to the melting point of the thermoplastic film. FIG. 33 shows the relation of the temperature of the heater element (line a), the temperature of the thermoplastic film (line b) and the size of the perforation in the main scanning direction (line d) to the time t from initiation of application of heater drive power obtained by simulation. Lines a, b and d in FIG. 33 respectively correspond to lines a, b and d in FIG. 29. The shorter the time in which the temperature of the thermoplastic film reaches the perforation generation temperature Ta, the shorter the time in which the initial perforation is generated.

As the temperature of the thermoplastic film increases after the initial perforation is generated, heat shrinkage of the thermoplastic film occurs near the contour of the initial perforation, and the contour of the initial shrinkage is pulled toward the lower temperature side, whereby the perforation grows. When the heat shrinkage factor of heat-shrinkable film is measured by TMA, heat shrinkage generally begins at a certain temperature Tb (will be referred to as "the shrinkage initiation temperature") as shown in FIG. 34. Shrinkage of the film occurs inside the area circumscribed by an isothermal line at the shrinkage initiation temperature Tb in the temperature distribution on the film. The area between the intersections of the main scanning axis A–A' and the shrinkage initiation temperature line in FIG. 32 will be referred to as "shrinkage area", hereinbelow. Line c in FIG. 33 shows the shrinkage area at each time.

As shown by line d in FIG. 33, the perforation is generated when the temperature of the thermoplastic film represented by line b reaches the perforation generation temperature Ta and approaches the shrinkage area represented by line c as the temperature of the thermoplastic film approaches the peak. Then the perforation is somewhat enlarged after the temperature of the thermoplastic film reaches the peak.

In FIG. 33, the reason why the size of the perforation represented by line d does not change with the shrinkage area represented by line c before the temperature of the thermoplastic film reaches the peak is that the size of the initial perforation is almost 0 whereas the shrinkage area at the time the initial perforation is generated is a half or more of the final size of the perforation, that the growing speed of the perforation, i.e., the speed at which the contour of the perforation moves, is limited, and that the size of the perforation gradually approaches the shrinkage area.

In FIG. 33, the reason why the size of the perforation does not change with the shrinkage area after the temperature of the thermoplastic film reaches the peak is that the perforation once enlarged cannot be contracted, and the contour of the perforation acts as a heat source which causes heat shrinkage near the contour of the perforation and enlarges the perforation after the temperature of the thermoplastic film reaches the peak.

The shrinkage initiation temperature Tb can be measured by TMA. The perforation generation temperature Ta and the speed at which the perforation grows depend upon physical properties, structure, temperature condition of the thermal head and the thermoplastic film though the dependency has not been known in detail.

Anyway, in the case of the conditions described above, it takes a time about a half of the duration of heater drive power for an initial perforation to be generated and it takes a time about double of the duration of heater drive power for the perforation to be fixed as measured from the initiation of application of heater drive power.

Further in the case of low-sensitive thermoplastic film, it is necessary to apply energy larger than that applied to high-sensitive thermoplastic film in order to obtain a desired shape of perforations. For this purpose, the heater drive power and/or the duration of heater drive power must be increased. This is because the low-sensitive thermoplastic film is higher than the high-sensitive thermoplastic film in the perforation generation temperature, the shrinkage initiation temperature and the temperature at which the initial perforation grows at a predetermined speed.

When the low-sensitive thermoplastic film is applied with heater drive power under the same condition as for the high-sensitive thermoplastic film in the conventional stencil master making apparatus, changes with time t of the temperature of the heater element, the temperature of the thermoplastic film, the shrinkage area and the size of the perforation are as shown by lines a to d in FIG. 35A. As can be seen from line d, the size $\phi$ of the perforation obtained becomes smaller than the target size $\phi_0$ in this case.

If the duration of heater drive power is increased in order to enlarge the perforation to the target size $\phi_0$, the temperature of the heater element exceeds an upper limit temperature Tmax below which deterioration of the heater element can be avoided as shown in FIG. 35B. This upper limit temperature Tmax will be referred to as "the maximum set temperature Tmax of the heater element", hereinbelow.

The maximum set temperature Tmax of the heater element is based on probability. Though, in FIG. 35B, the maximum set temperature Tmax of the heater element is specified, the maximum set temperature Tmax of the heater element is not a temperature such that deterioration of the heater element is sharply promoted when the temperature of the heater element exceeds the temperature. The heater element is deteriorated to a higher extent as the temperature which the heater element experiences becomes higher.

The perforation can be enlarged to the target size $\phi_0$ by increasing the heater drive power in place of increasing the duration of heater drive power. However when the heater drive power is increased, the peak of the temperature of the heater element becomes much higher than the maximum set temperature Tmax of the heater element.

As described above, it is generally necessary to shorten the duration of heater drive power in order to shorten the stencil master making time. However in order to shorten the duration of heater drive power, the heater drive power must be increased. That is, the temperature of the thermoplastic film must be quickly increased to the perforation generation temperature Ta so that the perforation is enlarged to the target size $\phi_0$ in a short time.

FIG. 36A shows changes with time of the temperature of the heater element (line a), the temperature of the thermoplastic film (line b), the shrinkage area (line c), and the size of the perforation (line d) when the heater element is energized with the heater drive power and the duration thereof set at values typical in the conventional stencil master making method. FIG. 36B shows changes with time of the temperature of the heater element (line a), the temperature of the thermoplastic film (line b), the shrinkage area (line c), and the size of the perforation (line d) when the heater drive power is increased and the duration of heater drive power is shortened so that perforation of the target size $\phi_0$ can be obtained in a time shorter than in the conventional method. As can be seen from FIG. 36B, the temperature of the heater element exceeds the maximum set temperature Tmax of the heater element when the heater drive power is increased and the duration of heater drive power is shortened.

As described above, there has been known a technique in which chopped pulses are applied to heater elements in thermal transfer printing in order to prevent sticking of ink sheets, keep a temperature suitable for printing and control the printing density, as disclosed, for instance, in Japanese Unexamined Patent Publication No. 62(1987)-51465.

As is well known, thermal transfer film employed in the thermal transfer printing comprises a support sheet (generally of polyethylene terephthalate, about 260° C. in melting point), a heat-resistant release material layer formed on one side of the support sheet and an ink layer formed on the other side of the support sheet. A thermal head is brought into contact with the release material layer and the ink layer is brought into contact with a recording paper. The support sheet contributes to keeping the ink layer flat and in a uniform thickness. The heat-resistant release material layer prevents the support sheet from being melted and sticking to the thermal head. The ink layer is melted or sublimed and is transferred to the recording paper when heated by the thermal head. The ink layer is transferred to the recording paper in the temperature range higher than the melting point of the ink layer (65 to 75° C.) or in the sublimation temperature of the ink layer (140 to 200° C.). The support sheet is heated to a temperature higher than the temperature range. If the support sheet is deformed by melting or heat shrinkage in the temperature range, the ink layer cannot be kept flat and fluctuation in transfer occurs, which deteriorates quality of the transferred image. Accordingly the support sheet should be kept in a temperature range where it cannot be deformed by heat. Though such a temperature range has not been precisely known, the melting point of the support sheet can be a parameter. That is, when the temperature of the support sheet is held below the melting point (about 260° C.) or so, deformation of the support sheet can be generally prevented. The thermal transfer film is inherently very smooth, and accordingly is very high in thermal transfer efficiency.

To the contrast, the heat-sensitive stencil master material comprises porous support sheet and thermoplastic film laminated on the porous support sheet. Perforations are formed in the thermoplastic film and the porous support sheet strengthens the thermoplastic film and is permeable to ink supplied to the perforated thermoplastic film. As described above, it is necessary to heat the thermoplastic film to a temperature above the perforation generation temperature (substantially equal to the melting point of the thermoplastic film=200 to 250° C.) in order to generate the aforesaid initial perforations. Further in order to enlarge the initial perforations to a target size, it is necessary to keep the temperature of the thermoplastic film in a higher range. The thermoplastic film is 1 to 2 $\mu$m in thickness and is smooth in itself. The porous support sheet is 30 to 40 $\mu$m in thickness and is large in fluctuation of fibers, which makes uneven the surface of the support sheet. Further, since the support sheet and the thermoplastic film are different from each other in elasticity and shrink, the heat-sensitive stencil master material is greatly inferior to the thermal transfer film in surface smoothness. According to our investigation, typical heat-sensitive stencil master material was about 0.4 to 3 $\mu$m in arithmetic mean surface roughness Ra of the surface of the thermoplastic film though depending upon the diameter and/or dispersion of the fibers of the support sheet. To the contrast, typical melting type or sublimation type thermal transfer film was lower than about 0.1 $\mu$m in arithmetic mean surface roughness Ra. Thus the thermal transfer efficiency from the thermal head to the heat-sensitive stencil master material in stencil master making is greatly inferior to that from the thermal head to the thermal transfer film in thermal transfer printing. The aforesaid arithmetic mean surface roughness Ra was measured by use of a non-contact three-dimensional geometry analyzer NH-3 (Mitaka Optical Instrument) with the cut-off value λc set at 0.8 mm and with the evaluation length ln set at 2.34 mm.

As can be seen from the description above, the heater elements of the thermal head are heated much higher in stencil master making than in thermal transfer printing, and accordingly the teachings of Japanese Unexamined Patent Publication No. 62 (1987)-51465 cannot be applied to heat-sensitive stencil master making as they are.

SUMMARY OF THE INVENTION

In view of the foregoing observations and description, the primary object of the present invention is to provide a stencil master making apparatus which can meet various requirements from the viewpoint of quality of printed matter without deterioration of heater elements of a thermal head, that is, a stencil master making apparatus which can make a stencil master which is excellent in uniformity in the perforation size, printing durability and accuracy in the printing position in a short time without fear of deterioration of heater elements of a thermal head.

In accordance with a present invention, there is provided a a heat-sensitive stencil master making apparatus which makes a stencil master by imagewise perforating heat-sensitive stencil master material according to an image on an original comprising a thermal head which has an array of a plurality of heater elements and is brought into thermal contact with the heat-sensitive stencil master material, and an electric voltage applying means which applies an electric voltage to heater elements selected from the array of the heater elements according to the image on the original so that perforations are formed in the parts of the heat-sensitive stencil master material in contact with the selected heater elements, wherein the improvement comprises that the electric voltage applying means applies a continuous electric voltage to each of the selected heater elements to heat the heater element to a predetermined temperature in a predetermined temperature range adequate to thermally perforate the stencil master material and then applies an intermittent electric voltage to the heater element so that the temperature of the heater element is held in said predetermined temperature range for a predetermined time interval adequate to thermally perforate the stencil master material.

The predetermined temperature range adequate to thermally perforate the stencil master material and the predetermined time interval for which the intermittent electric voltage is applied are empirically determined taking into account the sensitivity to perforation of the stencil master material used, the size of the perforation to be formed, the thermal transfer efficiency between the heater element and the stencil master material, and the like.

When the electric voltage applying means applies an intermittent electric voltage to the heater element, duty may be either fixed or changed. Duty is defined as the ratio of the duration of an on-time to the sum of the duration of the on-time and the duration of an off-time adjacent to the on-time in the intermittent pulse. Accordingly when the duration of the on-time and that of the off-time are fixed, the duty of the intermittent electric voltage is fixed, and when the durations of the on-time and the off-time are changed with time, the duty changes each time the electric voltage is turned on or off.

It is preferred that the electric voltage applying means applies said intermittent electric voltage so that the temperature of the center of the surface of the heater element during application of the intermittent voltage minus the periodic variation of the temperature of the center of the surface of the heater element due to application of the intermittent voltage is held in a temperature range not lower than the melting point of the thermoplastic film of the heat-sensitive stencil master material and not higher than a maximum set temperature determined for the heater element (e.g., 400° C.).

Further it is preferred that the electric voltage applying means applies said continuous electric voltage so that at least one of the following two heating rate conditions is satisfied, one being a condition that it takes 25 μsec or more as measured from the initiation of application for the temperature of the center of the surface of the heater element at a room temperature (e.g., 10 to 30° C.) to reach 200° C. and the other being a condition that it takes 50 μsec or more as measured from the initiation of application for the temperature of the center of the surface of the heater element at a room temperature to reach 300° C. It is further preferred that the electric voltage applying means applies said continuous electric voltage so that at least one of the following two heating rate conditions is satisfied, one being a condition that the temperature of the center of the surface of the heater element at a room temperature reaches 200° C. within 150 μsec as measured from the initiation of application and the other being a condition that the temperature of the center of the surface of the heater element at a room temperature reaches 300° C. within 300 μsec as measured from the initiation of application.

Further, when the stencil master is made by moving the thermal head relatively to the stencil master material in a sub-scanning direction substantially perpendicular to a main scanning direction which is equal to the direction of the array of the heater elements, and the densities of the picture elements of the stencil master in the main scanning direction and the sub-scanning direction are both in the range of 200 dpi to 800 dpi, it is preferred that the continuous electric voltage satisfies the following formula (1), $$0.005 \le \frac{v^2\sqrt{P_x P_y}}{r l_x l_y} \le 0.015 \tag{1}$$

wherein v represents the electric voltage (V) to be applied, r represents the mean resistance (Ω) of the heater elements, $P_x$ represents the pitches (μm) of the picture elements in the main scanning direction, $P_y$ represents the pitches (μm) of the picture elements in the sub-scanning direction, $l_x$ represents the length (μm) of the heater element in the main scanning direction, and $l_y$ represents the length (μm) of the heater element in the sub-scanning direction.

Further it is preferred that the stencil master making apparatus of the present invention be provided with a preheating means which carries out preheating on at least said selected heater elements before said electric voltage applying means applies said continuous electric voltage, the preheating consisting of the steps of applying a continuous electric voltage to each of the heater elements to heat the heater element to a predetermined temperature in a predetermined temperature range adequate to preheat the stencil master material and then applying an intermittent electric voltage to the heater element so that the temperature of the heater element is held in said predetermined temperature range for a predetermined time interval adequate to preheat the stencil master material.

In this case, it is preferred that the heater elements of the thermal head are divided into a plurality of blocks so that the heater elements are driven block by block, and the preheating means carries out the preheating on the heater elements in one block while the heater elements in one of the other blocks are perforating the stencil master material.

It is preferred that the preheating means applies said intermittent electric voltage so that the temperature of the center of the surface of the heater element during application of the intermittent voltage minus the periodic variation of the temperature of the center of the surface of the heater element due to application of the intermittent voltage is held in a temperature range between the melting point of the thermoplastic film minus 50° C. and that plus 50° C.

In the stencil master making apparatus in accordance with the present invention, since a continuous electric voltage is applied to the heater element to heat the heater element to a predetermined temperature adequate to perforate the stencil master material (more strictly, the thermoplastic film of the stencil master material) and then an intermittent electric voltage is applied to the heater element so that the temperature of the heater element is held near the predetermined temperature, the temperature of the heater element cannot be raised to an excessively high temperature even if the continuous electric voltage to be initially applied to the heated element is increased. Accordingly, the temperature of the thermoplastic film can be rapidly raised to the perforation generation temperature by increasing the continuous electric voltage initially applied to the heater element without fear of deterioration of the heater element in said oxidation mode. Further by changing the time interval for which the intermittent electric voltage is applied to the heater element according to the sensitivity of the thermoplastic film used, the heat transfer efficiency between the heater element and the thermoplastic film, and the like, the temperature of the thermoplastic film can be raised to a temperature optimum to perforation without being affected by these factors, whereby the size of the perforations can be stabilized and a stencil master which is excellent in printing durability, accuracy in the printing position and printing quality can be made in a short time without fear of deterioration of heater elements of a thermal head.

When the electric voltage applying means applies said intermittent electric voltage so that the temperature of the center of the surface of the heater element during application of the intermittent voltage minus the periodic variation of the temperature of the center of the surface of the heater element due to application of the intermittent voltage is held in a temperature range not lower than the melting point of the thermoplastic film of the heat-sensitive stencil master material and not higher than a maximum set temperature determined for the heater element (e.g., 400° C.), deterioration of the heater elements in said oxidation mode can be more surely avoided.

Though the temperature of the thermoplastic film can be raised to the perforation generation temperature in a shorter time as the continuous electric voltage initially applied to the heater element becomes higher, the heater element undergoes excessively sharp temperature change when the continuous electric voltage initially applied to the heater element is too high, which can cause deterioration of the heater element in said crack mode. Accordingly, in order to prevent the heater element from undergoing such sharp temperature change, it is preferred that the electric voltage applying means applies said continuous electric voltage so that at least one of the following two heating rate conditions is satisfied, one being a condition that it takes 25 μsec or more as measured from the initiation of application for the temperature of the center of the surface of the heater element at a room temperature (e.g., 10 to 30° C.) to reach 200° C. and the other being a condition that it takes 50 μsec or more as measured from the initiation of application for the temperature of the center of the surface of the heater element at a room temperature to reach 300° C. Further, in view of shortening the stencil master making time, it is preferred that the electric voltage applying means applies said continuous electric voltage so that at least one of the following two heating rate conditions is satisfied, one being a condition that the temperature of the center of the surface of the heater element at a room temperature reaches 200° C. within 150 μsec as measured from the initiation of application and the other being a condition that the temperature of the center of the surface of the heater element at a room temperature reaches 300° C. within 300 μsec as measured from the initiation of application.

When the electric voltage applying means applies a continuous electric voltage which satisfies the aforesaid formula (1), the temperature of the heater elements can be increased at a constant rate without being affected by the resolution as will be described in more detail later.

When the heater element is preheated by the preheating means before the main heating (application of the continuous electric voltage for heating the heater element to said predetermined temperature in the temperature range adequate to thermally perforate the stencil master material and application of the intermittent electric voltage for holding the temperature of the heater element in the temperature range), the temperature of the thermoplastic film has been raised to a certain temperature, and accordingly, the temperature of the thermoplastic film can be more rapidly raised to the perforation generation temperature by the main heating and the perforation grows at a higher speed. When the perforation grows at a higher speed, the time for which the intermittent electric current is to be applied to the heater element after application of the continuous electric voltage can be shortened, whereby the time for which the heater element is exposed to high temperature can be shortened, which is advantageous from the viewpoint of preventing deterioration of the heater element in the oxidation mode. Further, when the heater elements of the thermal head are divided into a plurality of blocks so that the heater elements are driven block by block, and the preheating is effected for the heater elements in one block while the heater elements in one of the other blocks are perforating the stencil master material, the total stencil master making time is shortened.

DESCRIPTION OF THE PREFERRED EMBODIMENT

Figure 1:
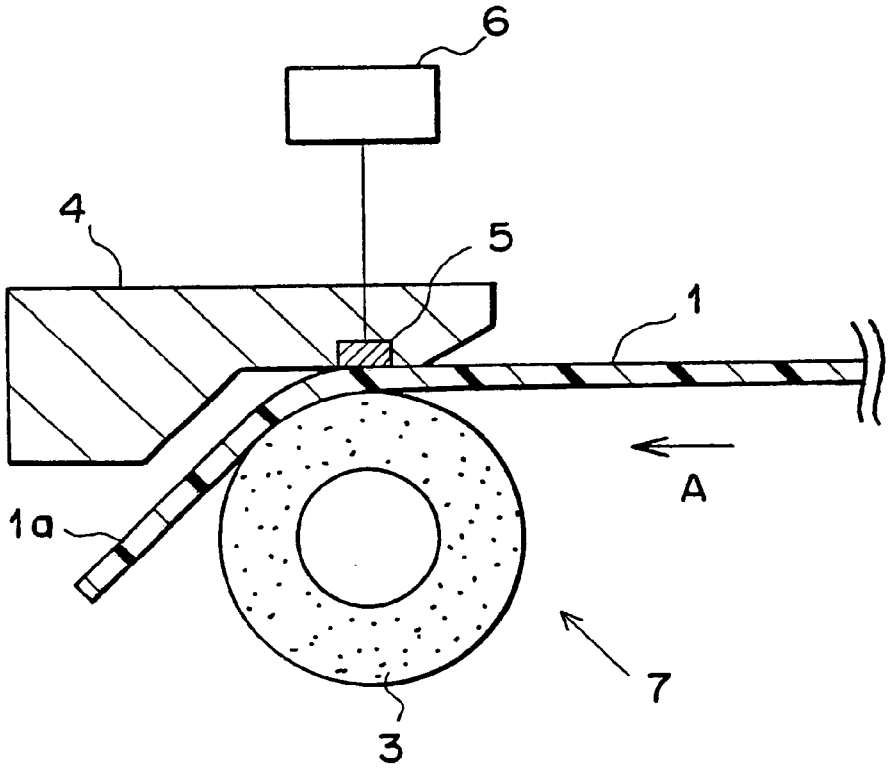
FIG. 1 is a schematic cross-sectional view of a heat-sensitive stencil master making apparatus in accordance with an embodiment of the present invention.

FIG. 1 shows a stencil master making apparatus in accordance with an embodiment of the present invention. In FIG. 1, the stencil master making apparatus 7 of this embodiment comprises a thermal head 4 having an array of a plurality of heater elements 5 (only one is visible in FIG. 1), and a platen roller 3. A heat-sensitive stencil master material 1 is conveyed in the direction of arrow A when the platen roller 3 is driven by an electric motor (not shown) and passed between the platen roller 3 and the thermal head 4 with the side of a thermoplastic film la of the stencil master material 1 facing the thermal head 4. Thus the heater elements 5 of the thermal head 4 are pressed against the thermoplastic film 1*a* of the stencil master material 1 and the thermoplastic film 1*a* is perforated in a pattern representing image data of an original by selectively energizing the heater elements 5 by an electric voltage applying means (a thermal head drive circuit) 6. The heater elements 5 are divided into four blocks and are driven by the thermal head drive circuit 6 block by block.

The thermal head drive circuit 6 applies a continuous electric voltage to each of the heater elements 5 until the temperature of the heater element reaches a predetermined temperature Tm in a predetermined temperature range adequate to thermally perforating the stencil master material 1 and then applies chopped pulses having a constant or varied duty to the heater element 5 so that the temperature of the heater element 5 is held in said predetermined temperature range for a predetermined time interval. The predetermined temperature Tm in said predetermined temperature range will be referred to as "the initial perforation temperature Tm", hereinbelow. It is preferred that the thermal head drive circuit 6 applies the continuous electric voltage so that the temperature of the thermoplastic film 1*a* at the time the temperature of the heater element 5 reaches the initial perforation temperature Tm is higher than the perforation generation temperature Ta described above from the viewpoint of shortening the stencil master making time.

Figure 2:
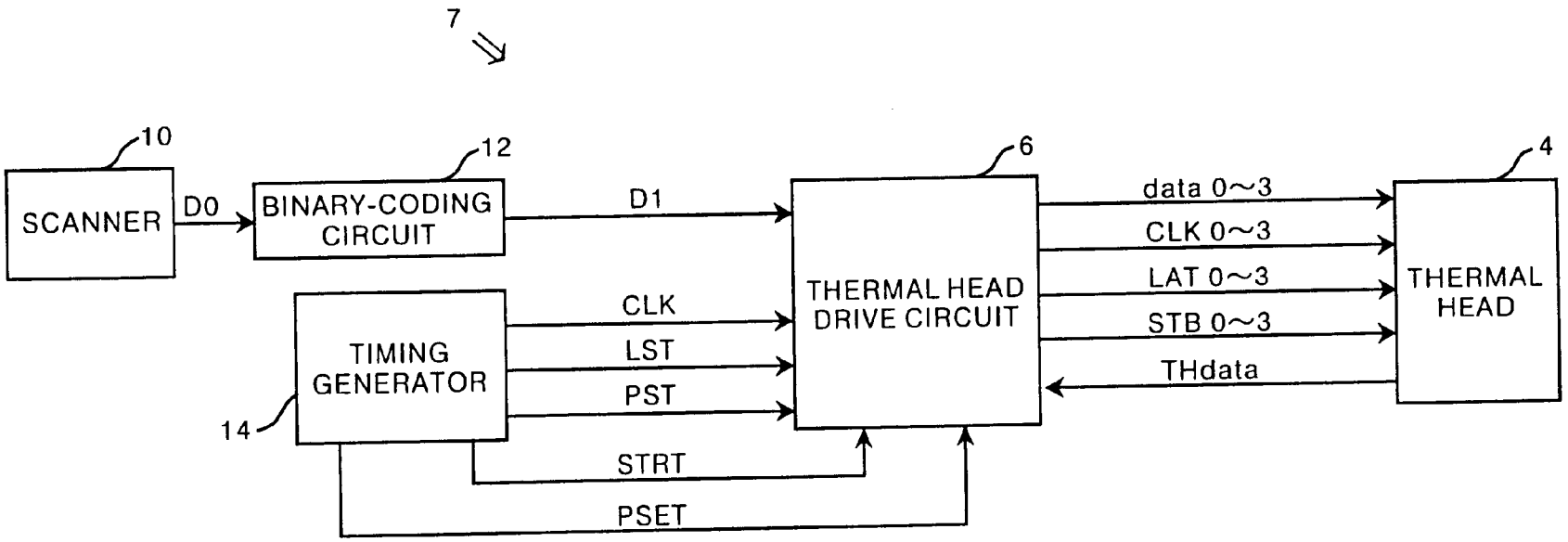
FIG. 2 is a block diagram showing a control circuit of the stencil master making apparatus shown in FIG. 1.

FIG. 2 is a block diagram showing a control circuit of the stencil master making apparatus 7 shown in FIG. 1. In the stencil master making apparatus 7, many-valued data D0 representing image data read out by a scanner 10 are input into a binary-coding circuit 12 and the binary-coding circuit 12 binary-codes the many-valued data D0 and outputs binary-coded image data D1 to the thermal head drive circuit 6. A timing generator 14 generates a clock CLK, a line start signal LST which defines a start point of scanning in a main scanning direction, a page start signal PST, a strobe start signal STRT and a parameter set signal PSET and outputs them to the thermal head drive circuit 6.

Figure 3:
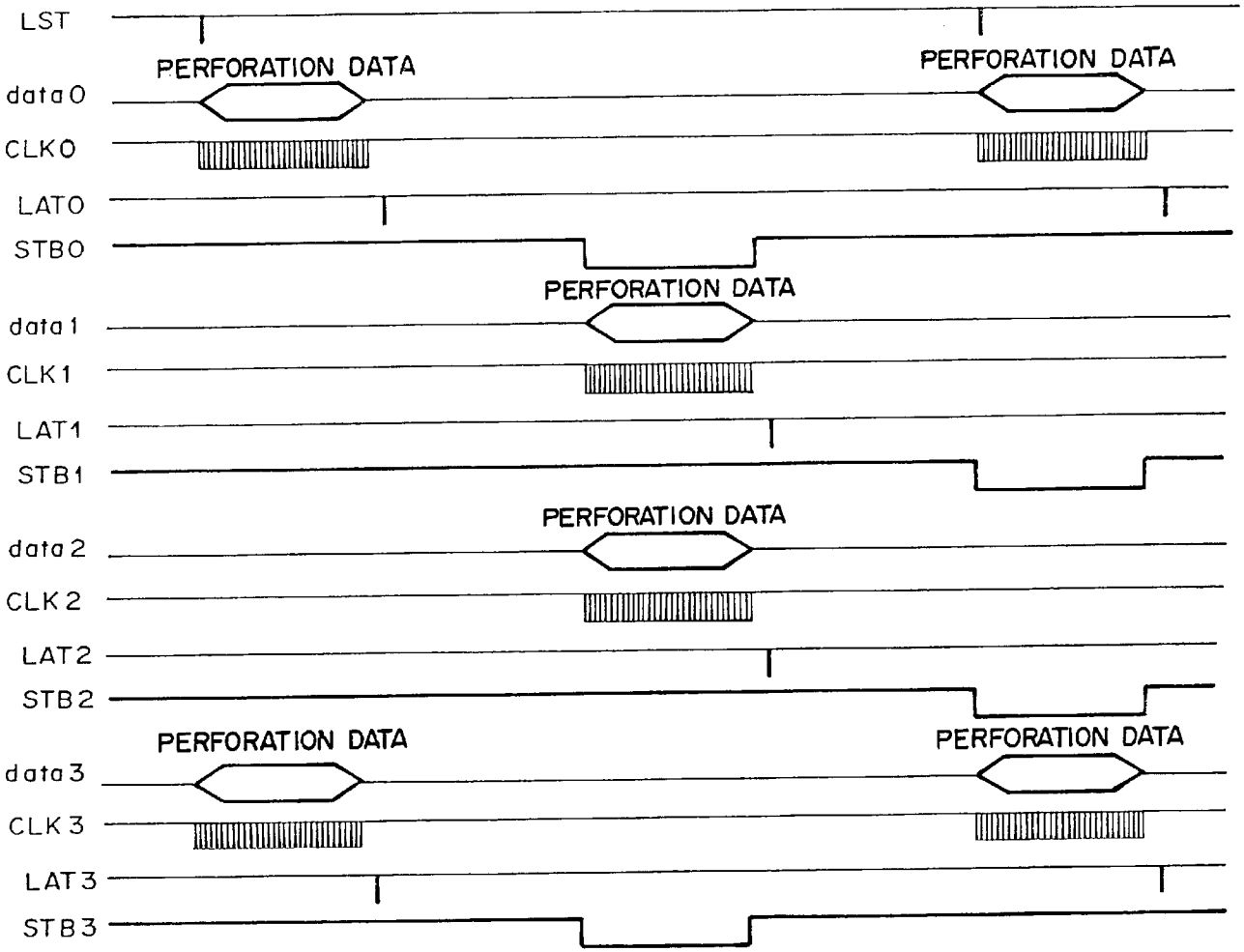
FIG. 3 is a timing chart for the line start signal and the signals output from the thermal head drive circuit in the stencil master making apparatus.

The thermal head drive circuit 6 receives the clock CLK, the line start signal LST, the page start signal PST, the strobe start signal STRT, the parameter set signal PSET and thermistor data $Th_{data}$ and generates, on the basis of these signals, four series of printing data data0 to data3 respectively for the first to fourth blocks of the heater elements 5, printing clocks CLK0 to CLK3 for outputting the printing data data0 to data3 respectively to the first to fourth blocks of the heater elements 5, latch signals LAT0 to LAT3 for converting serial signals to parallel signals in response to each of two printing data trains to be described later and holding the parallel signals, strobe signals STB0 to STB3 to be respectively applied to the first to fourth blocks of the heater elements 5. The thermal head 4 makes a stencil master under the control of these signals. The thermistor data $TH_{data}$ is output from the thermal head 4 and represent the temperature of the thermal head 4, and more strictly, a temperature detected by a thermistor provided on a base of the thermal head 4. This temperature is equalized to an atmospheric temperature when the stencil master making apparatus 7 is not operated for several hours or more, and is raised above the atmospheric temperature when the thermal head 4 is frequently operated a plurality of times in a short time and heat is accumulated on the thermal head 4. The temperature of the thermal head 4 affects stencil master making. The temperature of the thermal head 4 as detected by the thermistor will be referred to as "the basic thermal head temperature", hereinbelow. FIG. 3 shows a timing chart for the line start signal LST and the signals output from the thermal head drive circuit 6. In FIG. 3, the strobe signals STB0 to STB3 are shown as square pulses for the purpose of simplicity though they should be chopped pulses as will be described later.

The thermal head drive circuit 6 controls the respective blocks of the heater elements 5 of the thermal head 4 by use of the printing data data0 to data3, the latch signals LAT0 to LAT3, the strobe signals STB0 to STB3 and the printing clocks CLK0 to CLK3. The printing data data0 to data3 are input into the thermal head 4 as serial data by way of a serial input shift register (e.g., of 1024 bits: not shown), are converted into parallel data and are held in a latch portion (not shown) in the thermal head 4 by the latch signals LAT0 to LAT3 generated at predetermined timings. The heater elements 5 are heated at desired timings on the basis of logical products of the strobe signals STB0 to STB3 and the data held in the latch portion.

Figure 4:
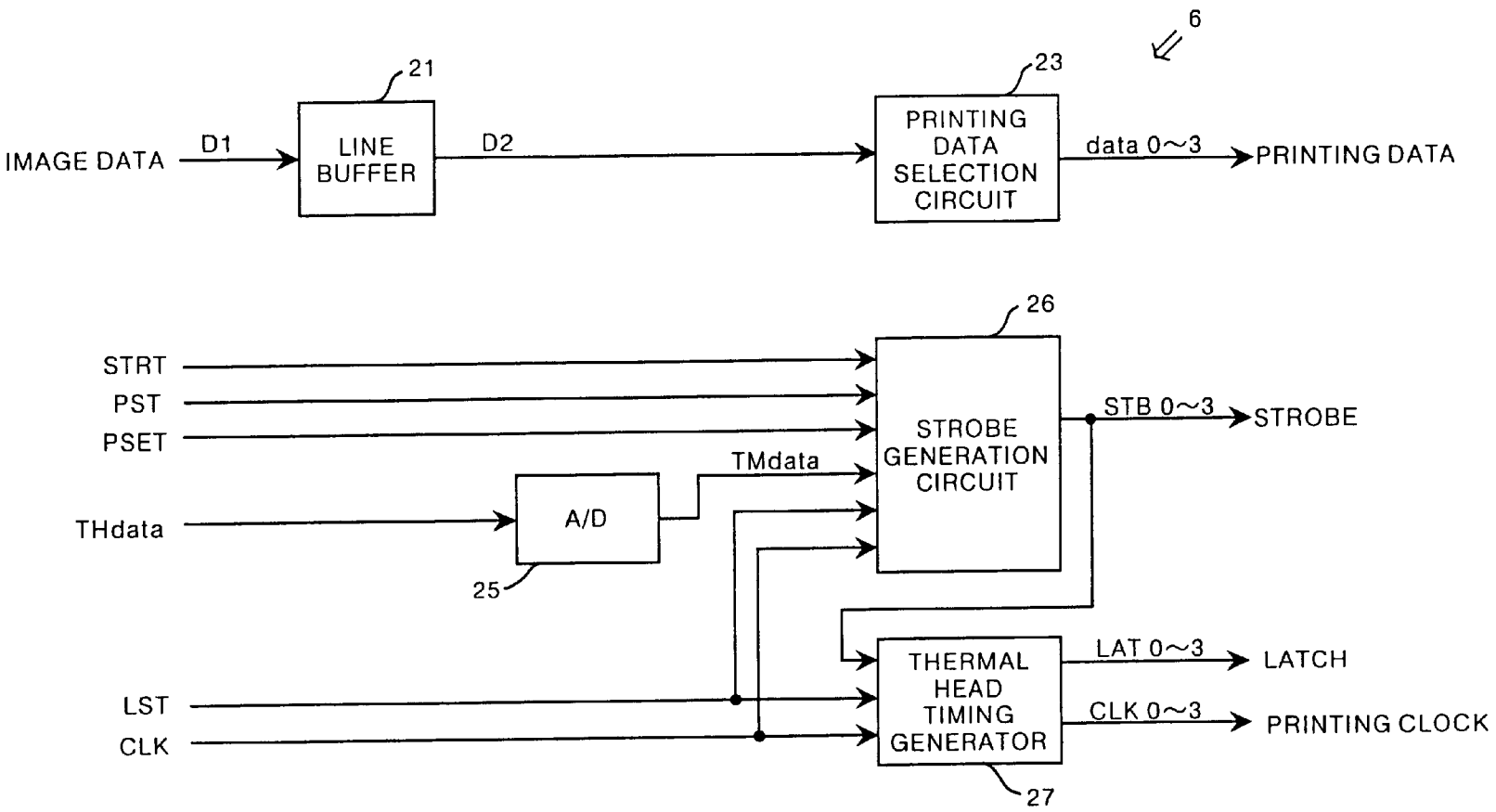
FIG. 4 is a block diagram showing in detail the thermal head drive of the stencil master making apparatus.

FIG. 4 is a block diagram showing in detail the thermal head drive circuit 6. A printing data selection circuit 23 outputs, at the timings shown in FIG. 3, the printing data data0 to data3 in sequence on the basis of image data D2 output from a line buffer 21 on the basis of the image data D1.

An A/D converter 25 digitizes the thermistor data $TH_{data}$ and outputs as temperature data $TM_{data}$.

A thermal head timing generator 27 generates printing clocks CLK0 to CLK3 and latch signals LAT0 to LAT3 on the basis of the line start signal LST, the strobe signals STB0 to STB3 and the clock CLK and outputs them at the timings shown in FIG. 3.

Figure 5:
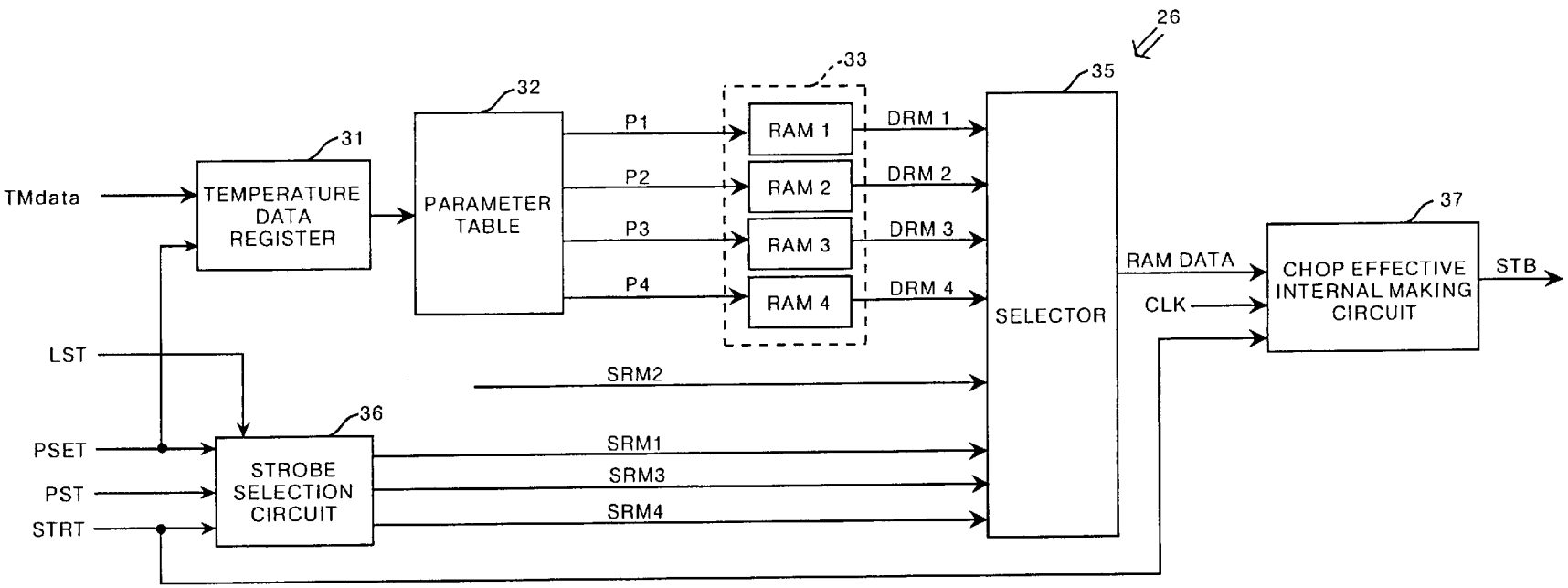
FIG. 5 is a block diagram showing in detail the strobe generation circuit of the thermal head drive circuit.

FIG. 5 shows in detail a strobe generation circuit 26 shown in FIG. 4. In the strobe generation circuit 26, the temperature data $TM_{data}$ are stored in a temperature data register 31 according to the parameter set signal PSET. The stored temperature data $TM_{data}$ are output to a parameter table 32.

The parameter table 32 outputs a preheating strobe parameter P1, a standard main strobe parameter P2, a short main strobe parameter P3 and a history main strobe parameter P4 corresponding to the temperature data $TM_{data}$ to a RAM 33 having parameter RAM sections RAM1 to RAM4. The preheating strobe parameter P1 is stored in the parameter RAM section RAM1, the standard main strobe parameter P2 is stored in the parameter RAM section RAM2, the short main strobe parameter P3 is stored in the parameter RAM section RAM3 and the history strobe parameter P4 is stored in the parameter RAM section RAM4. The following tables show examples of these parameters.

| Address | Pulse number | off-time | on-time |
|---|---|---|---|
| | preheating strobe parameter | | |
| 0 | 1 | 0 | 10 |
| 1 | 1 | 3 | 3 |
| 2 | 4 | 3 | 2 |
| 3 | 0 | 0 | 0 |
| 4 | 0 | 0 | 0 |
| | standard main strobe parameter | | |
| 0 | 1 | 0 | 80 |
| 1 | 1 | 10 | 10 |
| 2 | 4 | 10 | 7 |
| 3 | 0 | 0 | 0 |
| 4 | 0 | 0 | 0 |
| | short main strobe parameter | | |
| 0 | 1 | 0 | 100 |
| 1 | 1 | 10 | 10 |
| 2 | 4 | 10 | 7 |
| 3 | 0 | 0 | 0 |
| 4 | 0 | 0 | 0 |
| | history strobe parameter | | |
| 0 | 4 | 10 | 10 |
| 1 | 2 | 10 | 7 |
| 2 | 0 | 0 | 0 |
| 3 | 0 | 0 | 0 |
| 4 | 0 | 0 | 0 |

The preheating strobe parameter P1, the short main strobe parameter P3, the history strobe parameter P4, and the parameter RAM sections RAM1, RAM3 and RAM4 are not used in the stencil master making apparatus 7 of this embodiment but are used in another stencil master making apparatus to be described later. They are described here only for the purpose of convenience of description of the parameter table 32.

A selector 35 selects one of the parameter RAM sections RAM1 to RAM4 according to a preheating strobe effective signal SRM1, a standard main strobe selection signal SRM2, a short main strobe effective signal SRM3 and a history strobe effective signal SRM4 output from a strobe selection circuit 36, and outputs data stored in the selected parameter RAM section as RAM data for parameter. That is, when the preheating strobe effective signal SRM1 is effective and one of the standard main strobe selection signal SRM2, the short main strobe effective signal SRM3 and the history strobe effective signal SRM4 is effective, the selector 35 outputs the data DRM1 stored in the parameter RAM section RAM1 as the RAM data for parameter. When the standard main strobe selection signal SRM2 and the short main strobe effective signal SRM3 are both effective, the selector 35 outputs the data DRM2 stored in the parameter RAM section RAM2 as the RAM data for parameter. When the standard main strobe selection signal SRM2 is ineffective and the short main strobe effective signal SRM3 is effective, the selector 35 outputs the data DRM3 stored in the parameter RAM section RAM3 as the RAM data for parameter. When the history strobe effective signal SRM4 is effective, the selector 35 outputs the data DRM4 stored in the parameter RAM section RAM4 as the RAM data for parameter. In this particular embodiment, the standard main strobe selection signal SRM2 is constantly effective.

A chop effective interval making circuit 37 becomes active when the strobe start signal STRT is input thereinto from the timing generator 14, and makes a strobe signal STB on the basis of one of the aforesaid tables selected according to the data (DRM1, DRM2, DRM3 or DRM4) selected by the selector 35. As shown in the tables, in the strobe signal STB, the number of pulses, the off-time and the on-time are set address by address which is incremented by 1 from 0. When the number of pulses become 0 as the address is incremented one by one, the strobe signal STB is interrupted until another strobe start signal STRT is input from the timing generator 14. In this particular embodiment, the data DRM2 in the parameter RAM section RAM2 is selected by the selector 35 and the number of pulses, the off-time and the on-time are set by the chop effective interval making circuit 37 on the basis of the standard main strobe parameter P2.

Operation of the stencil master making apparatus 7 of this embodiment will be described, hereinbelow. Since the blocks of the heater elements 5 of the thermal head 4 operate in the same manner, the suffix of the sign of each signal representing the block of the heater elements 5 is omitted in the description below.

Figure 6:
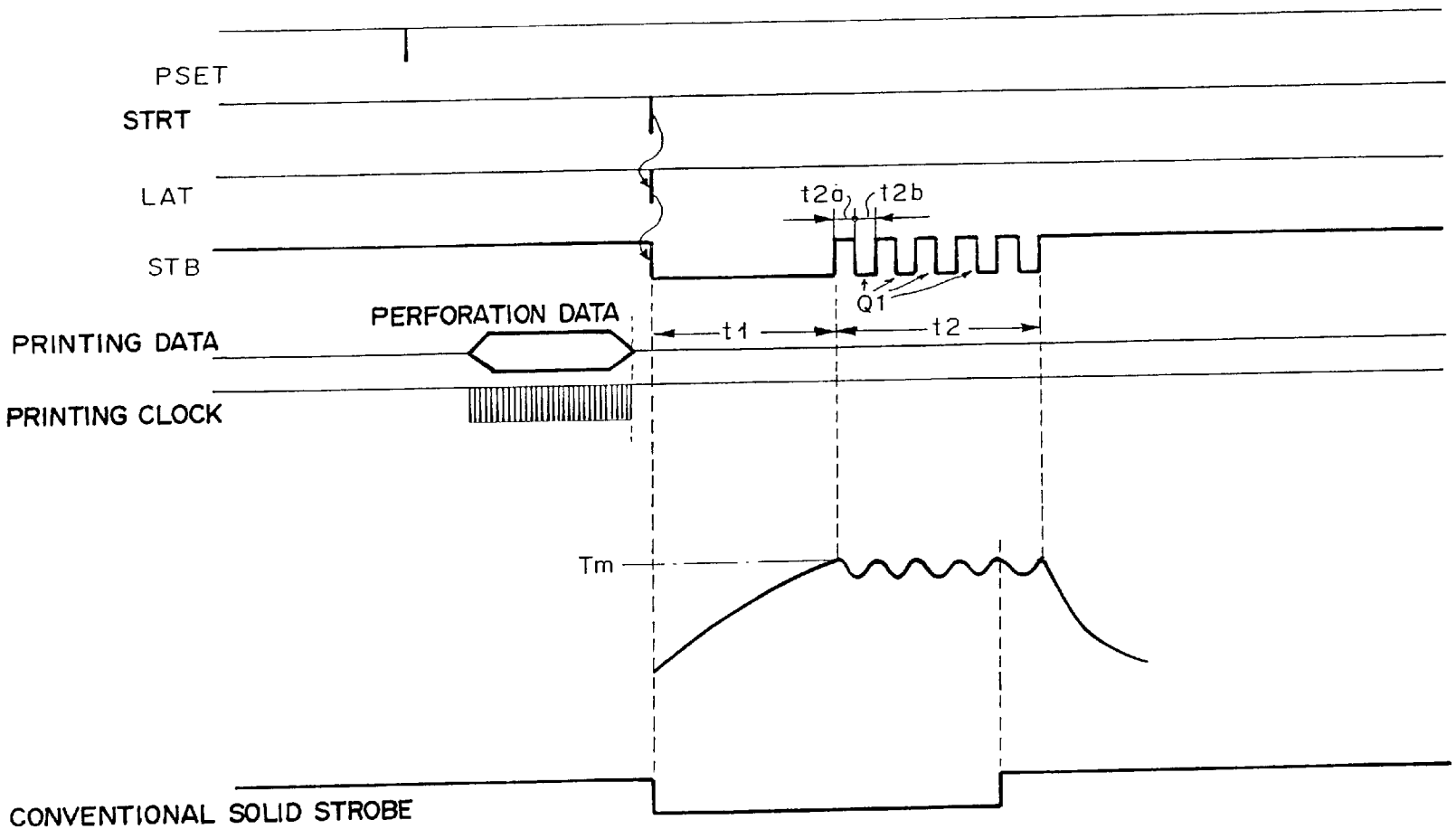
FIG. 6 is a timing chart showing the action of the strobe generation circuit and the change of the temperature of the heater element when chopped pulses are employed as the strobe signal.

FIG. 6 is a timing chart showing the action of the strobe generation circuit 26 and the change of the temperature of the heater element 5 when chopped pulses are employed as the strobe signal STB in order to apply an intermittent electric voltage to the heater element 5.

The time which is required for the temperature of the heater element 5 to reach a predetermined temperature (initial perforation temperature) Tm in a temperature range adequate to thermally perforate the thermoplastic film from normal temperatures (e.g., 10 to 30° C.) is employed as a main solid strobe time t1, and the time t2 for which the temperature of the heater element 5 is to be held in the temperature range is substituted for the duty (on-time t2*b* and off-time t2*a*) of each main chopped pulse Q1 and the number N1 of the main chopped pulses Q1, whereby these times t1 and t2 are set as a standard main strobe parameter P2. The relations between these times and change in temperature have been empirically obtained and are prepared in the parameter table 32 (FIG. 5) as values determined taking into account change in the ambient temperature. It is preferred that the upper limit of the temperature range adequate to thermally perforate the thermoplastic film be lower than the maximum set temperature Tmax of the heater element 5.

According to the set conditions, a strobe signal STB is generated by the parameter RAM section RAM2, the selector 35 and the chop effective interval making circuit 37 of the strobe generation circuit 26.

Figures 7A, 7B, 7C:
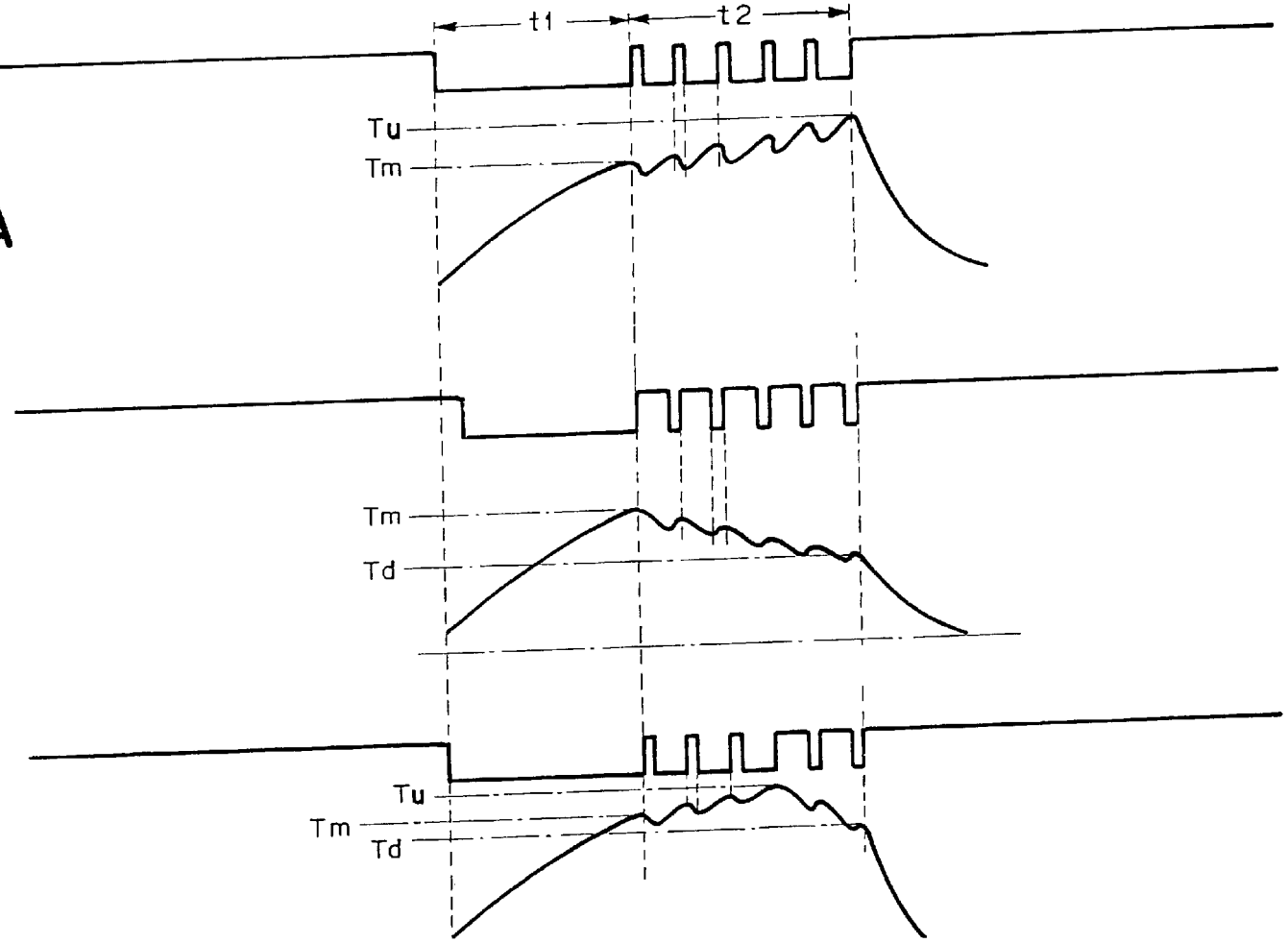
FIGS. 7A to 7C are views for illustrating change of the temperature of the heater element when the duty and the number of the main chopped pulses are changed.

By changing the duty of the main chopped pulses Q1 and/or the number of the main chopped pulses Q1 during the main chopped pulse interval t2, the temperature of the heater element 5 can be raised (to a temperature Tu) or lowered (to a temperature Td) from the initial perforation temperature Tm as shown in FIGS. 7A to 7C. The strobe time can be set so that the temperature of the heater element constantly becomes a desired temperature by changing the heating pattern according to the basic thermal head temperature as will be described in more detail later.

Figure 8:
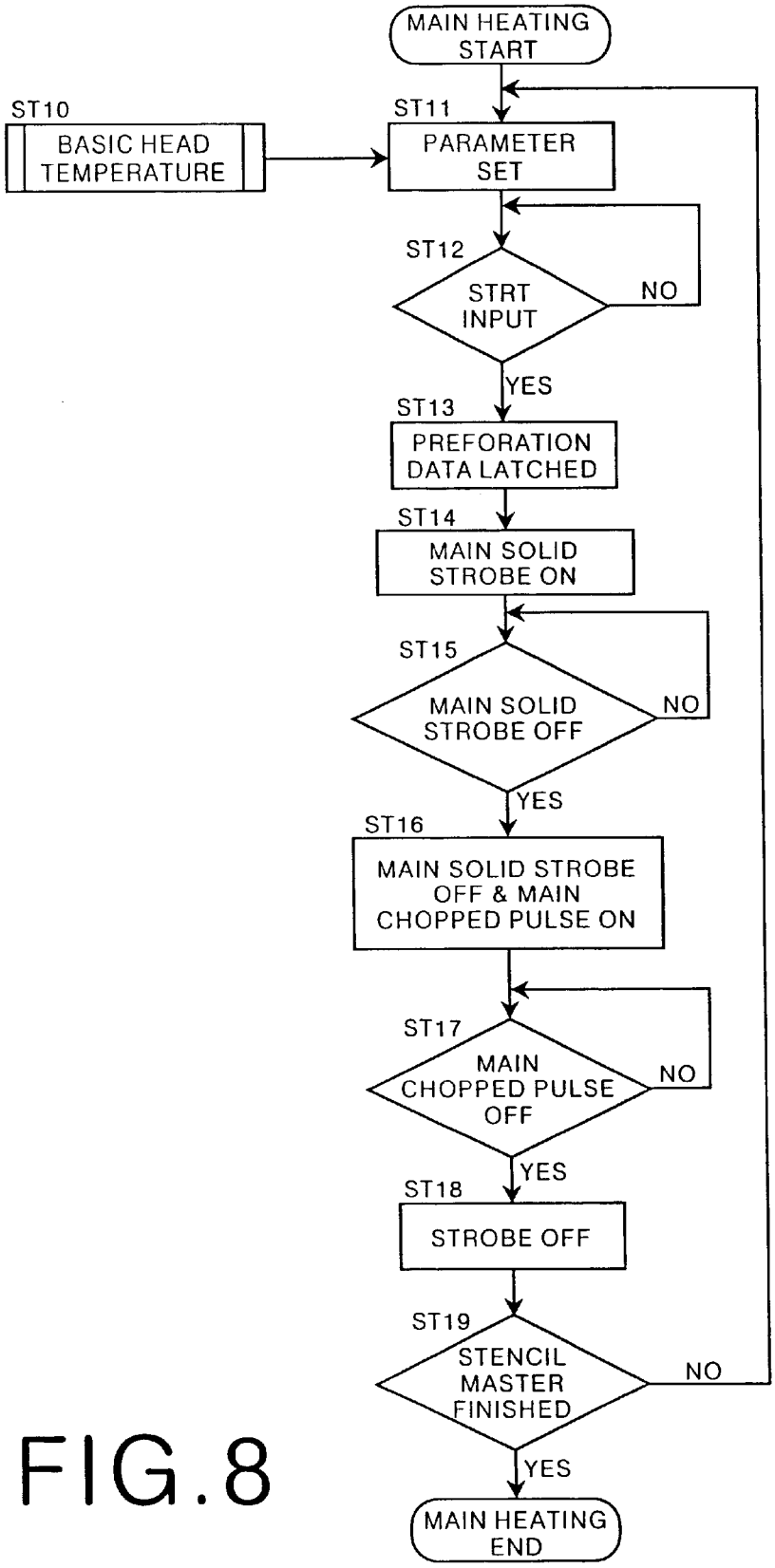
FIG. 8 is a flow chart for illustrating the operation of the strobe generation circuit of the stencil master making apparatus.

Operation of the strobe generation circuit 26 will be described with reference to the flow chart shown in FIG. 8, hereinbelow.

When a parameter set signal PSET is input into the strobe selection circuit 36 from the timing generator 14, a standard main strobe parameter P2 corresponding to the basic thermal head temperature, that is, the temperature data $T_{data}$ from the temperature data register 31, is input into the RAM 33 from the parameter table 32 and data DRM2 based on the standard main strobe parameter P2 is input into the selector 35 from the RAM 33. The selector 35 outputs the data DRM2 when the standard main strobe selection signal SRM2 and the short main strobe effective signal SRM3 are both effective and sets the number of pulses N1, the off-time t2*a* and on-times t1 and t2*b* in the chop effective interval making circuit 37 on the basis of the data DRM2. Then a page start signal PST rises and making a stencil master is started. (steps ST10 and ST11)

The strobe generation circuit 26 (FIG. 4) is activated upon receipt of a strobe start signal STRT. (step ST12) The strobe generation circuit 26 latches, in a latch circuit in the thermal head 4, perforation data stored in the shift register in the thermal head 4 when the strobe selection circuit 36 receives the strobe start signal STRT. (step ST13) Thereafter the chop effective interval making circuit 37 turns the strobe signal STB low (L) to turn the main solid strobe on. (stepST14) When the time t1 lapses, the chop effective interval making circuit 37 turns the strobe signal STB high (H) to turn the main solid strobe off. (step ST15) Then the chop effective interval making circuit 37 alternately turns high and low the strobe signal STB, thereby outputting main chopped pulses Q1 starting from an off-state. (step ST16) When the number of the output main chopped pulses Q1 reaches the set number N1, the chop effective interval making circuit 37 turns high the strobe signal STB, thereby turning off the main strobe. (steps ST17 and ST18) When the page start signal PST has fallen, it is determined that the stencil master has been finished, and this processing is ended. Otherwise, steps ST11 and the following steps are repeated. (step ST19) The chop effective interval making circuit 37 determines the effective interval of the strobe on the basis of count data obtained by counting the number of clocks CLK and the data (one of DRM1 to DRM4) selected by the selector 35 and outputs strobe signals STB0 to STB3.

By controlling the electric voltage applied to the heater element 5 in the manner described above, the temperature of the heater element 5 reaches the initial perforation temperature Tm in the time interval t1 when the strobe signal STB is low, that is, when the main solid strobe is on. Thereafter the temperature of the heater element 5 is held near the initial perforation temperature Tm for the time interval t2 by application of the main chopped pulses Q1. Since the time interval t2 is adequate to perforation, perforations of a proper size can be formed in the stencil master material 1.

Changes with time t of the temperature a of the heater element 5, the temperature b of the thermoplastic film, the shrinkage area c and the size d of the perforation when the heater element 5 is energized in the manner described above are shown in FIG. 35C. It is preferred that the temperature Tm' of the thermoplastic film when the heater element 5 is at the initial perforation temperature Tm be higher than the perforation generation temperature Ta from the viewpoint of shortening the stencil master making time. As can be seen from FIG. 35C, the temperature b of the thermoplastic film comes to increase more gently after reaching the temperature Tm' and then gradually approaches the temperature of the heater element.

When the heater element 5 is energized in this manner, the heater element 5 can be held at a temperature adequate to perforate the thermoplastic film for the time interval t2 for which the main chopped pulses Q1 are kept generated. Thus, by changing the time interval t2 for which the main chopped pulses Q1 are kept generated, perforations of a desired size can be formed in the thermoplastic film irrespective of the sensitivity of the thermoplastic film.

Further, by setting the duty of the main chopped pulses Q1 so that the temperature of the heater element 5 does not exceed the maximum set temperature Tmax of the heater element 5 according to the time interval t2 which may be set taking into account the sensitivity of the thermoplastic film, the time interval t2 can be elongated without fear of deterioration of the heater element 5 when low-sensitive stencil master making material is used.

Figure 35A:
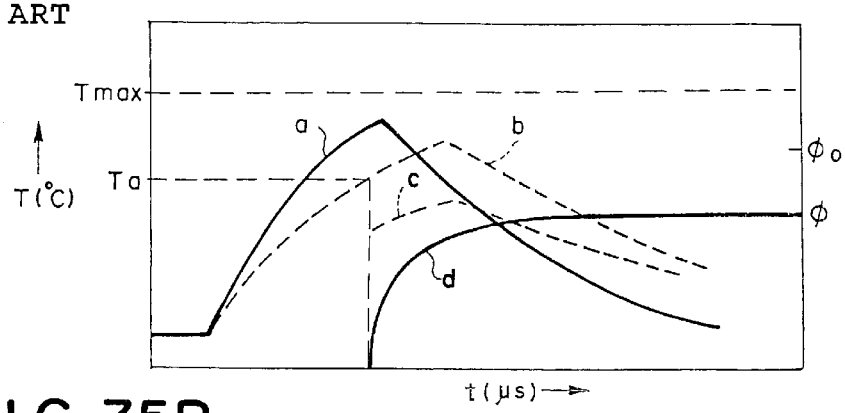
FIG.35A PRIOR ART
FIG. 35A is a view showing the change with time of the temperature of the heater element, the temperature of the thermoplastic film, the shrinkage area and the size of the perforation when thermoplastic film of low sensitivity is perforated with the heater element applied with heater drive power under the condition for thermoplastic film of high sensitivity in the conventional stencil master making apparatus.
Figure 35B:
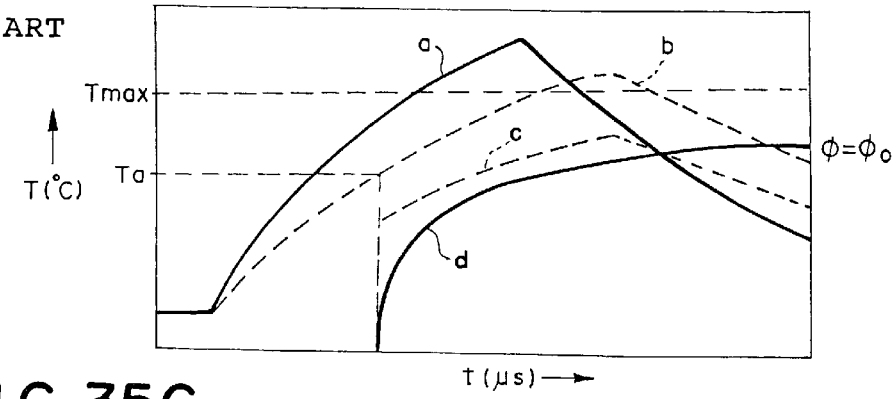
FIG.35B PRIOR ART
FIG. 35B is a view showing the change with time of the temperature of the heater element, the temperature of the thermoplastic film, the shrinkage area and the size of the perforation when thermoplastic film of low sensitivity is perforated with the heater element applied with heater drive power for a time interval longer than that in the condition for thermoplastic film of high sensitivity in the conventional stencil master making apparatus.
Figure 35C:
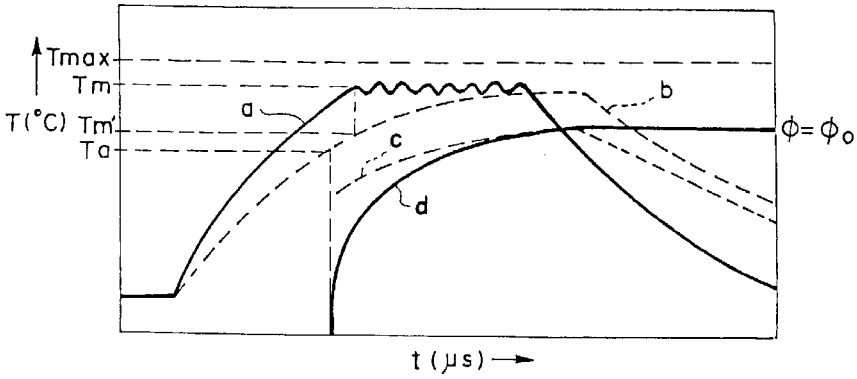
FIG. 35C is a view showing the change with time of the temperature of the heater element, the temperature of the thermoplastic film, the shrinkage area and the size of the perforation when thermoplastic film of low sensitivity is perforated with the heater element applied with heater drive power in accordance with the present invention.

That is, since the temperature of the thermoplastic film of any sensitivity approaches the temperature of the heater element 5 when the time interval t2 is elongated, stencil master material of any sensitivity can be perforated provided that the initial perforation temperature Tm is set higher than the perforation generation temperature Ta, and the size of the perforations becomes slightly larger than the maximum value of the shrinkage area as shown in FIG. 35C.

Though the above description has been made assuming that the voltage of the continuous electric voltage is set at the same level as the typical electric voltage used in the conventional stencil master making apparatus where only a continuous electric voltage is applied and the continuous electric voltage is cut after a predetermined time, the continuous electric voltage applied in this invention may be higher than the typical electric voltage.

Figure 36A:
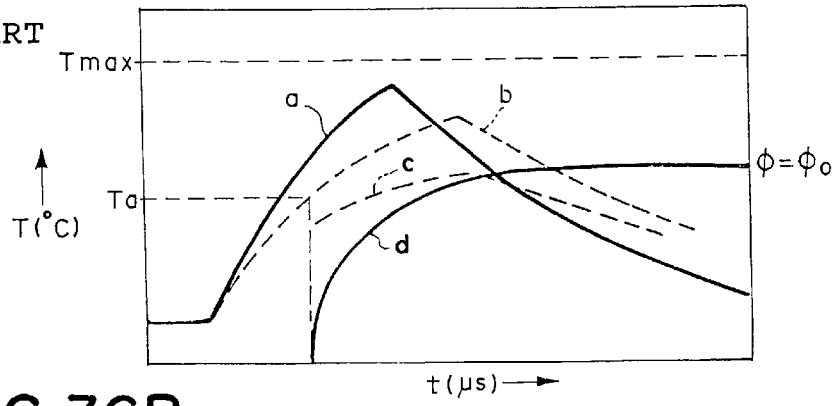
FIG.36A PRIOR ART
FIG. 36A is a view showing the change with time of the temperature of the heater element, the temperature of the thermoplastic film, the shrinkage area and the size of the perforation when thermoplastic film is perforated with the heater element applied with heater drive power under the condition employed in the conventional stencil master making apparatus.
Figure 36B:
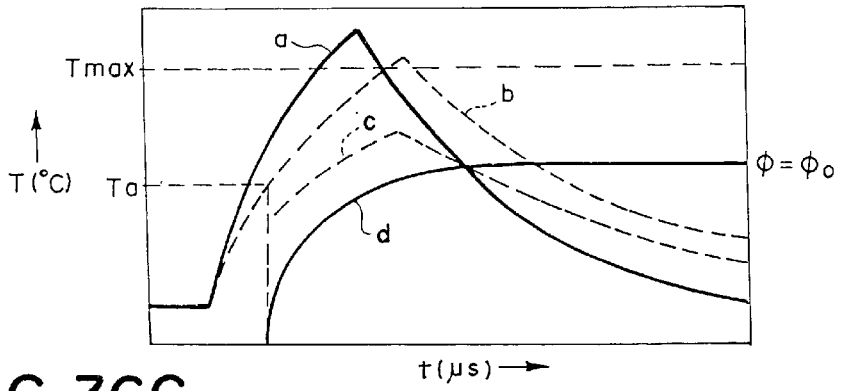
FIG.36B PRIOR ART
FIG. 36B is a view showing the change with time of the temperature of the heater element, the temperature of the thermoplastic film, the shrinkage area and the size of the perforation when thermoplastic film is perforated with the heater element applied with larger heater drive power for a shorter time interval than that in the condition employed in the conventional stencil master making apparatus.
Figure 36C:
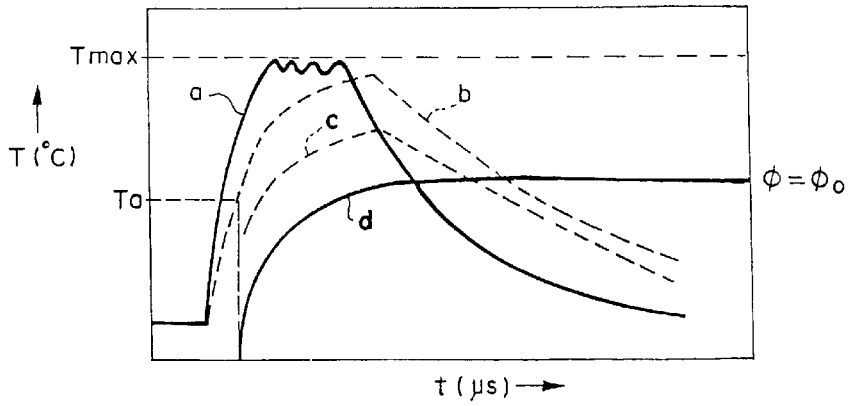
FIG. 36C is a view showing the change with time of the temperature of the heater element, the temperature of the thermoplastic film, the shrinkage area and the size of the perforation when thermoplastic film is perforated with the heater element applied with heater drive power larger than that in FIG. 35C in accordance with the present invention.

FIG. 36C shows changes with time of the temperature of the heater element (line a), the temperature of the thermoplastic film (line b), the shrinkage area (line c), and the size of the perforation (line d) when the continuous electric voltage is increased more than in FIG. 36B. As can be seen from FIG. 36C, when the continuous electric voltage is increased, the temperature of the thermoplastic film can be raised to the perforation generation temperature Ta in a shorter time and the size of the perforation can be enlarged to the target size in a shorter time. At the same time, since the continuous electric voltage is switched to the intermittent electric voltage before the temperature of the heater element 5 reaches the maximum set temperature Tmax of the heater element 5, deterioration of the heater element 5 in the oxidation mode can be suppressed.

That is, the time for which the continuous electric voltage is applied to the heater element 5 is set so that the temperature of the heater element 5 does not exceed the maximum set temperature Tmax of the heater element 5. As the continuous electric voltage is increased, the temperature of the heater element 5 rises more quickly and accordingly the temperature of the thermoplastic film rises more quickly, whereby generation of the perforation is started in a shorter time.

Further as can be seen from comparison of FIG. 36C and FIG. 36A, the temperature of the thermoplastic film at a given time from the time the initial perforation is generated to the time the temperature of the thermoplastic film is maximized is higher in FIG. 36C than in FIG. 36A, and accordingly the time required for the size of the shrinkage area to reach a predetermined size becomes shorter when the continuous electric voltage is increased. That is, the time from initiation of application of the continuous electric voltage to the time the size of the perforation reaches the target size is shortened.

However when the heating rate (the rate at which the temperature of the heater element 5 rises) is too high, fear of deterioration of the heater element 5 in the crack mode arises and accordingly the level of the continuous electric voltage should be limited.

For this purpose, it is preferred that the thermal head drive circuit 6 (FIG. 2) applies the continuous electric voltage so that at least one of the following two heating rate conditions is satisfied.

1. A condition that it takes 25 $\mu$sec or more as measured from the initiation of application of the continuous electric voltage for the temperature of the center of the surface of the heater element 5 at a room temperature (e.g., 10 to 30° C.) to reach 200° C.

2. A condition that it takes 50 μsec or more as measured from the initiation of application of the continuous electric voltage for the temperature of the center of the surface of the heater element at a room temperature to reach 300° C.

On the other hand, when the heating rate is too low, the effects of energizing the heater element 5 by a combination of the continuous electric voltage and the intermittent electric voltage are nullified. That is, as described above, the effects of energizing the heater element 5 by a combination of the continuous electric voltage and the intermittent electric voltage are to rapidly raise the temperature of the heater element 5 to the initial perforation temperature without fear of deterioration of the heater element 5 in the oxidation mode, to heat even low-sensitive or thick thermoplastic film to a temperature adequate to grow the perforation to a sufficient size without fear of deterioration of the heater element 5 in the oxidation mode, and to control the temperature of the heater element adequate to control the size of the perforation. When the heating rate is too low, these effects are hardly obtained.

Accordingly, it is preferred that the thermal head drive circuit 6 applies the continuous electric voltage so that at least one of the following two heating rate conditions is satisfied.

1. A condition that the temperature of the center of the surface of the heater element at a room temperature reaches 200° C. within 150 μsec as measured from the initiation of application.

2. A condition that the temperature of the center of the surface of the heater element at a room temperature reaches 300° C. within 300 μsec as measured from the initiation of application.

We have found that the rate at which the temperature of the heater element 5 is raised depends upon the power density applied to the heater element 5 (the power applied to the heater element 5 per unit area thereof) and the resolution so long as the shape and/or the structure of the heater element 5 is the same, and that the influence of the resolution depends upon the geometric mean of the pitches in the main scanning direction and the sub-scanning direction.

We have further found that when the continuous electric voltage applied to the heater element 5 satisfies the following formula (1), provided that the resolution in the main scanning direction and the sub-scanning direction of the stencil master to be made are both in the range of 200 dpi to 800 dpi, the aforesaid effects of energizing the heater element 5 by a combination of the continuous electric voltage and the intermittent electric voltage can be obtained without affected by the resolution.

$$0.005 \le \frac{v^2\sqrt{P_x P_y}}{r l_x l_y} \le 0.015 \quad (1)$$

wherein v represents the continuous electric voltage (V) to be applied, r represents the mean resistance (Ω) of the heater elements, $P_x$ represents the pitches (μm) of the picture elements in the main scanning direction, $P_y$ represents the pitches (μm) of the picture elements in the sub-scanning direction, $l_x$ represents the length (μm) of the heater element in the main scanning direction, and $l_y$ represents the length (μm) of the heater element in the sub-scanning direction.

$$\frac{v^2}{r l_x l_y}$$

(2) in the above formula (1) represents the power density.

Though, in the cases shown in FIGS. 35C and 36C, the chopped pulses Q1 are applied so that the temperature of the heater element is kept substantially constant at the initial perforation temperature Tm though slightly goes up and down, it is possible to change the duty of the chopped pulses so that the temperature of the heater element 5 is changed during application of the chopped pulses Q1 in order to control the size of the perforation.

Figure 9A:
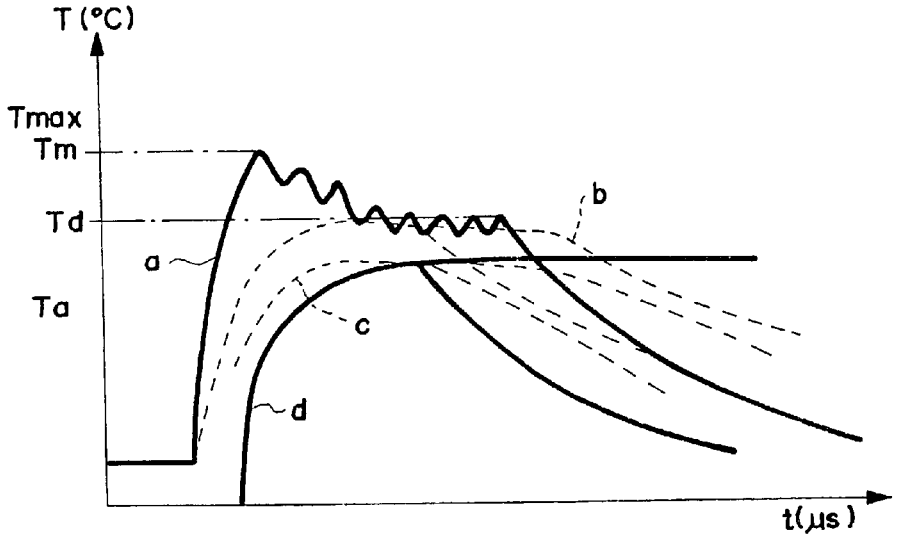
FIG. 9A shows changes with time of the temperature of the heater element, the temperature of the thermoplastic film, the shrinkage area and the size of the perforation when the duty of the main chopped pulses is set so that the temperature of the heater element is gradually lowered from the initial perforation temperature.

For example, when the duty of the chopped pulses Q1 is set so that the temperature of the heater element 5 is gradually lowered from the initial perforation temperature Tm to a temperature Td and is held substantially constant at the temperature Td as shown in FIG. 9A, the temperature of the thermoplastic film rises with increase in the temperature of the heater element 5 during application of the continuous electric voltage and is maximized at a temperature near the temperature Td since the temperature of the heater element 5 subsequently lowers to the temperature Td. Accordingly, the shrinkage area is fixed at a certain time after the temperature of the thermoplastic film is maximized and is kept substantially unchanged irrespective of when application of the chopped pulses Q1 is interrupted thereafter. In other words, it is possible to set the duty of the chopped pulses Q1 so that the size of the perforation becomes constant whenever application of the chopped pulses Q1 is interrupted after a certain time.

This contributes to suppressing fluctuation of the size of the perforations from picture element to picture element. That is, as described above, the thermal transfer efficiency is not uniform over the entire area of the thermoplastic film 1*a* of the stencil master material 1 but differs from part to part, which causes the size of the perforation to fluctuate from picture element to picture element. When the duty of the chopped pulses Q1 is set so that the size of the perforation becomes constant whenever application of the chopped pulses Q1 is interrupted after a certain time, the sizes of the perforations for the picture elements can be uniformed by continuing application of the chopped pulses Q1 until the shrinkage areas corresponding to all the heater elements 5 are fixed.

Figure 9B:
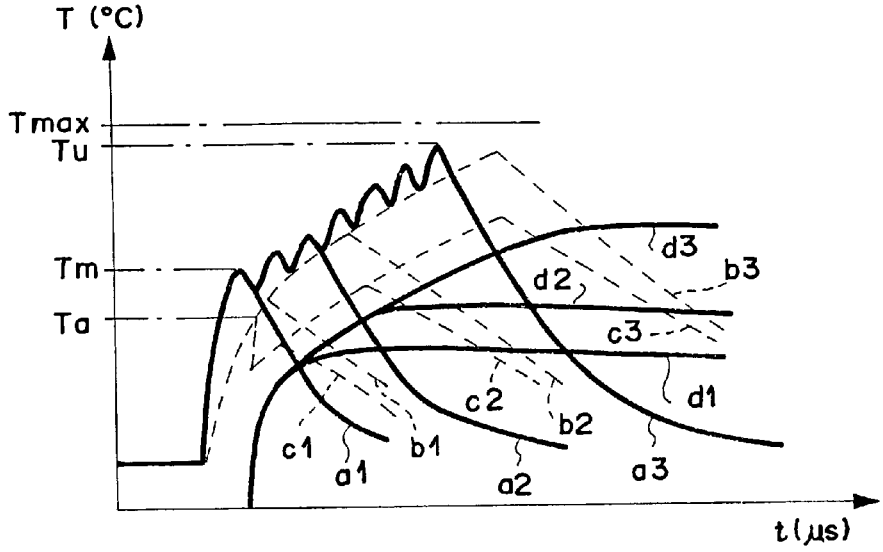
FIG. 9B shows changes with time of the temperature of the heater element, the temperature of the thermoplastic film, the shrinkage area and the size of the perforation when the duty of the main chopped pulses is set so that the temperature of the heater element is gradually raised from the initial perforation temperature.

Further the duty of the chopped pulses Q1 may be set so that the temperature of the heater element 5 is gradually raised from the initial perforation temperature Tm during application of the chopped pulses Q1 as shown by lines a1 to a3 in FIG. 9B (changes with time of the temperature of the thermoplastic film, the shrinkage area and the size of the perforation for the lines a1 to a3 are respectively represented by lines b1, c1 and d1; b2, c2 and d2 and b3, c3 and d3) or so that the temperature of the heater element 5 is once gradually raised from the initial perforation temperature Tm and then gradually lowered as shown in FIG. 7C.

No matter how the duty of the chopped pulses Q1 is set, the temperature of the heater element 5 should not exceed the maximum set temperature Tmax of the heater element 5 and the temperature of the heater element 5 should reach the initial perforation temperature Tm at the end of application of the continuous electric voltage.

When the duty of the chopped pulses Q1 is set so that the temperature of the heater element 5 is gradually raised from the initial perforation temperature Tm during application of the chopped pulses Q1 as shown in FIG. 9B, the peak temperature of the thermoplastic film is increased as the peak temperature of the heater element 5 is increased. The way in which the temperature of the thermoplastic film increases depends upon the way in which the temperature of the heater element 5 increases and accordingly can be controlled by changing the duty of the chopped pulses Q1. That is, the size of the perforation obtained can be controlled by changing the number N1 of the chopped pulses Q1 and/or the duty thereof. The way in which the temperature of the thermoplastic film increases cannot be freely controlled by controlling the time for which the square pulse is applied to the heater element as in the conventional stencil master making apparatus.

It has been desired that the perforations are as uniform as possible in size in order to uniform the size of the picture elements on the printed matter. However, recently, attempts have been made to control the size of the perforations in a plurality of sizes in order to better express half tone and/or edges of patterns. It is difficult to control the size of the perforations in a plurality of sizes by controlling the time for which the square pulse is applied to the heater element as in the conventional stencil master making apparatus since the temperature of the heater element 5 (accordingly, the temperature of the thermoplastic film) cannot be finely controlled after the end of application of the continuous electric voltage and since change of the shrinkage area is small and the speed at which the perforation grows is low.

As described above, in the stencil master making apparatus of this embodiment, a continuous electric voltage is initially applied to the heater element 5 until the temperature of the heater element 5 reaches an initial perforation temperature Tm in a temperature range adequate to thermally perforate the thermoplastic film and then chopped pulses with uniform or nonuniform duty are applied to the heater element 5 to hold the temperature of the heater element 5 in the temperature range for a predetermined time adequate to thermally perforate the thermoplastic film. In order to shorten the stencil master making time, it is preferred that the temperature of the thermoplastic film at the time the temperature of the heater element 5 reaches the initial perforation temperature Tm, that is at the end of application of the continuous electric voltage, is higher than the perforation generation temperature Ta which is substantially equal to the melting point of the thermoplastic film. Further it is preferred that the temperature of the heater element 5 during application of the chopped pulses Q1 minus the periodic variation of the temperature of the heater element 5 due to application of the chopped pulses Q1 does not exceed the maximum set temperature Tmax of the heater element 5, which has been empirically known to be about 400° C. Even if the temperature of the heater element 5 momentarily exceeds the maximum set temperature Tmax of the heater element by application of the chopped pulses Q1, deterioration of the heater element 5 is not substantially promoted.

As described above, shortening the stencil master making time by increasing the continuous electric voltage initially applied to the heater element 5 is limited due to the problem of deterioration of the heater element 5 in the crack mode. In order to shorten the stencil master making time without excessively increasing the continuous electric voltage, preheating is effective.

A stencil master making apparatus obtained by adding function of preheating to the apparatus described above will be described, hereinbelow.

As described above with reference to FIG. 5, the strobe generation circuit 26 can set a preheating strobe parameter P1 in the parameter table 32 and the preheating strobe parameter P1 is stored in the parameter RAM section RAM1, whereby the strobe generation circuit 26 can double as the preheating means which carries out preheating on at least each of the selected heater elements before the main heating (application of the continuous electric voltage for heating the heater element to said predetermined temperature in the temperature range adequate to thermally perforate the stencil master material and application of the intermittent electric voltage for holding the temperature of the heater element in the temperature range). In the preheating, the strobe generation circuit 26 applies a continuous electric voltage to the heater element 5 so that the temperature of the heater element reaches a predetermined temperature in a predetermined temperature range adequate to preheat the stencil master material and then applying an intermittent electric voltage to the heater element so that the temperature of the heater element is held in said predetermined temperature range for a predetermined time interval adequate to preheat the stencil master material. Though, in this particular embodiment, the strobe generation circuit 26 doubles as the preheating means, the preheating means may be separately provided.

Operation of the preheating will be described in detail, hereinbelow.

Figure 10:
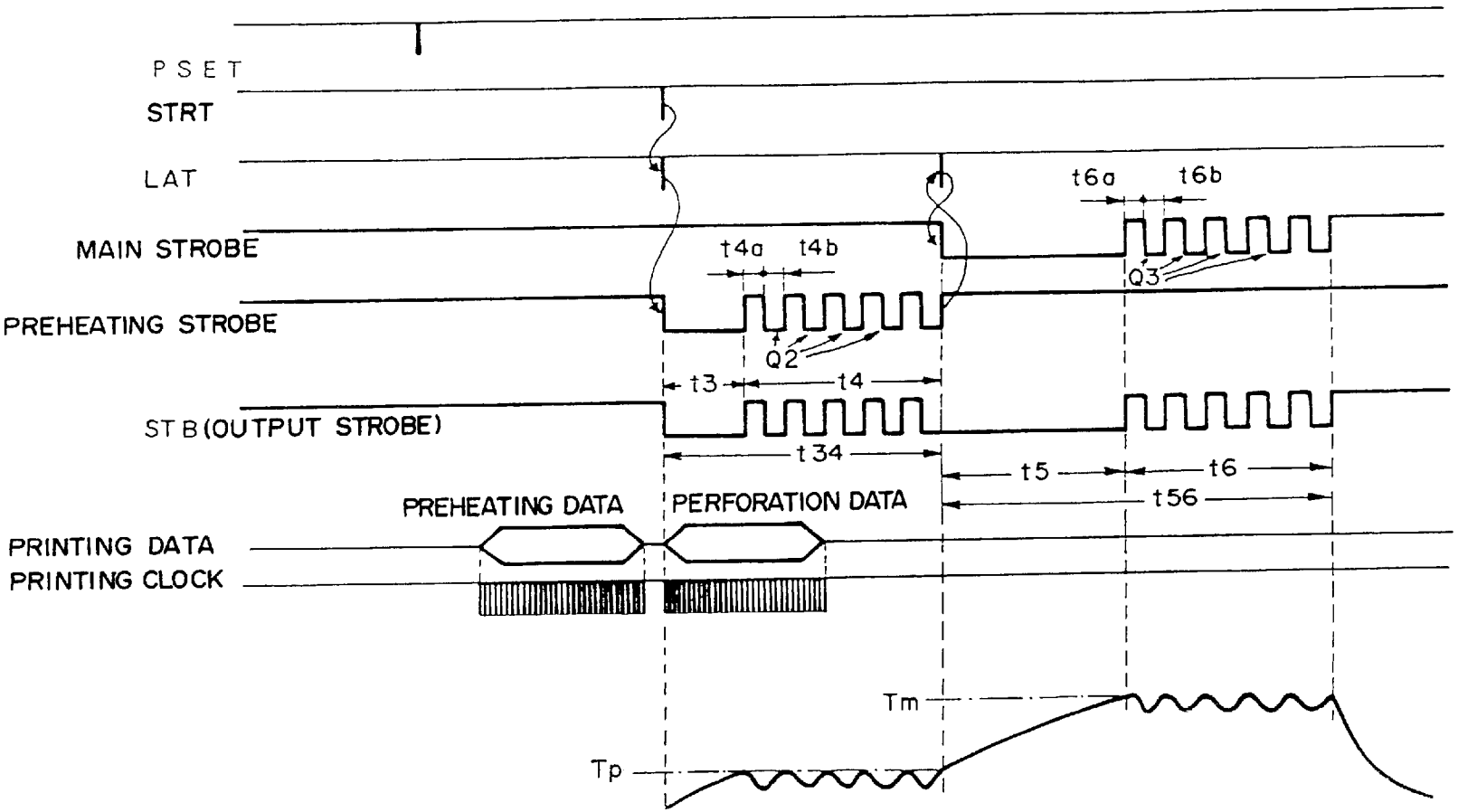
FIG. 10 is a timing chart showing the action of the strobe generation circuit and the change of the temperature of the heater element when preheating chopped pulses are employed as the strobe signal.

FIG. 10 is a timing chart showing the action of the strobe generation circuit 26 and the change of the temperature of the heater element 5 when chopped pulses for preheating is employed as the strobe signal STB.

The time which is required for the temperature of the heater element 5 to reach a predetermined temperature Tp (will be referred to as "initial preheating temperature Tp", hereinbelow) in a temperature range adequate to preheat the thermoplastic film (this temperature range is set sufficiently low not to perforate the thermoplastic film and will be referred to as "preheating temperature range", hereinbelow) from normal temperatures is employed as a preheating solid strobe time t3, and the time t4 for which the temperature of the heater element 5 is to be held in the preheating temperature range is substituted for the duty (on-time t4*b* and off-time t4*a*) of each preheating chopped pulse Q2 and the number N2 of the preheating chopped pulses Q2, whereby these times t3 and t4 are set as a preheating strobe parameter P1. Further the time which is required for the temperature of the heater element 5 to reach the initial perforation temperature Tm in the perforation temperature range (the temperature range adequate to thermally perforate the thermoplastic film) after the preheating is employed as a main solid strobe time t5, and the time t6 for which the temperature of the heater element 5 is to be held in the perforation temperature range is substituted for the duty (on-time t6*b* and off-time t6*a*) of each main chopped pulse Q3 and the number N3 of the main chopped pulses Q3, whereby these times t5 and t6 are set as a standard main strobe parameter P2.

The relations between these times and change in temperature have been empirically obtained and are prepared in the parameter table 32 (FIG. 5) as values determined taking into account change in the basic thermal head temperature.

According to the set conditions, a strobe signal STB is generated by the parameter RAM sections RAM1 and RAM2, the selector 35 and the chop effective interval making circuit 37 of the strobe generation circuit 26. As shown in FIG. 10, the strobe signal STB is output as a composite signal of the main strobe and the preheating strobe.

The strobe times can be set so that the temperature of the heater element constantly becomes a desired temperature by changing the heating patterns according to the temperature of the heater element 5.

Figure 11:
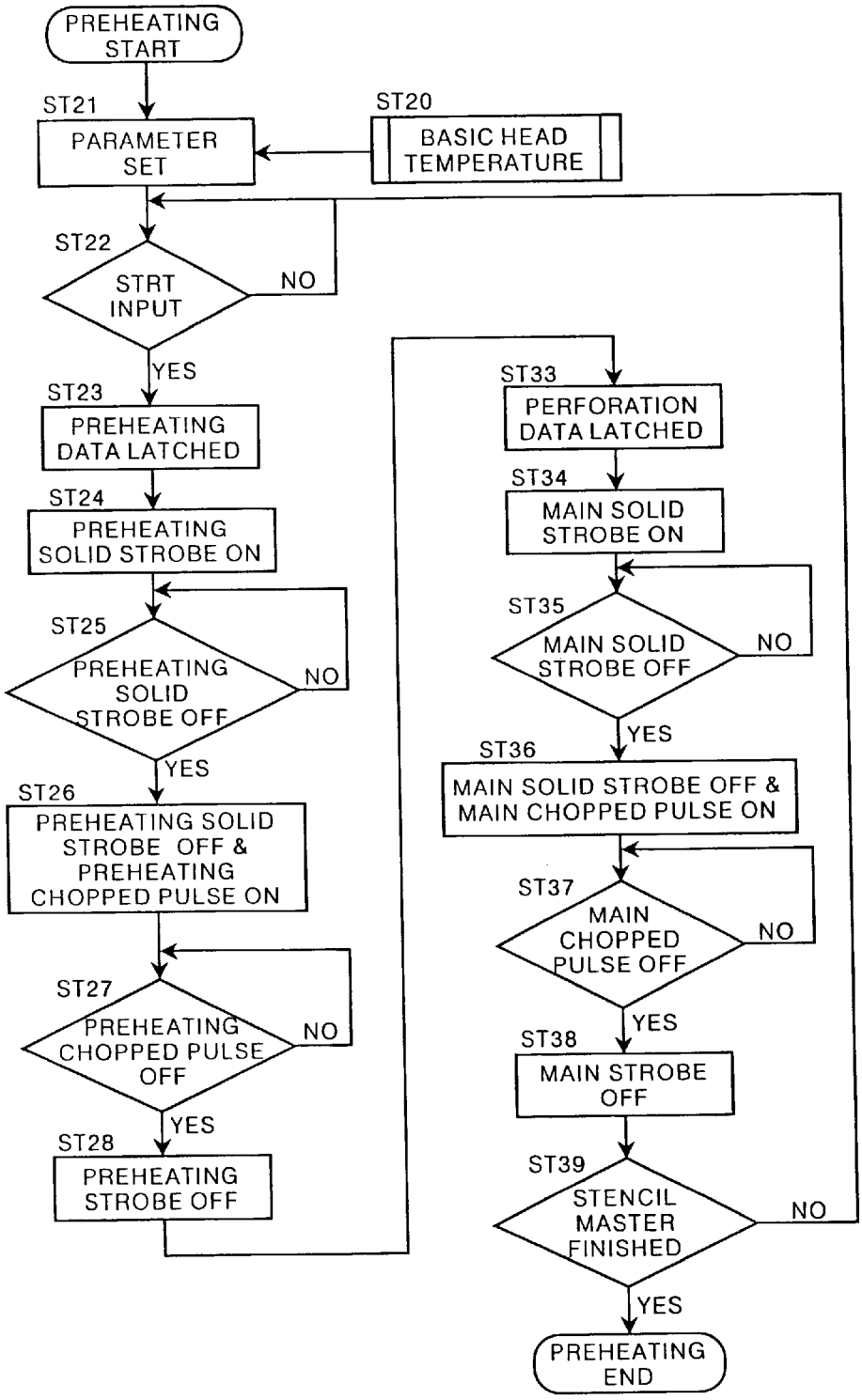
FIG. 11 is a flow chart for illustrating the preheating control by the strobe generation circuit.

Operation of the strobe generation circuit 26 in the preheating will be described with reference to the flow chart shown in FIG. 11, hereinbelow.

When a parameter set signal PSET is input into the strobe selection circuit 36, a preheating strobe parameter P1 and a standard main strobe parameter P2 corresponding to the basic thermal head temperature, that is, the temperature data $TM_{data}$ from the temperature data register 31, are input into the RAM 33 from the parameter table 32 and data DRM1 based on the preheating strobe parameter P1 and data DRM2 based on the standard main strobe parameter P2 are input into the selector 35 from the RAM 33. The selector 35 outputs the data DRM1 when the preheating strobe effective signal SRM1 is effective, and sets the number of pulses N2, the off-time t4*a* and on-times t3 and t4*b* in the chop effective interval making circuit 37 on the basis of the data DRM1. Further the selector 35 outputs the data DRM2 when the standard main strobe selection signal SRM2 and the short main strobe effective signal SRM3 are both effective, and sets the number of pulses N3, the off-time t6*a* and on-times t5 and t6*b* in the chop effective interval making circuit 37 on the basis of the data DRM2. Then a page start signal PST rises and making a stencil master is started. (steps ST20 and ST21)

The strobe generation circuit 26 (FIG. 4) is activated upon receipt of a strobe start signal STRT. (step ST22) The strobe generation circuit 26 latches, in a latch circuit in the thermal head 4, perforation data stored in the shift register in the thermal head 4 when the strobe selection circuit 36 receives the strobe start signal STRT. (step ST23) Thereafter the chop effective interval making circuit 37 turns the strobe signal STB low (L) to turn the preheating solid strobe on. (step ST24) When the time t3 lapses, the chop effective interval making circuit 37 turns the strobe signal STB high (H) to turn the preheating solid strobe off. (step ST25) Then the chop effective interval making circuit 37 alternately turns high and low the strobe signal STB, thereby outputting preheating chopped pulses Q2 starting from an off-state. (step ST26) When the output number of the preheating chopped pulses Q2 reaches the set number N2, the chop effective interval making circuit 37 turns high the strobe signal STB, thereby turning off the preheating strobe. (steps ST27 and ST28) When the preheating data cover the same heater elements 5 as the perforation data, the preheating is carried out only on the heater elements to be heated in the main heating, whereas when the preheating data cover all the heater elements 5 of the thermal head 4, the preheating is carried out on all the heater elements 5.

When the preheating time t34 lapses, a perforation data latch signal is generated, and the strobe generation circuit 26 latches, in the latch circuit in the thermal head 4, perforation data stored in the shift register in the thermal head 4. (step ST33) Thereafter processing is effected on the main chopped pulses Q1 in the following steps ST34 to ST39. Since steps ST34 to ST39 are the same as steps ST14 to ST19 in FIG. 8, steps ST34 to ST39 will not be described here.

When the electric voltage applied to the heater element 5 is controlled in the manner described above, the temperature of the heater element 5 reaches the initial preheating temperature Tp in the time interval t3 when the strobe signal STB is low, that is, when the preheating solid strobe is on as shown in FIG. 10. Thereafter the temperature of the heater element 5 is held near the initial preheating temperature Tp for the time interval t4 by application of the preheating chopped pulses Q2. Then the temperature of the heater element 5 is raised to the initial perforation temperature Tm by application of the main solid strobe. At this time, since the temperature of the heater element 5 has been raised to the initial preheating temperature Tp, the energy to be applied to the heater element 5 to raise the temperature of the heater element 5 to the initial perforation temperature Tm may be smaller and accordingly, the time interval t5 for which the main solid strobe is to be applied may be shorter, whereby the perforation can be generated in a shorter time. After the temperature of the heater element 5 is raised to the initial perforation temperature Tm, the temperature of the heater element 5 is held near the initial perforation temperature Tm for the time interval t6 by application of the main chopped pulses Q3. Since the time interval t6 is adequate to perforate the thermoplastic film, a desired size of perforation can be formed in the thermoplastic film.

As can be understood from the description above, the preheating consists of a first step of applying the preheating solid strobe to heat the heater element 5 to the initial preheating temperature Tp and a second step of applying the preheating chopped pulses Q2 to hold the temperature of the heater element 5 near the initial preheating temperature. The sum of the time interval for which the preheating solid strobe is applied to the heater element 5 and the time interval for which the preheating chopped pulses Q2 are applied to the heater element 5 is referred to as "the preheating time interval" and the preheating solid strobe and the preheating chopped pulses Q2 are referred to as "the preheating pulses".

Further applying the main solid strobe and the main chopped pulses Q3 is referred to as "the main heating" and the time interval of the main heating is referred to as "the main heating time interval". The main heating solid strobe and the main heating chopped pulses Q3 are referred to as "the main heating pulses".

Figure 12A:
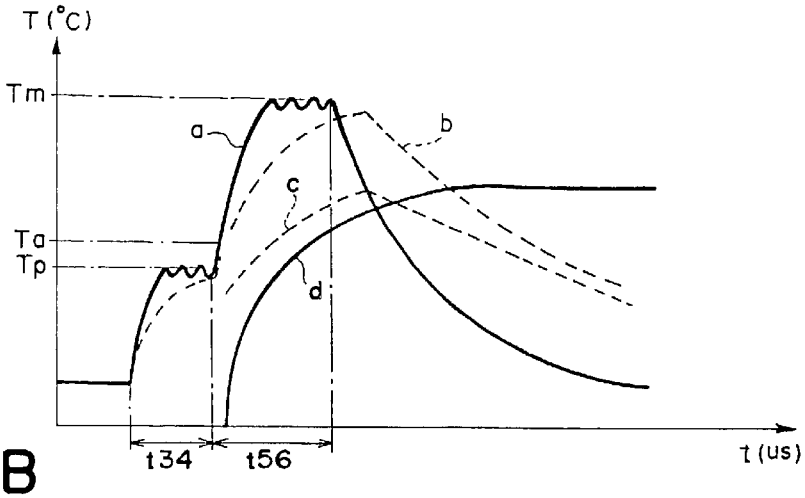
FIG. 12A shows changes with time of the temperature of the heater element, the temperature of the thermoplastic film, the shrinkage area and the size of the perforation when the preheating is carried out.

Changes with time t of the temperature a of the heater element 5, the temperature b of the thermoplastic film, the shrinkage area c and the size d of the perforation when the preheating is carried out are shown in FIG. 12A.

Figure 12B:
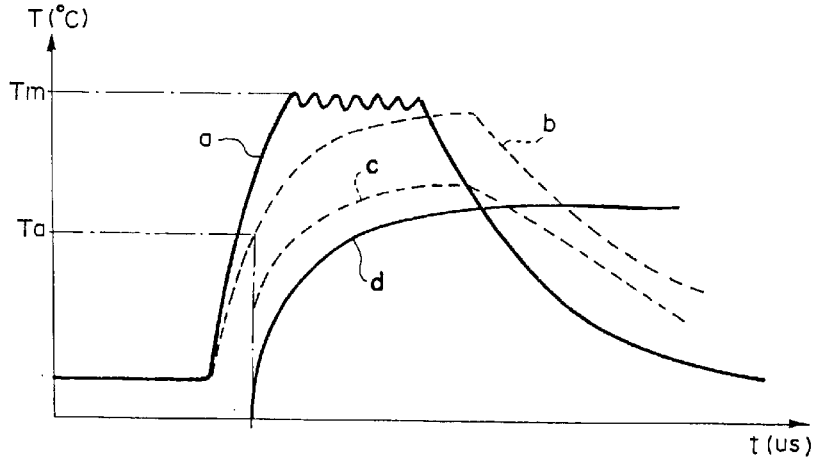
FIG. 12B shows changes with time of the temperature of the heater element, the temperature of the thermoplastic film, the shrinkage area and the size of the perforation when the preheating is not carried out.

As shown in FIG. 12A, the temperature of the thermoplastic film is raised to the temperature Tp (the initial preheating temperature of the heater element 5) in the preheating time interval t34 (t34=t3+t4, FIG. 10). The temperature Tp is a temperature which is lower than the perforation generation temperature Ta but close to the same. As a result, the time from the initiation of the main heating to generation of the perforation becomes shorter as compared with the case where the preheating is not carried out as shown in FIG. 12B. Further the time interval t5 of application of the main solid strobe becomes shorter as compared with the case where the preheating is not carried out as shown in FIG. 12B. At the same time, since the thermoplastic film 1*a* receives a certain amount of heat in the preheating time interval t34, the temperature of the thermoplastic film 1*a* rises more rapidly in the main heating time interval t56 (t56=t5+t6, FIG. 10), which results in rapid grow of the perforation. This means that the number N3 of chopped pulses Q3 required to enlarge the perforation to a desired size may be smaller than the number N1 of the chopped pulses Q1 in the case shown in FIG. 12B and that the time required for the size of the perforation to be fixed as measured from initiation of the main heating is shorter than that in the case shown in FIG. 12B.

Accordingly, when the preheating is carried out just before the main heating, the main heating time interval t56 may be further shorter, which leads to shortening the total stencil master making time.

Further when the preheating carried out, the time interval for which the heater element 5 is exposed to a high temperature is shortened and deterioration of the heater element 5 in the oxidation mode is further suppressed.

As in the case of the main heating chopped pulses, the preheating chopped pulses may be applied so that the temperature of the heater element 5 varies during application of the chopped pulses. When the temperature of the heater element 5 during application of the preheating chopped pulses is gradually lowered, the temperature of the thermoplastic film during the preheating time interval can be stabilized earlier.

The initial preheating temperature Tp and the preheating temperature range should be determined so that the thermoplastic film 1*a* is sufficiently preheated but is not perforated by application of the preheating pulses. We have empirically found that the preheating temperature range is preferably from the melting point of the thermoplastic film 1*a* minus 50° C. to the melting point plus 50° C. Even if the temperature of the heater element 5 slightly exceeds the melting point of the thermoplastic film 1*a* during preheating, the temperature of the thermoplastic film 1*a* cannot reach the perforation generation temperature Ta due to the gap between the heater element 5 and the thermoplastic film 1*a* and/or the heat capacity of the thermoplastic film 1*a* and the gap.

Thus, it is preferred that the preheating means (the strobe generation circuit 26 in this particular embodiment) applies said intermittent electric voltage (the preheating chopped pulses Q2) so that the temperature of the center of the surface of the heater element 5 during application of the intermittent voltage minus the periodic variation due to application of the intermittent voltage is held in a temperature range between the melting point of the thermoplastic film 1*a* minus 50° C. and that plus 50° C.

The preheating may be carried out on all the heater elements including those which do not perforate in the cycle since the preheated heater elements cannot perforate the thermoplastic film 1*a* unless applied with the main heating pulses.

In a high speed stencil master making apparatus where the stencil master making speed is higher than the conventional apparatuses, heat energy is gradually accumulated on the heater elements since heat energy applied to the heater elements 5 for perforation along the preceding line cannot be sufficiently dissipated before perforation along the next line. As a result, heat energy is accumulated on each heater element 5 according to its heat generation history, which causes fluctuation in energy state among the heater elements and causes deterioration in image quality.

In order to overcome the problem of heat generation history, it is necessary to execute heat generation history control in the high speed stencil master making apparatus. As the methods of the heat generation history control, there have been known a method in which heat generation history data on each heater element 5 are stored for several lines and the energy to be supplied to each heater element 5 is controlled on the basis of the heat generation history data (see, for instance, Japanese Unexamined Patent Publication Nos.60(1985)-161163 and 2(1990)-8065, will be referred to as "the history data control", hereinbelow), and a method in which a total amount of heat generated by the thermal head 4 for several lines and the energy to be supplied to each of the blocks of the heater elements is controlled on the basis of the total amount of heat generated by the thermal head 4 for several lines (will be referred to as "the histogram control", hereinbelow).

The present invention can be applied also to stencil master making apparatuses where the heat generation history control is carried out.

The case where the present invention is applied to the stencil master making apparatus in which the history data control is carried out will be described first, hereinbelow.

Figure 13:
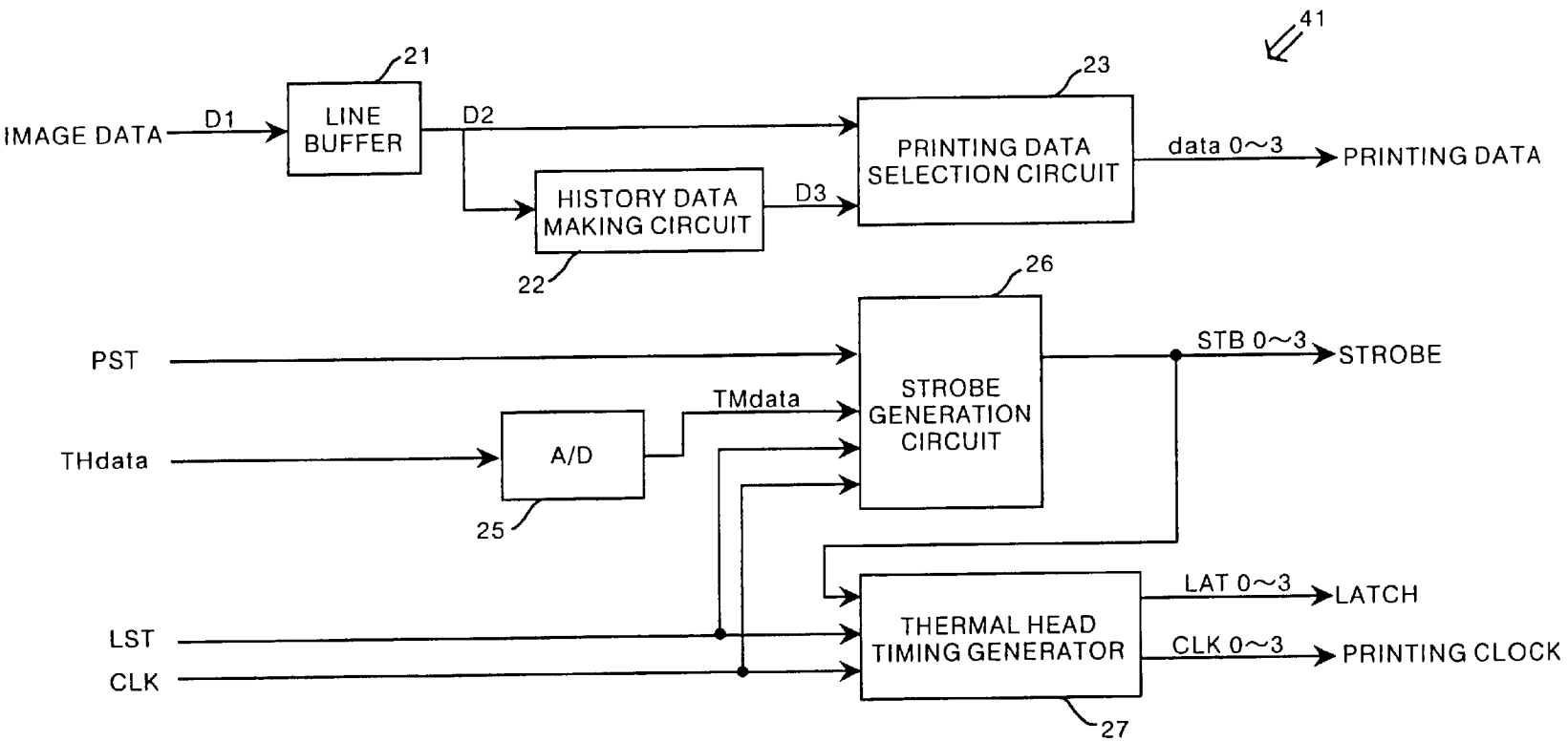
FIG. 13 is a block diagram showing a thermal head drive circuit which is employed in the stencil master making apparatus in which the history data control is carried out.

FIG. 13 is a block diagram showing a thermal head drive circuit 41 of a stencil master making apparatus in which the present invention is applied to a stencil master making apparatus in which the history data control is carried out. The thermal head drive circuit 41 is the same as the thermal head drive circuit 6 shown in FIG. 4 except that a heat generation history data making circuit 22 is provided between the line buffer 21 and the printing data selection circuit 23.

Figure 14:
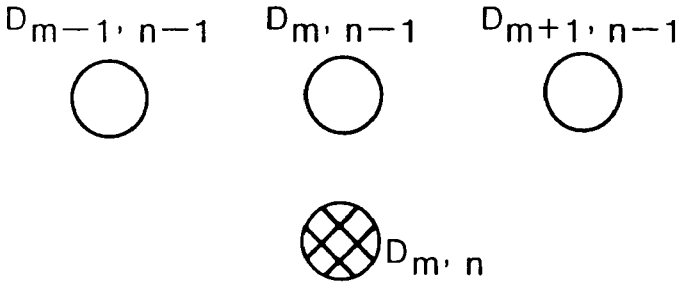
FIG. 14 is a view for illustrating the image data which the history data making circuit refers to, FIG. 15 is a timing chart showing the action of the strobe generation circuit of the thermal head drive circuit shown in FIG. 13 and the change of the temperature of the heater element.

The history data making circuit 22 receives the image data D2 from the line buffer 21 and outputs heat history data D3, which represents the presence or absence of heat history for a given heater element, on the basis of image data $D_{m,n}$ on the given heater element for a current line, image data $D_{m,n-1}$ on the given heater element for the preceding line and image data $D_{m-1,n-1}$ and $D_{m+1,n-1}$ on the heater elements on opposite sides of the given heater element in the main scanning direction as shown in FIG. 14 according to the heat history data making rule shown in the following table. Suffix m stands for the number of the heater element as numbered in the main scanning direction and suffix n stands for the number of the heater element as numbered in the sub-scanning direction.

history data making rule

| data for current line | data for preceding line | history data |
|---|---|---|
| White | Ignored | ineffective |
| Black | black for all the elements | ineffective |
| | white for at least one element | effective |

Figure 15:
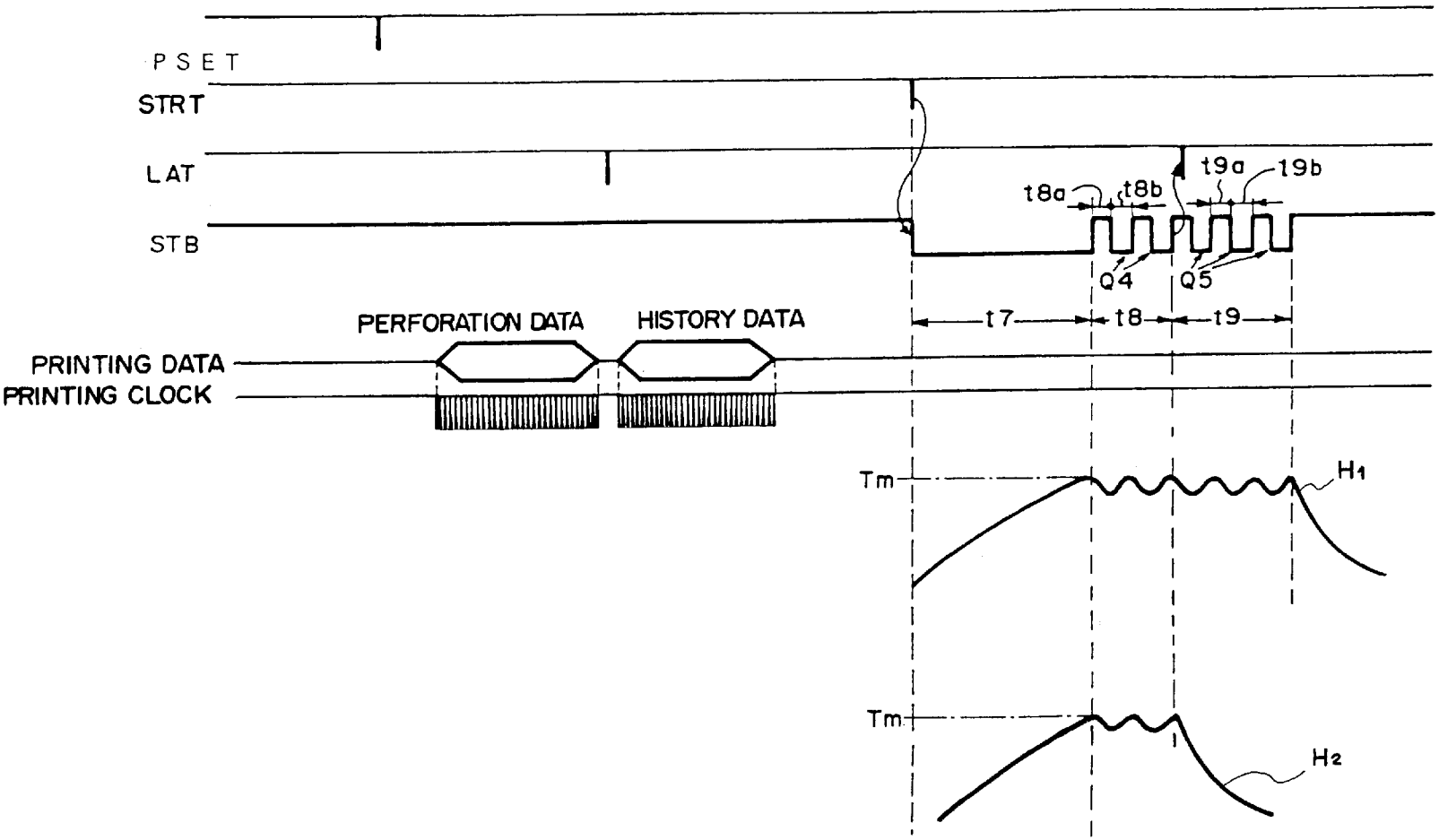

The printing data selection circuit 23 relates the image data D2 from the line buffer 21 and the history data D3 with the respective data bits and outputs, at the timings shown in FIG. 15, the printing data data0 to data3 each consisting of a data train of perforation data (the image data D2) and heat history data (the history data D3).

As described above in conjunction with FIG. 5, the strobe generation circuit 26 can set the history main strobe parameter P4 in the parameter table 32 and the history main strobe parameter P4 is stored in the parameter RAM section RAM4. Thus, the strobe generation circuit 26 doubles as a means for executing the history data control in this particular embodiment.

The history data control in the stencil master making apparatus will be described, hereinbelow.

FIG. 15 is a timing chart showing the action of the strobe generation circuit 26 and the change of the temperature of the heater element 5 when chopped pulses for history data control are employed as the strobe signal STB in order to apply an intermittent electric voltage for history data control to the heater element 5.

As shown in FIG. 15, the time which is required for the temperature of the heater element 5 to reach a predetermined temperature (initial perforation temperature) Tm in a temperature range adequate to thermally perforate the thermoplastic film is employed as a main solid strobe time t7, and the time t8 for which the temperature of the heater element 5 is to be held in the temperature range is substituted for the duty (on-time t8*b* and off-time t8*a*) of each main chopped pulse Q4 and the number N4 of the main chopped pulses Q3, whereby these times t7 and t8 are set as a standard main strobe parameter P2. Further, the time t9 for which the history data control is effected to hold the temperature of the heater element 5 in the temperature range is substituted for the duty (on-time t9*b* and off-time t9*a*) of each heat history chopped pulse Q5 and the number N4 of the heat history chopped pulses Q5, is set as a heat history strobe parameter P4.

The relations between these times and change in temperature have been empirically obtained and are prepared in the parameter table 32 (FIG. 5) as values determined taking into account change in the basic thermal head temperature.

The heat history chopped pulses Q5 become effective when there are heat history data and otherwise become ineffective so that unnecessary heat generation by the heater element 5 is avoided and unnecessary heat accumulation can be avoided.

According to the set conditions, a strobe signal STB is generated by the parameter RAM section RAM2, the selector 35 and the chop effective interval making circuit 37 of the strobe generation circuit 26.

The strobe time t9 can be set so that the temperature of the heater element constantly becomes a desired temperature by changing the heating pattern according to the basic thermal head temperature.

Figure 16:
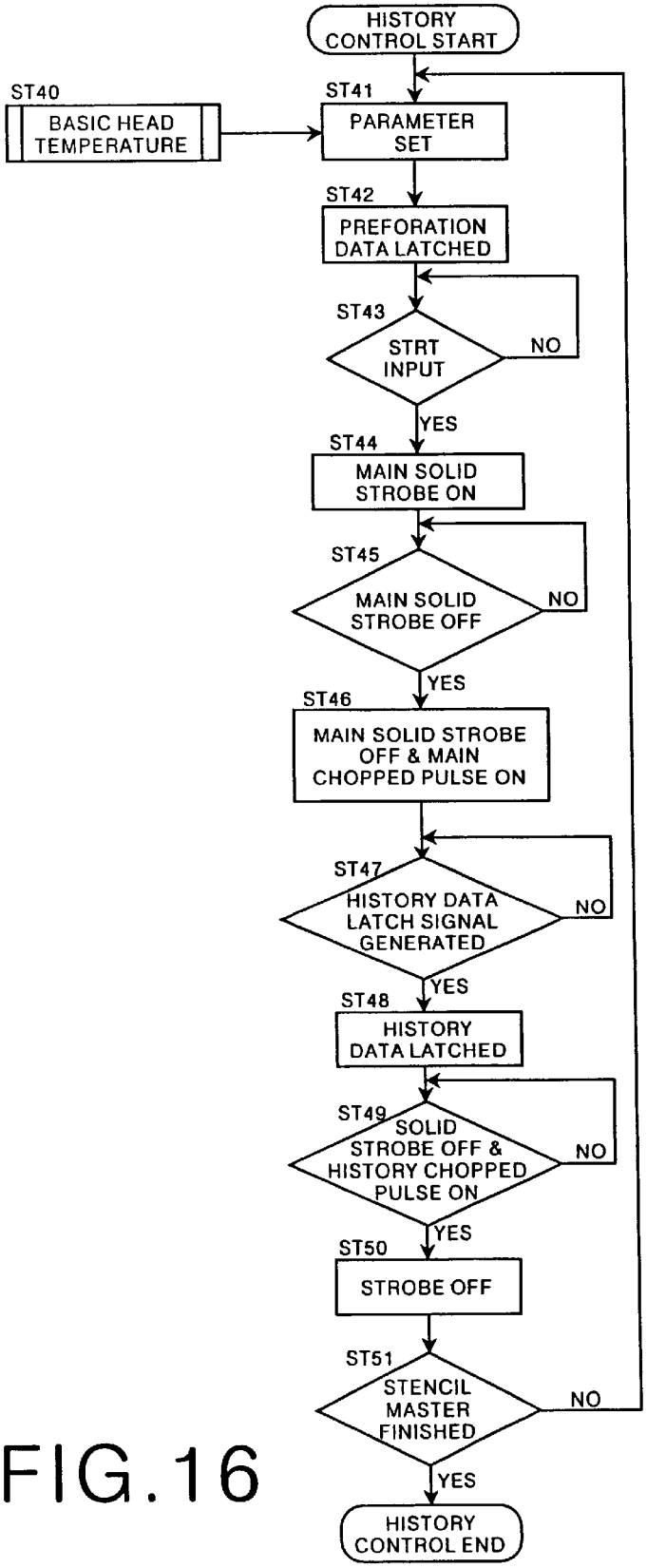
FIG. 16 is a flow chart for illustrating the history data control by the strobe generation circuit.

The history data control by the strobe generation circuit 26 will be described in detail with reference to the flow chart shown in FIG. 16, hereinbelow.

When a parameter set signal PSET is input into the strobe selection circuit 36 from the timing generator 14, a standard main strobe parameter P2 and a history main strobe parameter P4 corresponding to the basic thermal head temperature, that is, the temperature data $TM_{data}$ from the temperature data register 31, are input into the RAM 33 from the parameter table 32 and data DRM2 based on the standard main strobe parameter P2 and data DRM4 based on the history main strobe parameter P4 are input into the selector 35 from the RAM 33. The selector 35 outputs the data DRM2 when the standard main strobe selection signal SRM2 and the short main strobe effective signal SRM3 are both effective and sets the number of pulses N4, the off-time t8*a* and on-times t7 and t8*b* in the chop effective interval making circuit 37 on the basis of the data DRM2. Further, the selector 35 outputs the data DRM4 when the history strobe effective signal SRM4 is effective and sets the number of pulses N5, the off-time t9*a* and the on-time t9*b* in the chop effective interval making circuit 37 on the basis of the data DRM4. Then a page start signal PST rises and making a stencil master is started. (steps ST40 and ST41)

At the same time, the strobe generation circuit 26 latches, in a latch circuit in the thermal head 4, perforation data stored in the shift register in the thermal head 4. (step ST 42) The strobe generation circuit 26 (FIG. 14) is activated upon receipt of a strobe start signal STRT. (step ST43)

Thereafter the chop effective interval making circuit 37 turns the strobe signal STB low (L) to turn the main solid strobe on when the strobe selection circuit 36 receives a strobe start signal STRT. (step ST44) When the time t7 lapses, the chop effective interval making circuit 37 turns the strobe signal STB high (H) to turn the main solid strobe off. (step ST45) Then the chop effective interval making circuit 37 alternately turns high and low the strobe signal STB, thereby outputting main chopped pulses Q4 starting from an off-state until the number of the output main chopped pulses Q4 reaches the set number N4. (step ST46) Then a history data latch signal is generated (step ST47), and the strobe generation circuit 26 latches, in the latch circuit in the thermal head 4, history data stored in the shift register in the thermal head 4. (step ST48) Then the chop effective interval making circuit 37 alternately turns high and low the strobe signal STB, thereby outputting history chopped pulses Q5 starting from an off-state. (step ST49) When the number of the output history chopped pulses Q5 reaches the set number N5, the chop effective interval making circuit 37 turns high the strobe signal STB, thereby turning off the strobe. (step ST50) When the page start signal PST has fallen, it is determined that the stencil master has been finished, and this processing is ended. Otherwise, steps ST41 and the following steps are repeated. (step ST51)

By the history data control described above, the temperature of the heater element 5 reaches the initial perforation temperature Tm in the time interval t7 when the strobe signal STB is low, that is, when the main solid strobe is on as shown in FIG. 15. Thereafter the temperature of the heater element 5 is held near the initial perforation temperature Tm for the time interval t8 by application of the main chopped pulses Q4. When there exists history data for the heater element 5, the history chopped pulses Q5 are applied to the heater element 5 after the main chopped pulses Q4 and the temperature of the heater element 5 is further kept near the initial perforation temperature Tm for the time interval t9 as shown by line H1 in FIG. 15. On the other hand, when there exists no history data for the heater element 5, the history chopped pulses Q5 are not applied to the heater element 5 after the main chopped pulses Q4 and accordingly the temperature of the heater element 5 lowers from the end of the time interval t8 as shown by line H2 in FIG. 15.

The time interval t9 for which the history chopped pulses Q5 are applied to the heater element 5 is set according to the basic thermal head temperature (the actual temperature of the heater element 5) so that the chopped pulses Q5 are applied to the heater element 5 to compensate for its heat generation history in the manner described above, whereby deterioration in the image quality due to heat generation history can be avoided.

The case where the present invention is applied to the stencil master making apparatus in which the histogram control is carried out will be described, hereinbelow.

Figure 17:
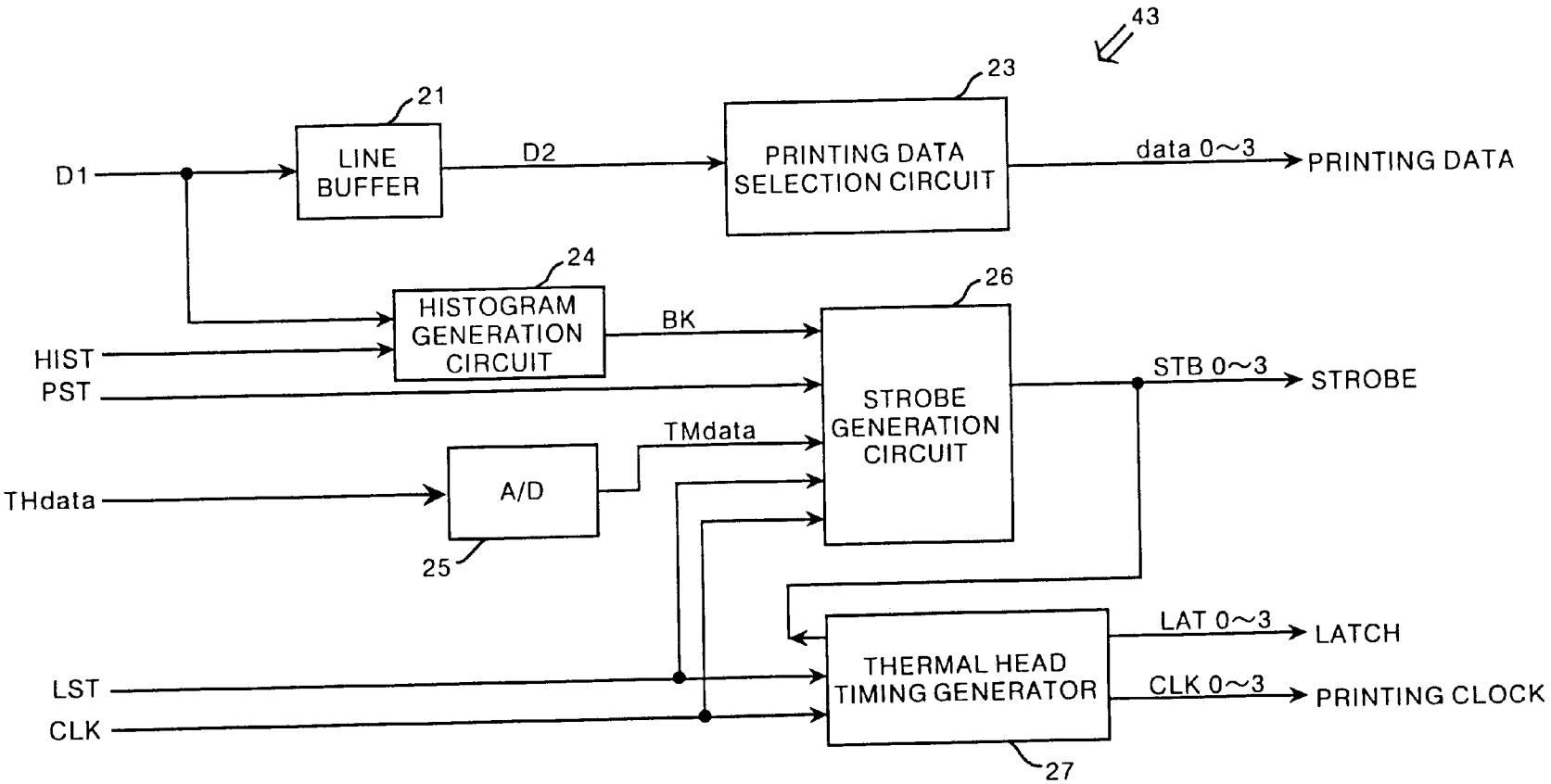
FIG. 17 is a block diagram showing a thermal head drive circuit which is employed in the stencil master making apparatus in which the histogram control is carried out.

FIG. 17 is a block diagram showing a thermal head drive circuit 43 of a stencil master making apparatus in which the present invention is applied to a stencil master making apparatus in which the histogram control is carried out. The thermal head drive circuit 43 is the same as the thermal head drive circuit 6 shown in FIG. 4 except that there is provided a histogram generation circuit 24 which counts the number of the black picture elements in the preceding histogram block (to be described below) and calculates the black picture element ratio BK of preceding histogram block on the basis of the image data D1. The histogram generation circuit 24 inputs the black picture element ratio BK into the strobe generation circuit 44.

Figure 18:
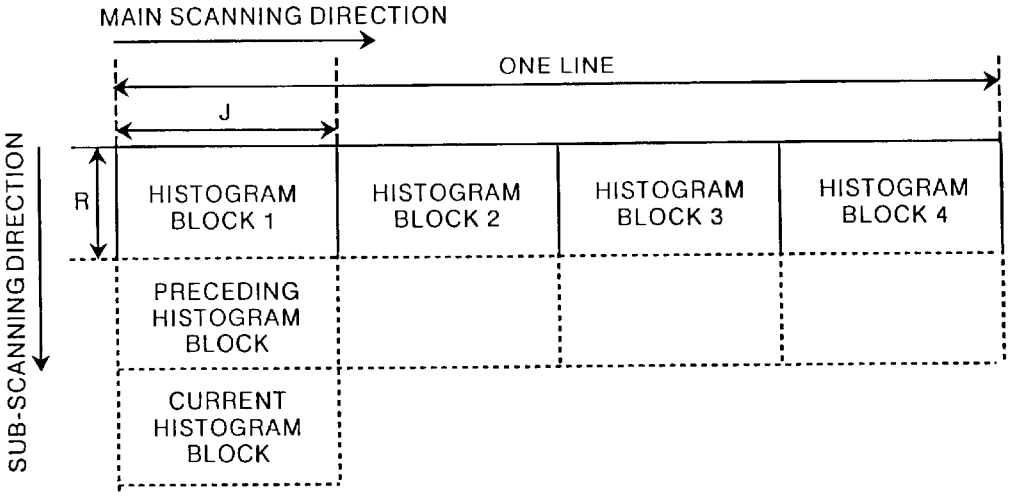
FIG. 18 is a view for illustrating the histogram block used by the histogram generation circuit of the thermal head drive circuit shown in FIG. 17.

As shown in FIG. 18, the picture elements which have been formed by the thermal head 4 are divided into a plurality of histogram blocks in both the main scanning direction and the sub-scanning direction so that J×R picture elements are included in each histogram block, wherein J represents the number of the picture elements in each array of the picture elements extending in the main scanning direction and R represents the number of the arrays of the picture elements arranged in the sub-scanning direction. The number of the histogram blocks in the main scanning direction is at most equal to the number of the blocks of the heater elements 5 in the thermal head 4. A plurality of histogram blocks are formed in the sub-scanning direction as the stencil master making steps proceeds. The black picture element ratio BK to be input into the strobe generation circuit 44 is that in the preceding histogram block.

Figure 19:
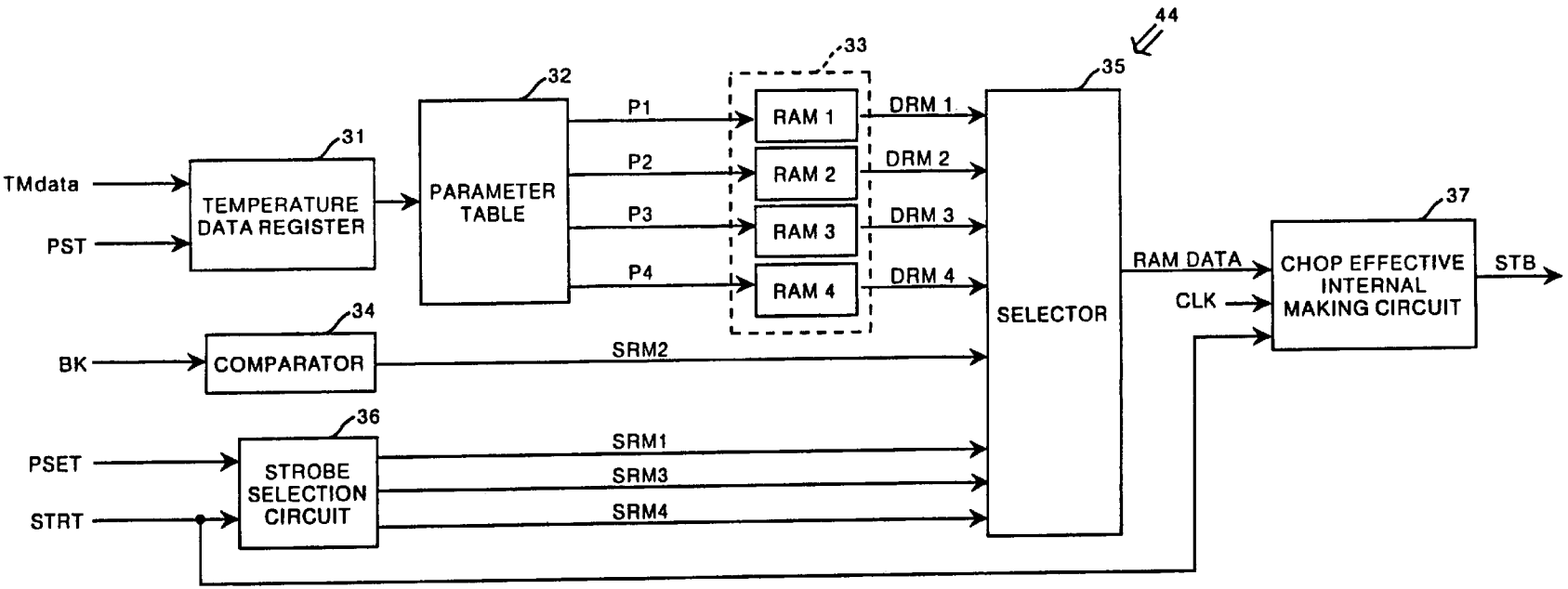
FIG. 19 is a block diagram showing in detail the strobe generation circuit of the thermal head drive circuit.

FIG. 19 is a block diagram showing in detail the strobe generation circuit 44. The strobe generation circuit 44 is substantially the same as the strobe generation circuit 26 shown in FIG. 4 except that there is provided a comparator 34 which inputs a standard main strobe selection signal SRM2 into the selector 35. The comparator 34 compares the black picture element ratio BK output from the histogram generation circuit 24 (FIG. 17) with a preset value, and makes effective the standard main strobe selection signal SRM2 when the black picture element ratio BK is smaller than the preset value while makes ineffective the same when the former is not smaller than the latter.

As described above in conjunction with FIG. 5, the strobe generation circuit 26 can set the standard main strobe parameter P2 and the short main strobe parameter P3 in the parameter table 32 and the standard main strobe parameter P2 and the short main strobe parameter P3 are stored in the parameter RAM sections RAM2 and RAM3, respectively. Thus, the strobe generation circuit 26 doubles as a means for executing the histogram control in this particular embodiment.

The histogram control in the stencil master making apparatus will be described, hereinbelow.

Figure 20:
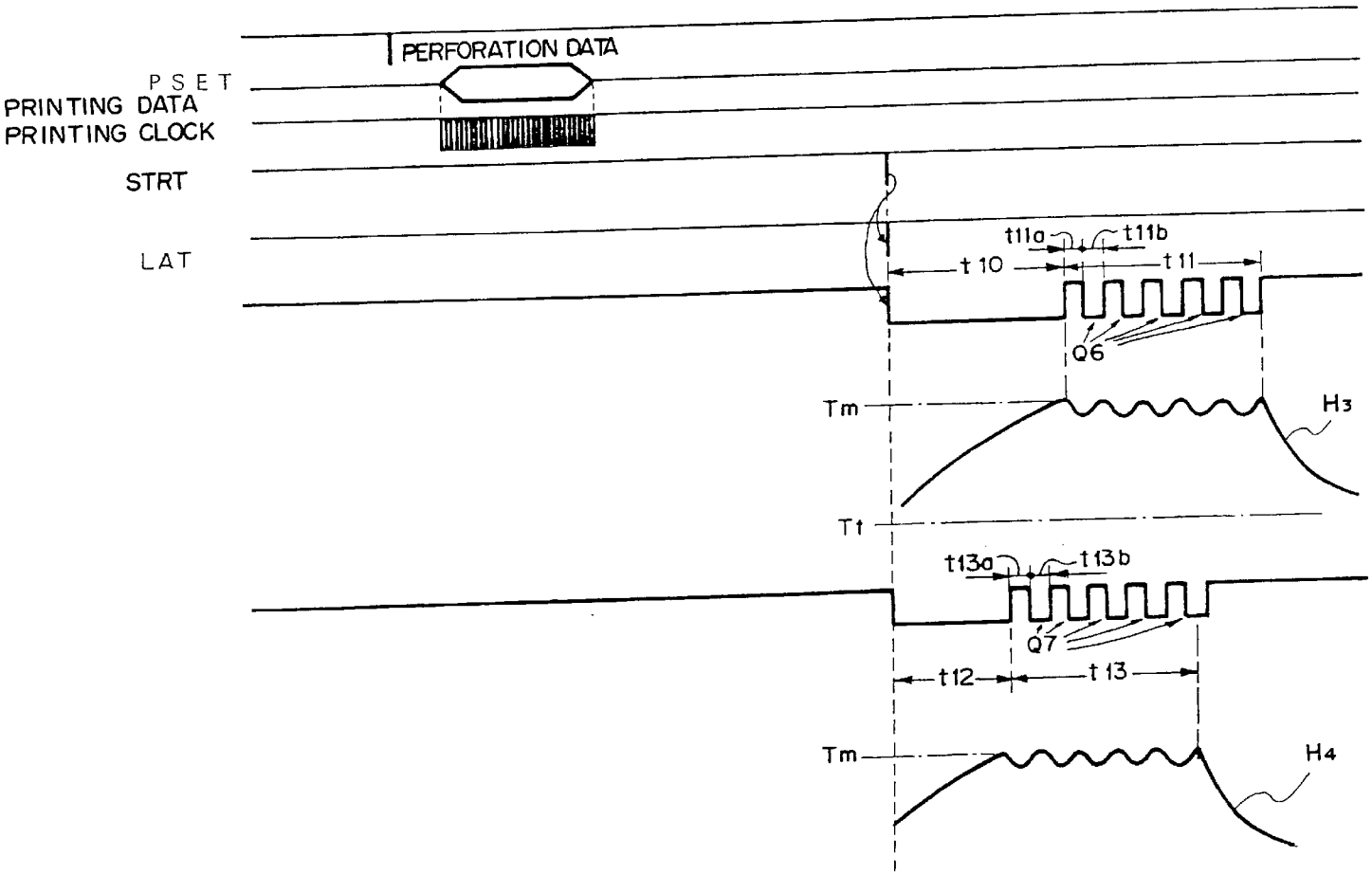
FIG. 20 is a timing chart showing the action of the strobe generation circuit shown in FIG. 19 and the change of the temperature of the heater element.

FIG. 20 is a timing chart showing the action of the strobe generation circuit 44 and the change of the temperature of the heater element 5 when chopped pulses for histogram control are employed as the strobe signal STB in order to apply an intermittent electric voltage for histogram control to the heater element 5.

As shown in FIG. 20, the standard main strobe parameter P2 and the short main strobe parameter P3 are set for each histogram block according to the black heater element ratio BK. That is, the time which is required for the temperature of the heater element 5 to reach a predetermined temperature (initial perforation temperature) Tm in a temperature range adequate to thermally perforate the thermoplastic film when the black picture element ratio BK is smaller than the preset value is employed as a main solid strobe time t10, and the time t11 for which the temperature of the heater element 5 is to be held in the temperature range is substituted for the duty (on-time t11*b* and off-time t11*a*) of each main chopped pulse Q6 and the number N6 of the main chopped pulses Q6, whereby these times t10 and t11 are set as a standard main strobe parameter P2. Further, the time which is required for the temperature of the heater element 5 to reach the initial perforation temperature Tm in the temperature range adequate to thermally perforate the thermoplastic film when the black picture element ratio BK is not smaller than the preset value is employed as a main solid strobe time t12, and the time t12 for which the temperature of the heater element 5 is to be held in the temperature range is substituted for the duty (on-time t13*b* and off-time t13*a*) of each main chopped pulse Q7 and the number N7 of the main chopped pulses Q7, whereby these times t12 and t13 are set as a short main strobe parameter P3.

The relations between these times and change in temperature have been empirically obtained and are prepared in the parameter table 32 (FIG. 19) as values determined taking into account change in the basic thermal head temperature.

According to the set conditions, a strobe signal STB is generated by the parameter RAM sections RAM2 and RAM3, the selector 35 and the chop effective interval making circuit 37 of the strobe generation circuit 44.

When the black picture element ratio BK output from the histogram generation circuit 24 is smaller than the preset value, the standard main solid strobe time t10 is set as the histogram solid strobe time and the standard main chopped pulse time t11 is set as the histogram chopped pulse time as shown in FIG. 20. On the other hand, when the black picture element ratio BK output from the histogram generation circuit 24 is not smaller than the preset value, the short main solid strobe time t12 and the short main chopped pulse time t13 are set respectively as the histogram solid strobe time and the histogram chopped pulse time, whereby the histogram solid strobe time is shortened or the condition of the histogram chopped pulses is changed. These strobe times are set so that the temperature of the heater element constantly becomes a desired temperature by changing the heating pattern according to the basic thermal head temperature.

Figure 21:
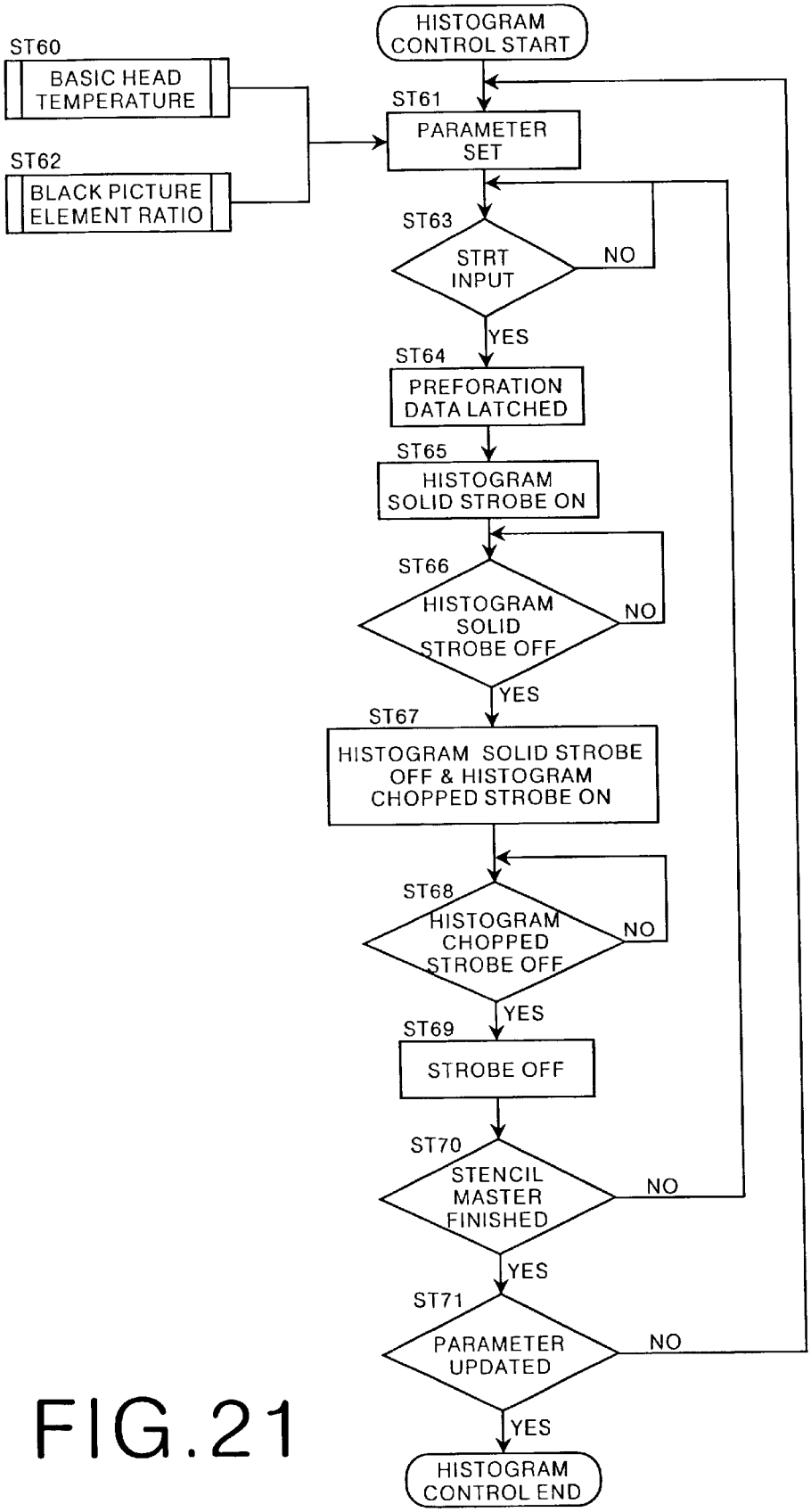
FIG. 21 is a flow chart for illustrating the histogram control by the strobe generation circuit.

The histogram control by the strobe generation circuit 44 will be described in detail with reference to the flow chart shown in FIG. 21, hereinbelow.

When a parameter set signal PSET is input into the strobe selection circuit 36, a standard main strobe parameter P2 and a short main strobe parameter P3 corresponding to the basic thermal head temperature, that is, the temperature data $TM_{data}$ from the temperature data register 31, are input into the RAM 33 from the parameter table 32 and data DRM2 based on the standard main strobe parameter P2 and data DRM3 based on the short main strobe parameter P3 are input into the selector 35 from the RAM 33. The selector 35 outputs the data DRM2 when the black picture element ratio BK is smaller than the preset value and the standard main strobe selection signal SRM2 and the short main strobe effective signal SRM3 are both effective and sets the number of pulses N6, the off-time t11*a* and on-times t10 and t11*b* in the chop effective interval making circuit 37 on the basis of the data DRM2. On the other hand, the selector 35 outputs the data DRM3 when the black picture element ratio BK is not smaller than the preset value and the standard main strobe selection signal SRM2 is ineffective, and sets the number of pulses N7, the off-time t13*a* and on-times t12 and t13*b* in the chop effective interval making circuit 37 on the basis of the data DRM3. Then a page start signal PST rises and making a stencil master is started. (steps ST60 and ST61) At the beginning, the black picture element ratio BK is set at an initial value. (step ST62)

The strobe generation circuit 44 (FIG. 4) is activated upon receipt of a strobe start signal STRT. (step ST63) The strobe generation circuit 44 latches, in a latch circuit in the thermal head 4, perforation data stored in the shift register in the thermal head 4 when the strobe selection circuit 36 receives the strobe start signal STRT. (step ST64) Thereafter the chop effective interval making circuit 37 turns the strobe signal STB low (L) to turn the histogram solid strobe on. (step ST65) When the time t10 or t12 set as a parameter lapses, the chop effective interval making circuit 37 turns the strobe signal STB high (H) to turn the histogram solid strobe off. (step ST66) Then the chop effective interval making circuit 37 alternately turns high and low the strobe signal STB, thereby outputting histogram chopped pulses starting from an off-state. (step ST67) When the number of the output main chopped pulses reaches the set number N6 or N7, the chop effective interval making circuit 37 turns high the strobe signal STB, thereby turning off the strobe. (steps ST68 and ST69) When the page start signal PST has fallen, it is determined that the stencil master has been finished, and this processing is ended. Otherwise, step ST63 and the following steps are repeated. (step ST70)

When a histogram update signal HIST is input into the histogram generation circuit 24 (FIG. 17), the parameters are changed according to the black heater element ratio BK. (step ST71) Then the chop effective interval making circuit 37 (FIG. 19) determines the effective intervals of the strobes according to the updated parameters and outputs the strobe signals.

By the histogram control described above, the temperature of the heater element 5 reaches the initial perforation temperature Tm in the time interval t10 or t12 when the histogram solid strobe is on as shown in FIG. 20. Thereafter the temperature of the heater element 5 is held near the initial perforation temperature Tm for the time interval t11 or t13 by application of the histogram chopped pulses Q6 or Q7. That is, when the black picture element ratio BK is smaller than the present value, the standard main solid strobe time t10 is set as the histogram solid strobe time and the standard main chopped pulse time t11 is set as the histogram chopped pulse time, whereby the temperature of the heater element 5 changes as shown by line H3 in FIG. 20. On the other hand, when the black picture element ratio BK is not smaller than the present value, the short main solid strobe time t12 and the short main chopped pulse time t13 are set respectively as the histogram solid strobe time and the histogram chopped pulse time, whereby the temperature of the heater element 5 changes as shown by line H4 in FIG. 20. In this manner, the temperature of the heater element 5 is controlled according to the heat generation history of the heater element 5, whereby deterioration in the image quality due to heat generation history can be avoided.

A plurality of stencil masters were made by use of a stencil master making apparatus in accordance with the present invention and a conventional stencil master making apparatus under various conditions. Resistance to energy, the size of the perforations and the SN ratio of the size of the perforations of the stencil masters made by the stencil master making apparatus of the present invention (embodiments 1 to 6) and those made by the conventional stencil master making apparatus (comparative examples 1 to 5) were evaluated. The result was as shown in the following table.

In the experiment, the temperature of the heater element 5, the resistance to energy, the mean perforation size and the SN ratio of the area of the perforations were measured in the following manner.

1. Temperature of the heater element 5 (the peak temperature when a square pulse was applied to the heater element 5, the temperature range during preheating, the temperature range during main heating)

(1) The temperature of the heater element was measured by applying heater drive power to the heater element under the condition used in perforating the thermoplastic film 1*a* without anything in contact with the heater element 5 and by use of an infrared radiation thermometer RM-2A (BARNES ENGINEERING COMPANY) with the field of view set to be a circle 7.5 $\mu$m in diameter, a band pass filter whose half-amplitude level of detecting wavelength was 4.9 to 5.4 $\mu$m used, the infrared emissivity $\epsilon$ taken as 1, and the sampling cycle set to be 2 $\mu$sec.

(2) When a square pulse is applied to the heater element 5, the temperature of the heater element 5 is maximized at the end of the application. The peak temperature of the heater element 5 is the temperature of the heater element 5 at the end of the application of the square pulse.

(3) The lowest and highest temperature of the heater element 5 during application of the preheating chopped pulses were measured and the temperature range was determined as between the lowest temperature and the highest temperature. The temperature range includes fluctuation of the temperature due to on and off the chopped pulses.

(4) The lowest and highest temperature of the heater element 5 during application of the main chopped pulses were measured and the temperature range was determined as between the lowest temperature and the highest temperature. The temperature range includes fluctuation of the temperature due to on and off the chopped pulses.

2. Resistance to energy (1) The resistance to energy is defined here as the margin of the condition of application of power in the step stress test to be described below.

(2) The step stress test has been well known as a method of testing resistance of a thermal head against severity of conditions of application of power. In the step stress test, power is applied to the heater element 5 at predetermined cycles with the degree of severity of the condition of application gradually increased stepwise until the heater element 5 is completely deteriorated, the heater element being driven a predetermined number of times at each degree of severity. Then the electric resistance of the heater element 5 is measured before the test is effected and at the end of each degree of severity. The degree of severity of the condition is generally increased by stepwise increasing power or duration of the power. The resistance of the heater element 5 does not change at the beginning of the test when the degree of severity is relatively low and as the degree of severity becomes higher, the heater element comes to experience a higher temperature and the resistance of the heater element 5 becomes higher due to deterioration in the aforesaid oxidation mode. In the case of a thin film thermal head formed by sputtering, the resistance of the heater element can be lowered at a certain step of the step stress test. This is considered because reduction of strain due to annealing effect prevails against increase of the resistance due to oxidation. When a pulse of certain strength is applied to the heater elements of the thin film thermal head to give hysteresis, the heater element is sufficiently annealed and reduction in resistance is almost nullified, whereby the resistance of the heater element comes to be increased from a certain step of the step stress test.

(3) The condition of application of power under which the resistance of the heater element is minimized (in the case of a heater element whose resistance is lowered during the step stress test) or the condition under which the resistance of the heater element substantially comes to be increased (in the case of the heater element whose resistance is not lowered during the step stress test) will be referred to as "an upper limit application condition", hereinbelow. When power is applied to the heater element under a condition severer than the upper limit application condition, the heater element progressively deteriorates and the resistance of the heater element increases, whereby heat generation performance of the heater element is lowered.

Figure 22:
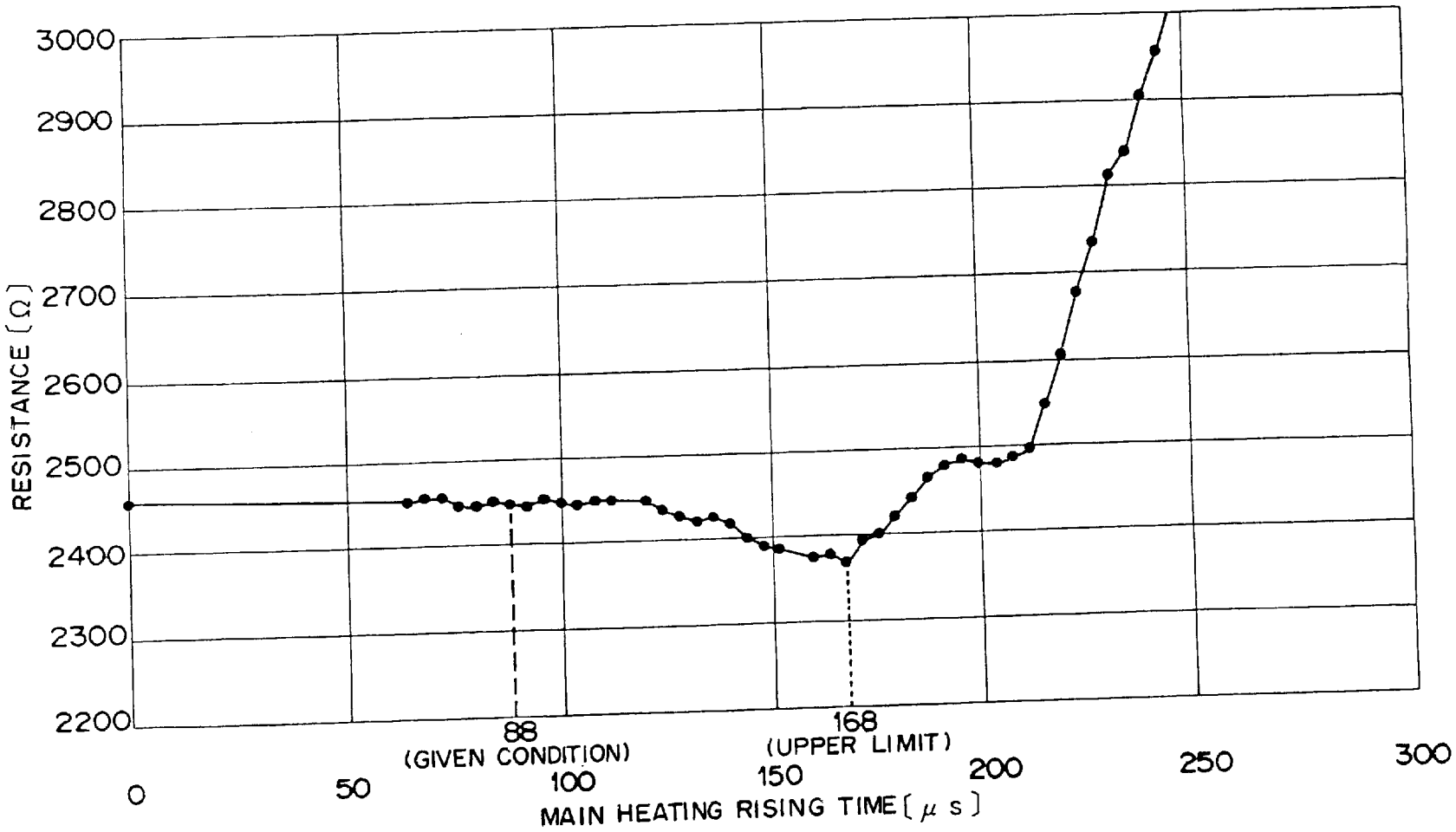
FIG. 22 is a view showing the result of step stress test under the condition equivalent to that for embodiment 1.

(4) While changing the duration of heater drive power (the rising time of the main heating in the case of the embodiments and the duration of the square pulse in the case of the comparative examples) stepwise over a range including the duration under the given condition for each embodiment and comparative example (see also the following table) and the resistance of the heater element at each duration of heater drive power was measured, whereby the upper limit application condition for each case was determined. For example, the upper limit application condition and the resistance of the heater element at each duration of heater drive power for embodiment 1 were as shown in FIG. 22. The resistance to energy is defined as (M-100)%, wherein M represents the duration of heater drive power under the upper limit application condition in % (168 for embodiment 1 as can been from FIG. 22) when the duration (88 for embodiment 1 as can been from FIG. 22) under the given condition is taken as 100%.

(5) As can be understood from the description above, the resistance to energy represents margin of the condition of application of power in the step stress test. However it has been known that the resistance to energy can be a barometer indicating the durability of the heater element when the heater element is continuously driven under the given condition. The larger the resistance to energy is, the longer the durability of the heater element is, that is, the less, the heater element deteriorates.

(6) We have empirically found that the resistance to energy practically should be at least 33%, preferably not smaller than 60%, and more preferably not smaller than 100%, though it is difficult to unitarily evaluate since the value of the resistance to energy varies depending on the condition of the step stress test, e.g., which is changed power or duration, cycle, number of pulse for each step, heat capacity of the recording medium and the like. When the resistance to energy is smaller than 33%, trouble is apt to occur.

3. Mean perforation size (in the main scanning direction and the sub-scanning direction) and the SN ratio of the area of the perforations (1) Stencil masters having a solid pattern were made. Images of the perforations of the respective stencil masters in the areas equivalent to each other in heat history (e.g., areas at a distance not smaller than 5 mm and not larger than 15 mm from the first main scanning line) were taken by a CCD camera through an optical microscope, and the images of 100 perforations were cut out by binary-coding and analyzed with their shapes by use of an image analysis software MacSCOPE (MITANI CORPORATION).

(2) The mean perforation size in the main scanning direction: The lengths of orthogonal projections of the respective perforations (through portions) onto the main scanning axis were measured and averaged. The mean perforation size in the sub-scanning direction: The lengths of orthogonal projections of the respective perforations (through portions) onto the sub-scanning axis were measured and averaged.

(3) The SN ratio of the area of the perforations: The areas of the respective perforations (through portions) were measured and the SN ratio of hole-viewing properties were obtained. The SN ratio of the nominal-the-better was taken as the SN ratio of the area of the perforations. We have empirically found that the SN ratio practically should be at least 10 db, preferably not lower than 13 db, and more preferably not lower than 16 db, though it is difficult to unitarily evaluate since the value of the SN ratio also varies depending on the condition of the step stress test. When the SN ratio is lower than 33%, trouble is apt to occur.

| | Embodiment | | | | | | comparative example | | | | | |
|---|---|---|---|---|---|---|---|---|---|---|---|---|
| | 1 hs | 2 hs | 3 hs | 4 hs | 5 T/F | 6 SS | 1 con | 2 con | 3 hs | 4 T/F | 5 H/P | 6 H/P |
| F/T (μm) | 1.7 | 1.7 | 1.7 | 2 | 3.5 | 1.7 | 1.7 | 1.7 | 1.7 | 3.5 | 1.7 | 1.7 |
| R/m (dpi) | 400 | 600 | 600 | 300 | 400 | 600 | 400 | 600 | 600 | 400 | 400 | 600 |
| R/s (dpi) | 400 | 600 | 600 | 400 | 400 | 600 | 400 | 600 | 600 | 400 | 400 | 600 |
| E/S/M (μm) | 30 | 20 | 20 | 45 | 30 | 20 | 30 | 20 | 20 | 30 | 30 | 20 |
| E/S/S (μm) | 40 | 25 | 25 | 45 | 40 | 25 | 40 | 25 | 25 | 40 | 40 | 25 |
| Cycle (ms) | 1.5 | 1.5 | 1.5 | 2 | 2.5 | 2.5 | 2.5 | 2.5 | 1.5 | 4 | 1.5 | 1.5 |
| M/res (Ω) | 2435 | 2077 | 2077 | 1715 | 2435 | 2077 | 2435 | 2077 | 2077 | 2435 | 2435 | 2077 |
| M/p (mW) | 240 | 160 | 160 | 300 | 240 | 120 | 120 | 80 | 160 | 120 | 330 | 240 |
| Voltage | 24.17 | 18.23 | 18.23 | 22.68 | 24.17 | 15.79 | 17.09 | 12.89 | 18.23 | 17.09 | 28.35 | 22.33 |
| Formula (1) | .0127 | .013547 | .013547 | .010863 | .0127 | .01016 | .0064 | .0068 | .0135 | .0064 | .0175 | .0203 |
| Sp | | | | | | | | | | | | |
| Dur (μs) | | | | | | | 400 | 360 | 160 | 800 | | |
| P/T (° C.) | | | | | | | 370 | 362 | 462 | 480 | | |
| Preheat | | | | | | | | | | | | |
| R/T (μs) | | | 35 | | | | | | | | | |
| Off (μs) | | | 14 | | | | | | | | | |
| On (μs) | | | 10 | | | | | | | | | |
| P/N | | | 2 | | | | | | | | | |
| T/R (° C.) | | | 204–232 | | | | | | | | | |
| Main heat | | | | | | | | | | | | |
| R/T (μs) | 88 | 76 | 65 | 132 | 92 | 112 | | | | | 56 | 44 |
| Off (μs) | 14 | 10 | 10 | 10 | 12 | 10 | | | | | 20 | 14 |
| On (μs) | 10 | 16 | 16 | 14 | 12 | 10 | | | | | 10 | 10 |
| P/N | 5 | 4 | 3 | 4 | 16 | 7 | | | | | 5 | 5 |
| T/T (μs) | 208 | 180 | 143 | 228 | 444 | 322 | | | | | 206 | 164 |
| T/R (° C.) | 330–350 | 324–354 | 330–366 | 333–361 | 345–380 | 280–344 | | | | | 344–385 | 371–409 |
| M/E (μj) | 33.1 | 22.4 | 26.9 | 56.4 | 60.5 | 30.2 | 48.0 | 28.8 | 25.6 | 96.0 | 35.0 | 22.6 |
| R/E (%) | 90.9 | 52.6 | 46.2 | 121 | 156.5 | 142.9 | 75 | 56.3 | <0 | <0 | 22.2 | 9.1 |
| MPSM (μm) | 42 | 27 | 26 | 59 | 43 | 42 | 42 | 25 | 24 | 25 | 42 | 26 |
| MPSS (μm) | 42 | 27 | 27 | 43 | 45 | 43 | 42 | 26 | 26 | 25 | 41 | 25 |
| S/N (db) | 12.5 | 12 | 12.9 | 13.3 | 15.3 | 16.5 | 12.8 | 11.5 | 8.7 | 9.9 | 11.3 | 10.7 |

The result of the experiment is shown in the following table. In the following table, the total main heating time covers the time interval from initiation of the main heating to the end of the same, and includes the off-time of the chopped pulses.

In the following table, symbols represent as follows.

hs: high speed, T/F: thick film, SS: shape stabilization,
con: conventional, H/P: high power, F/T: film thickness,
R/m: resolution in the main scanning direction,
R/s: resolution in the sub-scanning direction,
E/S/M: size of heater element in the main scanning direction,
E/S/S: size of heater element in the sub-scanning direction,
M/res: mean resistance, M/p: mean power, Dur: duration,
Formula (1): value of $$\frac{v^2\sqrt{P_x P_y}}{rl_x l_y},$$

sp: square pulse, P/T: peak temperature, R/T: rising time, Off: off time, On: on time, P/N: pulse number, T/T:total time, T/R:temperature range, M/E:mean energy, R/E:resistance to energy, MPSM:perforation size (main scanning direction), MPSS:perforation size (sub-scanning direction)

Comparative Example 1

For the purpose of comparison with embodiment 1 described below, a stencil master was made by use of stencil master material comprising porous support sheet and 1.7 μm thick polyethylene terephthalate film laminated on the porous support sheet. The resolution was 400 dpi in both the main scanning direction and the sub-scanning direction, the size of each heater element was 30 μm (length in the main scanning direction) by 40 μm (length in the sub-scanning direction), and a square wave pulse was applied to the heater elements for 400 μs at a mean heater drive power of 120 mW. The perforating cycle was 2.5 ms. This stencil master making condition was typical for the stencil master at a resolution of 400 dpi. The peak temperature of the heater elements was 370° C.

The obtained stencil master was excellent in resistance to energy (75%) and was on a standard level in the SN ratio of the area of perforations (12.8 db).

Embodiment 1

A stencil master was made by use of stencil master material comprising porous support sheet and 1.7 μm thick polyethylene terephthalate film laminated on the porous support sheet. The resolution was 400 dpi in both the main scanning direction and the sub-scanning direction, the size of each heater element was 30 μm (length in the main scanning direction) by 40 μm (length in the sub-scanning direction), and a main heating continuous pulse and main heating chopped pulses were applied to the heater elements at a mean heater drive power of 240 mW. The perforating cycle was 1.5 ms. The temperature of the heater elements was held in the range of 330° C. to 350° C. during application of the chopped pulses. This temperature range was lower than the peak temperature of the heater elements (370° C.) in comparative example 1. The total main heating time was 208 μs, which was as short as about a half of that in comparative example 1.

The obtained stencil master was excellent in resistance to energy (90.9%) and was on a standard level in the SN ratio of the area of perforations (12.5 db).

Figure 23:
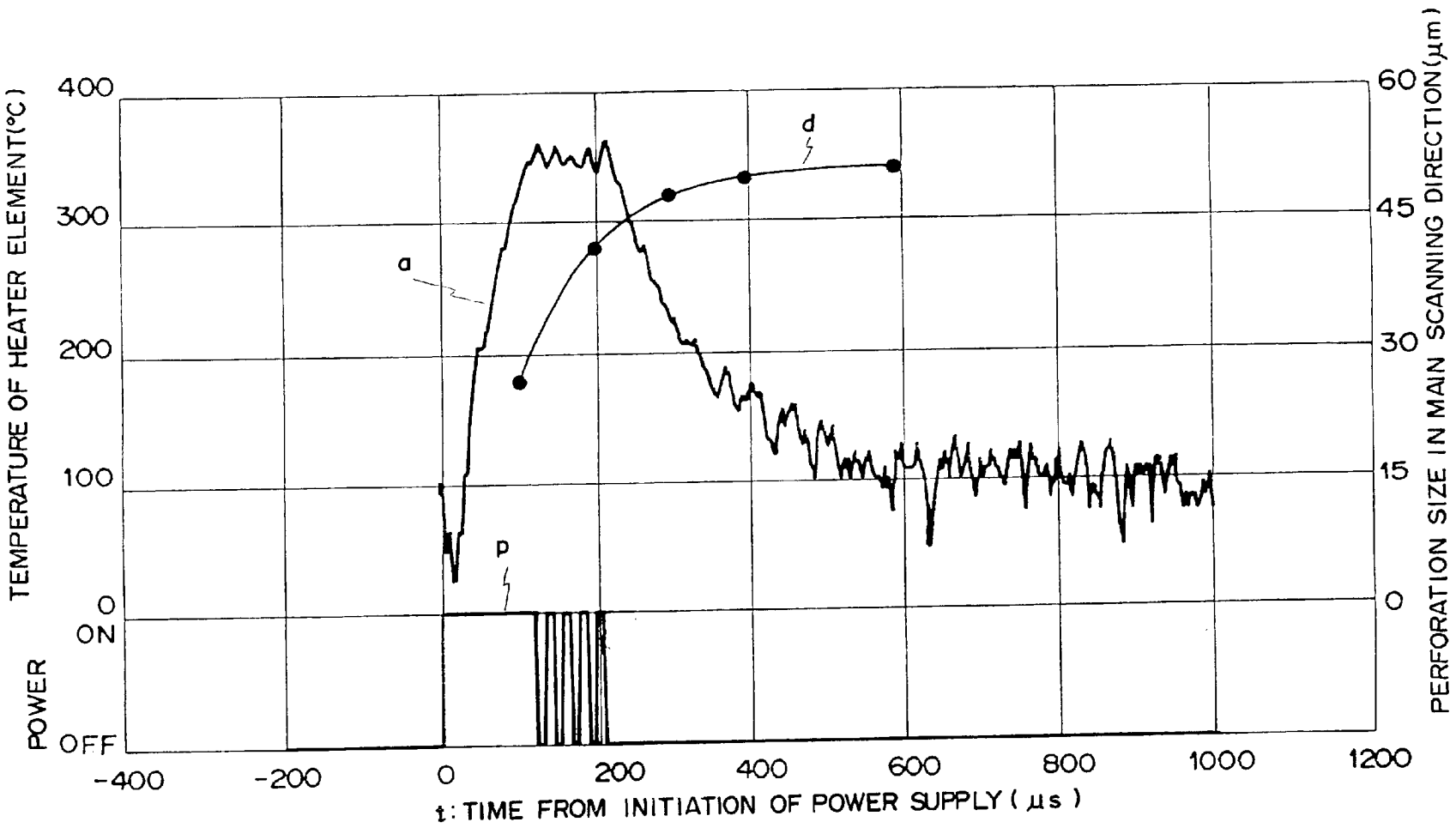
FIG. 23 is a view showing changes with time of the temperature of the heater element and the size of the perforation in the main scanning direction when the heater element is applied with heater drive power under a condition similar to that used in embodiment 1.
Figure 24:
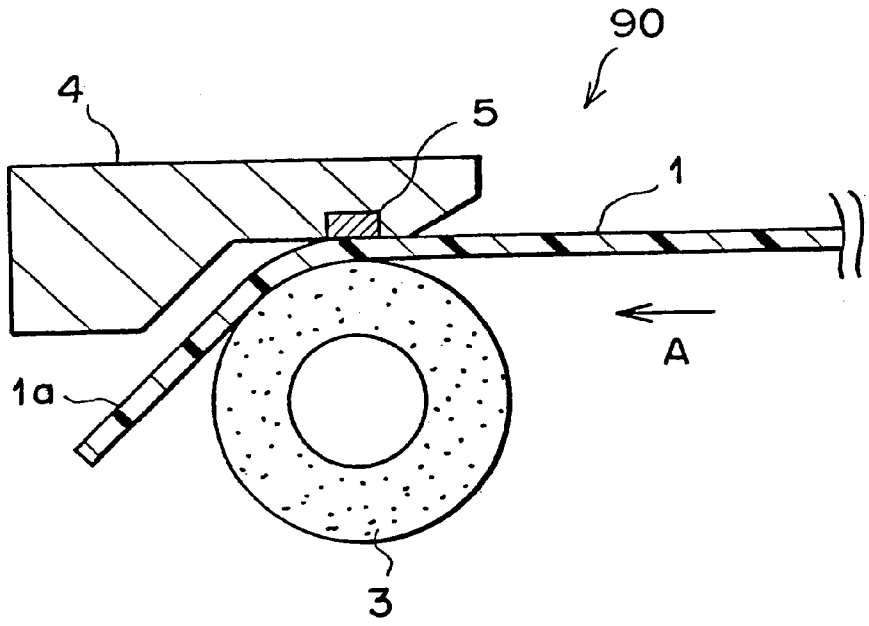
F I G . 24 PRIOR ART
FIG. 24 is a view showing an example of a conventional stencil master making apparatus.
Figure 25A:
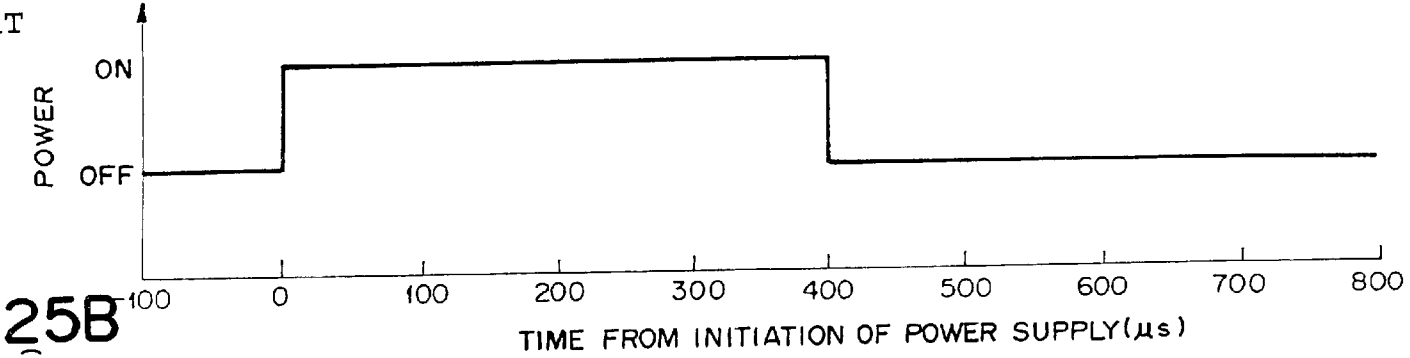
FIG.25A PRIOR ART
FIG. 25A is a view showing the heater drive power employed in the conventional stencil master making apparatus.
Figure 25B:
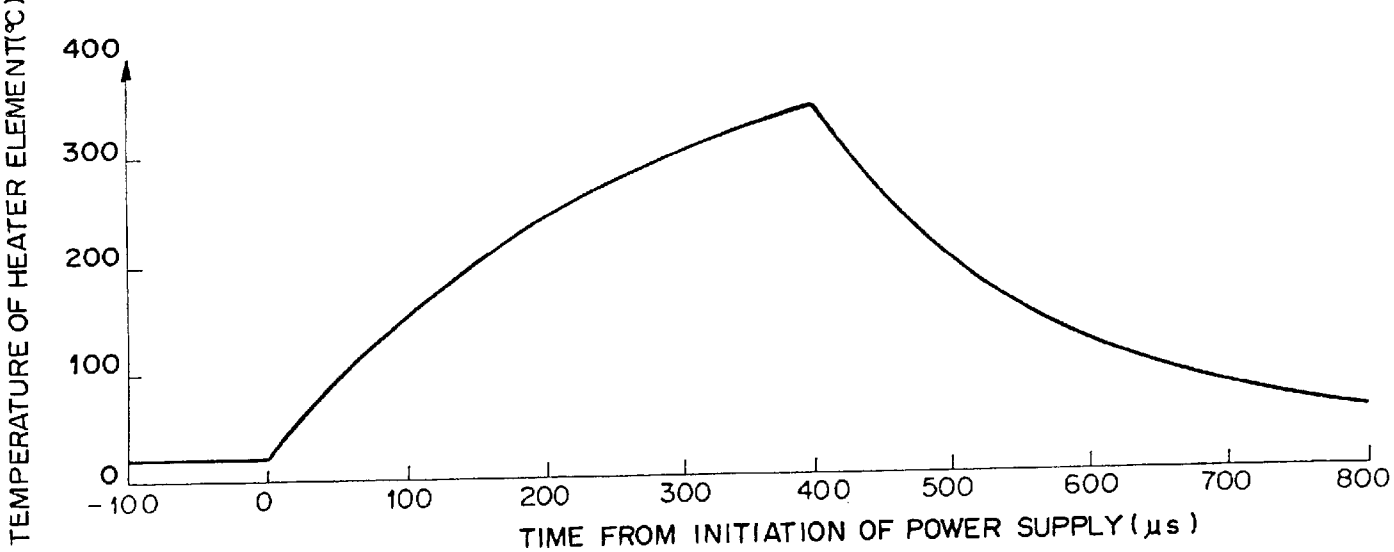
FIG.25B PRIOR ART
FIG. 25B is a view showing the change of the temperature of the heater element in the conventional stencil master making apparatus.
Figure 26:
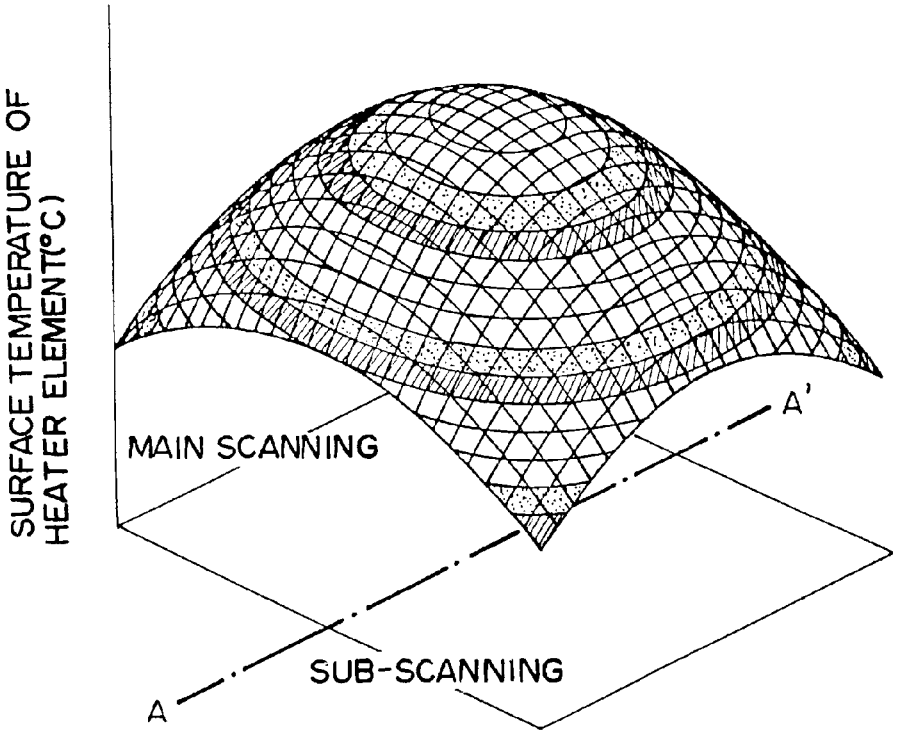
F I G. 26 PRIOR ART
FIG. 26 is a view showing the temperature distribution on the surface of the heater element.
Figure 27:
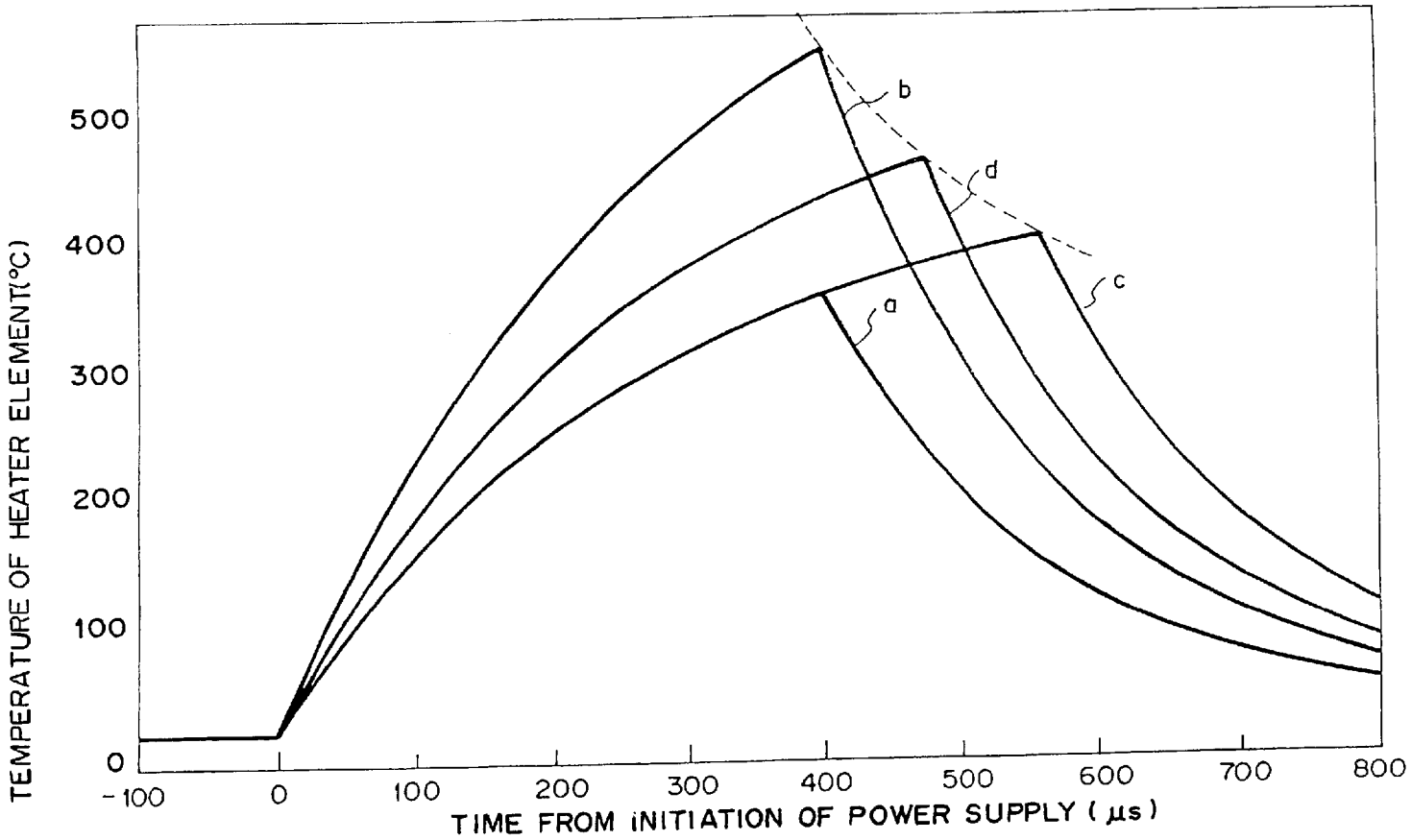
FIG.27 PRIOR ART
FIG. 27 is a view showing the change with time of the heater element for various manners of application of heater drive power.
Figure 28:
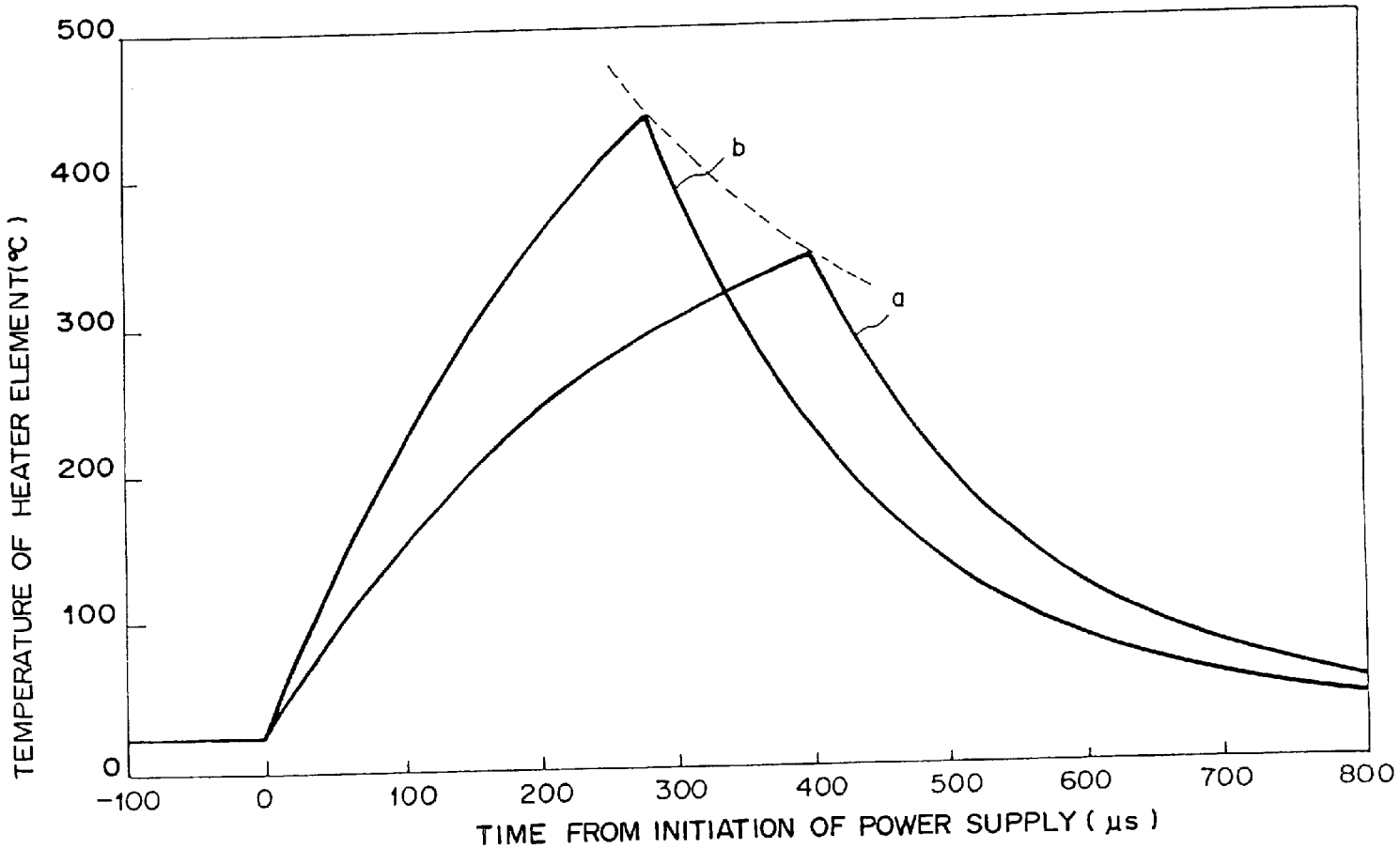
FIG.28 PRIOR ART
FIG. 28 is a view showing the change with time of the heater element when the heater drive power is changed.
Figure 29:
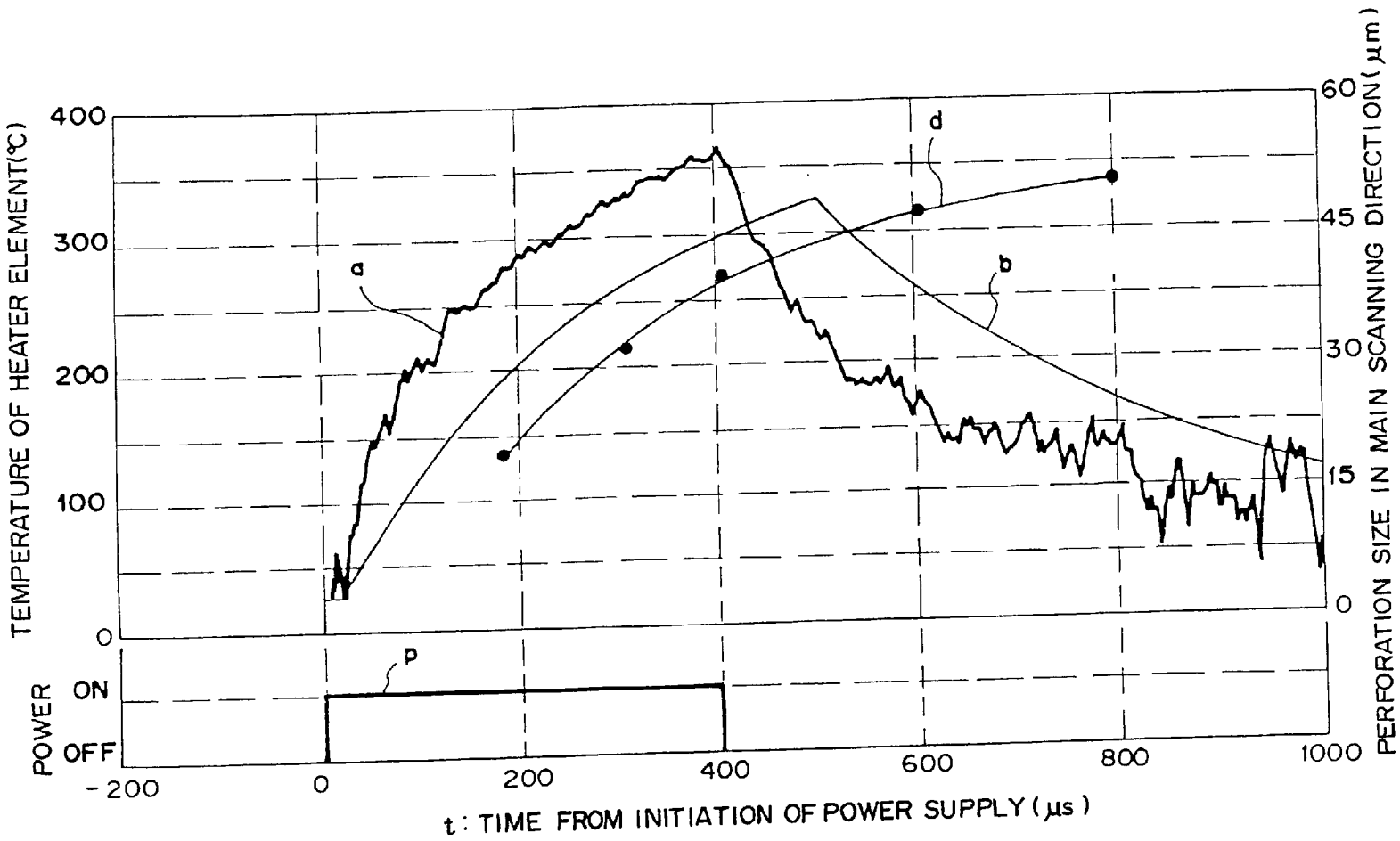
FIG.29 PRIOR ART
FIG. 29 is a view showing the change with time of the temperature of the heater element, the temperature of the thermoplastic film and the size of the perforation in the main scanning direction when a square pulse is applied to the heater element for 400 $\mu$s.
Figure 30:
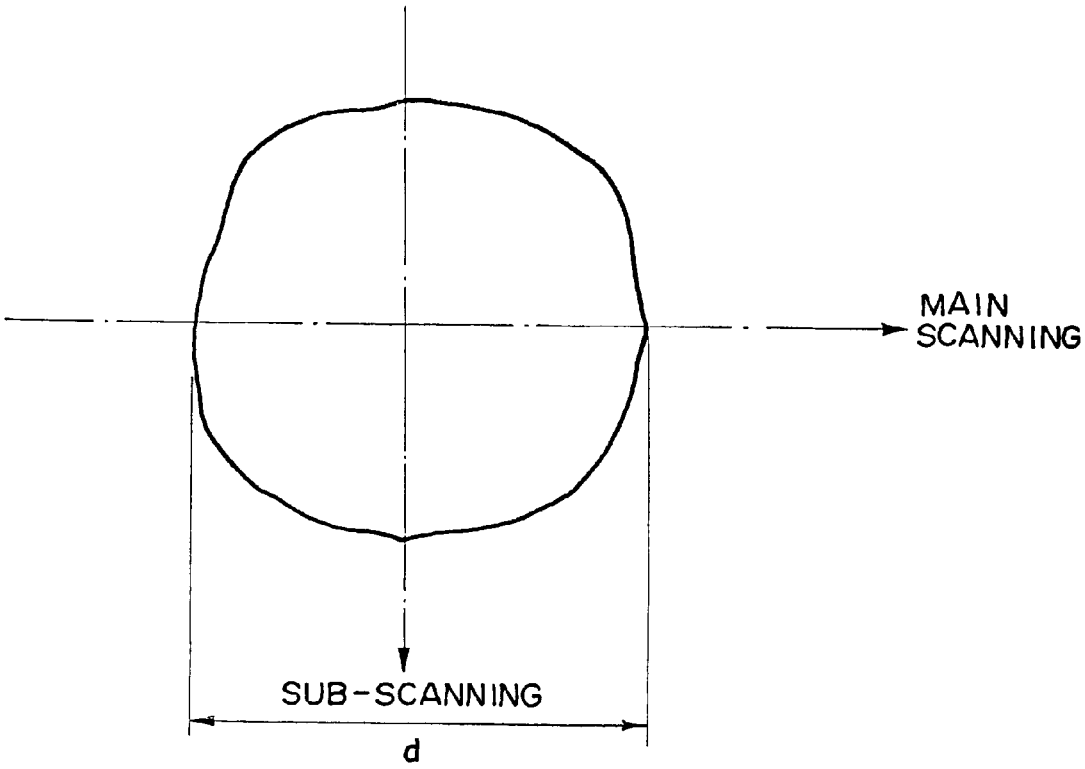
FIG. 30 PRIOR ART
FIG. 30 is an enlarged view of the perforation.
Figure 31:
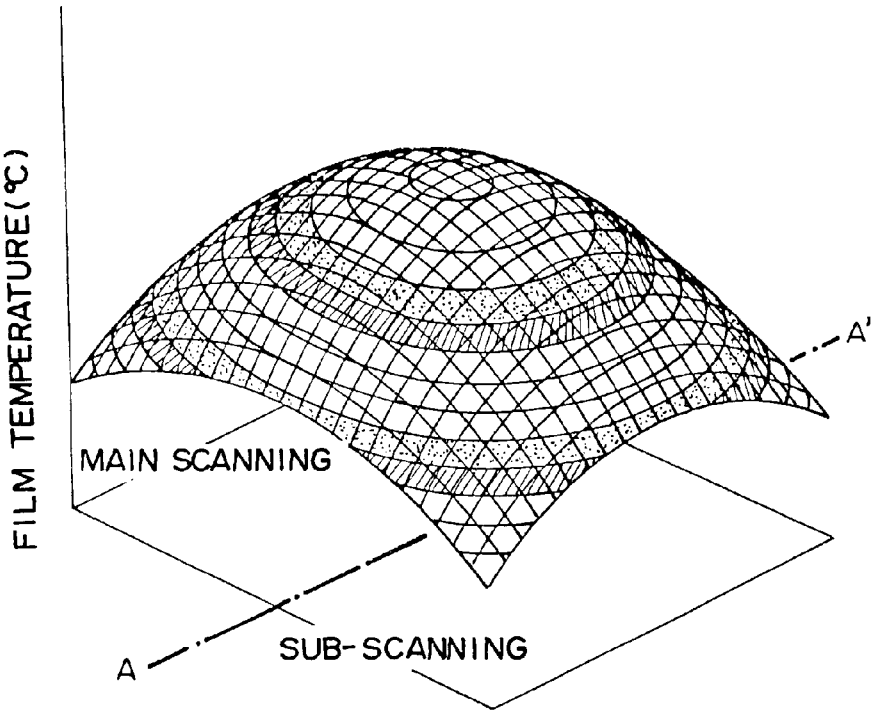
F I G. 31 PRIOR ART
FIG. 31 is a view showing the temperature distribution on the surface of the thermoplastic film.
Figure 32:
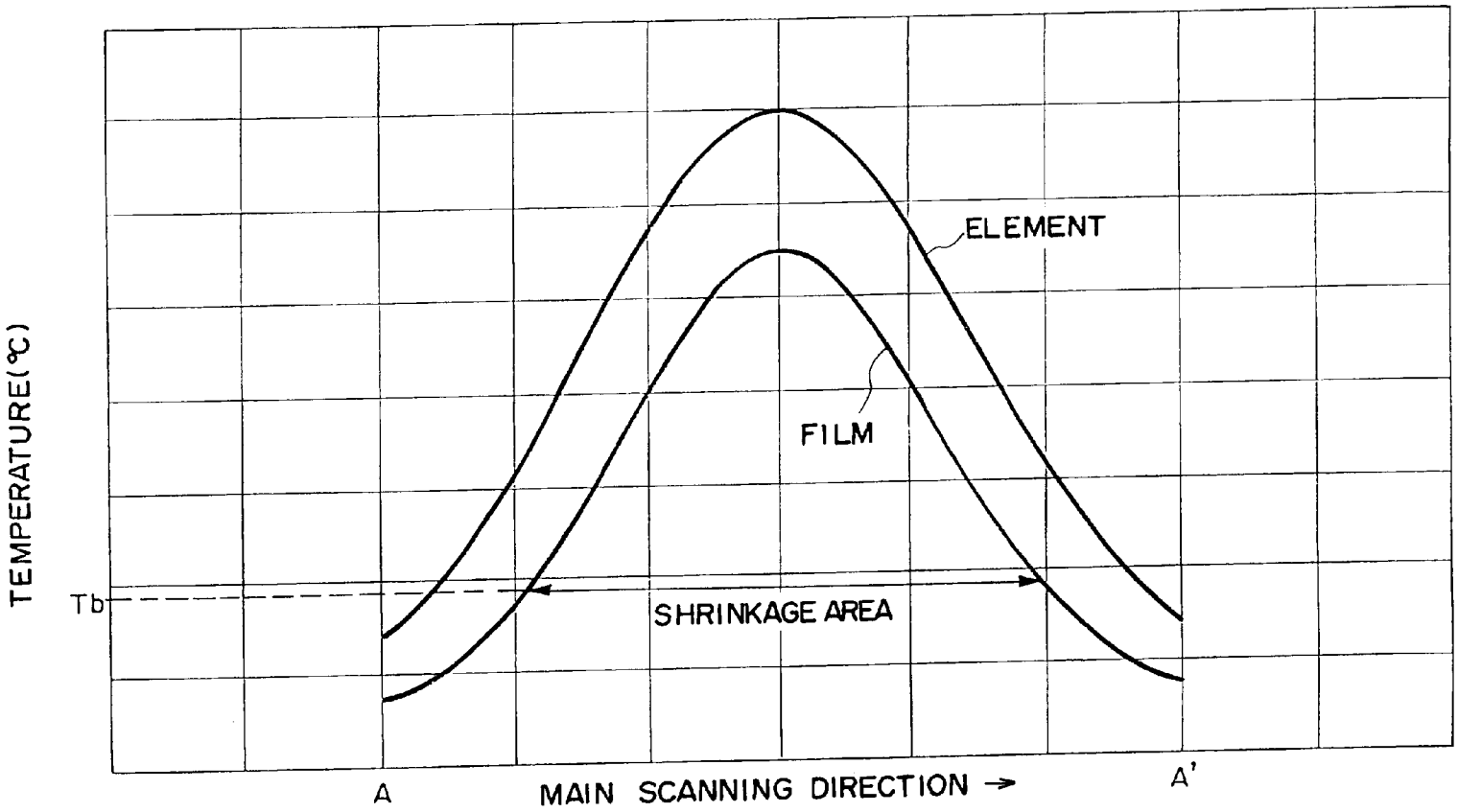
FIG.32 PRIOR ART
FIG. 32 shows the cross-sections of temperature distribution on the thermoplastic film and that on the heater element taken along line A–A'.
Figure 33:
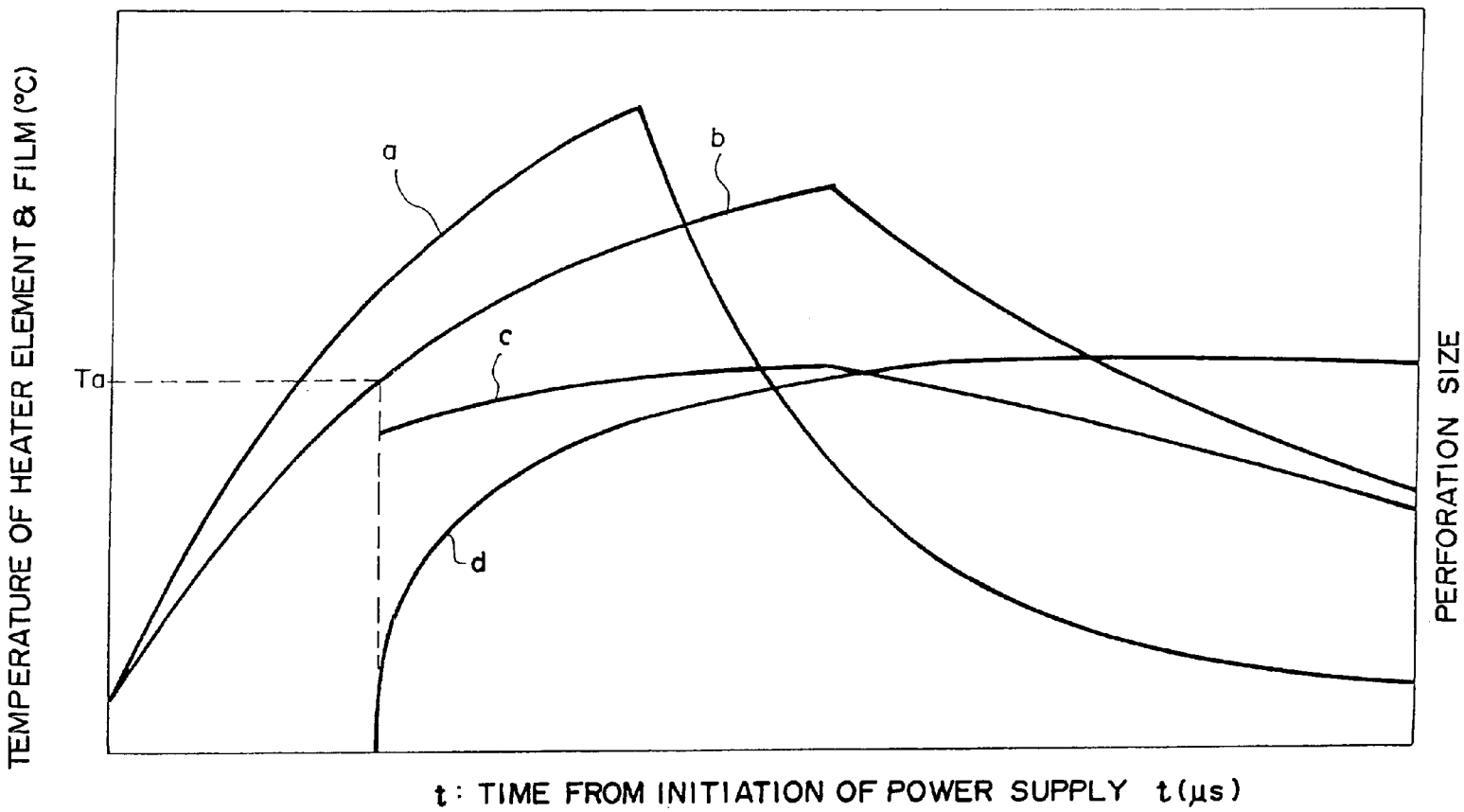
FIG. 33 PRIOR ART
FIG. 33 shows the relation of the temperature of the heater element, the temperature of the thermoplastic film and the size of the perforation in the main scanning direction to the time t from initiation of application of heater drive power.
Figure 34:
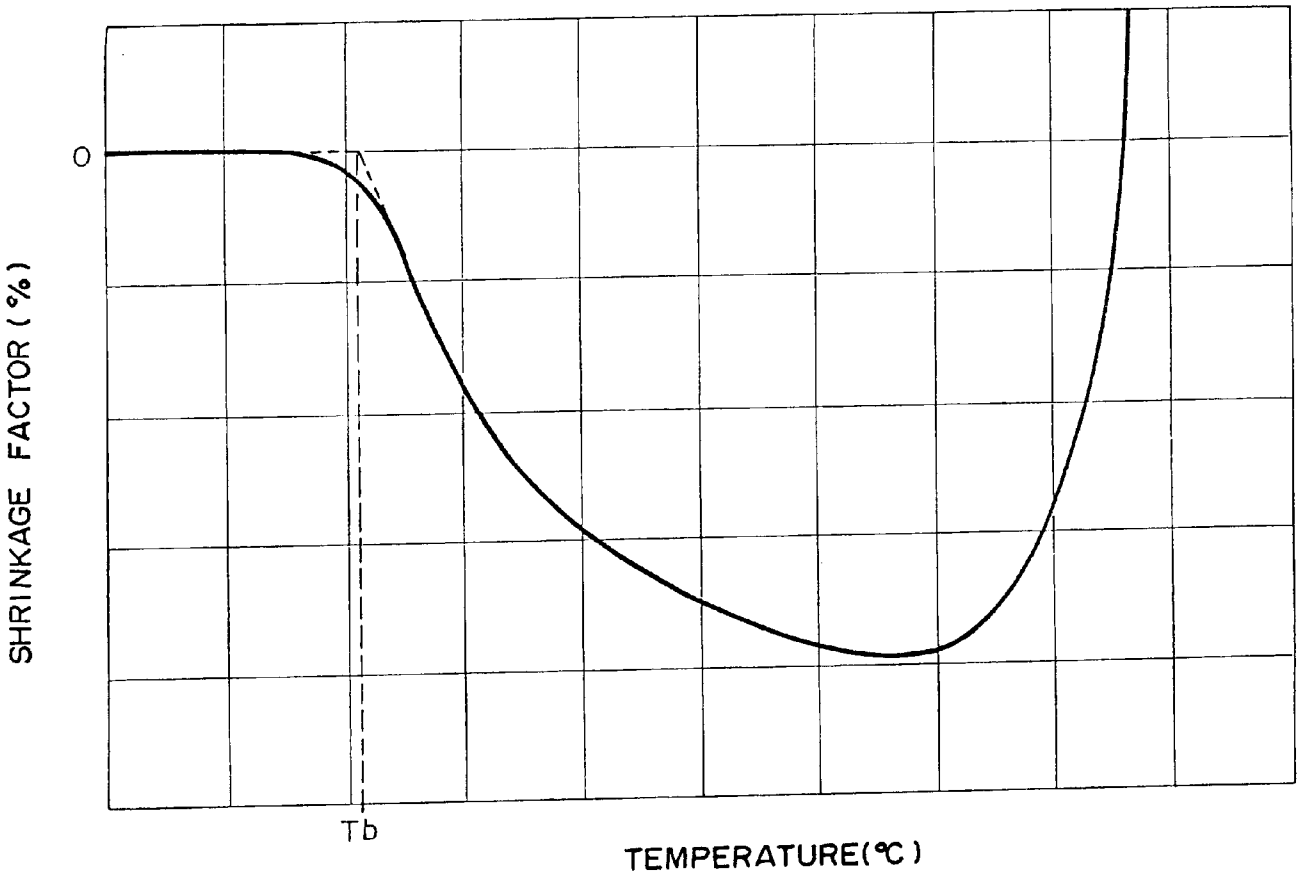
FIG.34 PRIOR ART
FIG. 34 is a view showing the relation between the temperature of the thermoplastic film and heat shrink.

FIG. 23 shows changes with time of the temperature of the heater element and the size of the perforation in the main scanning direction when the heater element is applied with heater drive power under a condition similar to that used in embodiment 1. As can be understood from comparison of FIG. 23 and FIG. 29 (representing a case where a square pulse is applied to the heater element), growth of the perforation in the main scanning direction to a desired size is completed only in about 400 μs in the case shown in FIG. 23 whereas it takes about 800 μs for the perforation to grow to the desired size in the case shown in FIG. 29. Further the peak temperature of the heater element is sufficiently lower than 400° C.

Comparative Example 2

For the purpose of comparison with embodiments 2 and 3 described below, a stencil master was made by use of stencil master material comprising porous support sheet and 1.7 μm thick polyethylene terephthalate film laminated on the porous support sheet. The resolution was 600 dpi in both the main scanning direction and the sub-scanning direction, the size of each heater element was 20 μm (length in the main scanning direction) by 25 μm (length in the sub-scanning direction), and a square wave pulse was applied to the heater elements for 360 μs at a mean heater drive power of 80 mW. The perforating cycle was 2.5 ms. This stencil master making condition was typical for the stencil master at a resolution of 600 dpi. The peak temperature of the heater elements was 362° C.

The obtained stencil master was on a standard level in both the resistance to energy (56.3%) and the SN ratio of the area of perforations (11.5 db).

Embodiment 2

A stencil master was made by use of stencil master material comprising porous support sheet and 1.7 μm thick polyethylene terephthalate film laminated on the porous support sheet. The resolution was 600 dpi in both the main scanning direction and the sub-scanning direction, the size of each heater element was 20 μm (length in the main scanning direction) by 25 μm (length in the sub-scanning direction), and a main heating continuous pulse and main heating chopped pulses were applied to the heater elements at a mean heater drive power of 160 mW. The perforating cycle was 1.5 ms. The temperature of the heater elements was held in the range of 324° C. to 354° C. during application of the chopped pulses. This temperature range was lower than the peak temperature of the heater elements (362° C.) in comparative example 2. The total main heating time was 180 μs, which was as short as about a half of that (360 μs) in comparative example 2.

The obtained stencil master was on a standard level in both the resistance to energy (52.6%) and the SN ratio of the area of perforations (12 db).

Embodiment 3

A stencil master was made by use of stencil master material comprising porous support sheet and 1.7 μm thick polyethylene terephthalate film laminated on the porous support sheet. The resolution was 600 dpi in both the main scanning direction and the sub-scanning direction, the size of each heater element was 20 μm (length in the main scanning direction) by 25 μm (length in the sub-scanning direction), and a main heating continuous pulse, main heating chopped pulses, a preheating continuous pulse and preheating chopped pulses were applied to the heater elements at a mean heater drive power of 160 mW. The perforating cycle was 1.5 ms. The temperature of the heater elements was held in the range of 204° C. to 232° C. during application of the preheating chopped pulses and in the range of 330° C. to 366° C. during application of the main heating chopped pulses. The total main heating time was 143 μs, which was greatly shorter than that (360 μs) in comparative example 2. This clearly shows the effect of the preheating.

The obtained stencil master was on a standard level in both the resistance to energy (46.2%) and the SN ratio of the area of perforations (12.9 db).

Comparative Example 3

For the purpose of comparison with embodiments 2 and 3 described above, a stencil master was made by use of stencil master material comprising porous support sheet and 1.7 μm thick polyethylene terephthalate film laminated on the porous support sheet. The resolution was 600 dpi in both the main scanning direction and the sub-scanning direction, the size of each heater element was 20 μm (length in the main scanning direction) by 25 μm (length in the sub-scanning direction), and a square wave pulse was applied to the heater elements for 160 μs at a mean heater drive power of 160 mW. The perforating cycle was 1.5 ms. This stencil master making condition was severe to realize the perforating cycle of 1.5 ms by application of a square pulse. The peak temperature of the heater elements was 462° C. When stencil master making was continued under the condition described above, the heater elements were deteriorated to such an extent that the heater elements were disabled from perforating in a position at 10 to 200 mm downstream the stencil master making start line in the sub-scanning direction.

The obtained stencil master was remarkably inferior in both the resistance to energy (0% or less) and the SN ratio of the area of perforations (8.7 db).

Embodiment 4

A stencil master was made by use of stencil master material comprising porous support sheet and 2 μm thick polyethylene terephthalate film laminated on the porous support sheet. The resolution was 300 dpi in the main scanning direction and 400 dpi in the sub-scanning direction, the size of each heater element was 45 μm (length in the main scanning direction) by 45 μm (length in the sub-scanning direction), and a main heating continuous pulse and main heating chopped pulses were applied to the heater elements at a mean heater drive power of 300 mW. The perforating cycle was 2 ms. The temperature of the heater elements was held in the range of 333° C. to 361° C. during application of the chopped pulses.

The obtained stencil master was very excellent in resistance to energy (121%) and was excellent in the SN ratio of the area of perforations (13.3 db).

Embodiment 5

A stencil master was made by use of stencil master material comprising porous support sheet and 3.5 μm thick polyethylene terephthalate film laminated on the porous support sheet. The resolution was 400 dpi in both the main scanning direction and the sub-scanning direction, the size of each heater element was 30 μm (length in the main scanning direction) by 40 μm (length in the sub-scanning direction), and a main heating continuous pulse and main heating chopped pulses were applied to the heater elements at a mean heater drive power of 240 mW. The perforating cycle was 2.5 ms. The temperature of the-heater elements was held in the range of 345° C. to 380° C. during application of the chopped pulses.

The obtained stencil master was very excellent in both the resistance to energy (156.5%) and the SN ratio of the area of perforations (15.3 db).

Comparative Example 4

For the purpose of comparison with embodiment 5 described above, a stencil master was made by use of stencil master material comprising porous support sheet and 3.5 μm thick polyethylene terephthalate film laminated on the porous support sheet. The resolution was 400 dpi in both the main scanning direction and the sub-scanning direction, the size of each heater element was 30 μm (length in the main scanning direction) by 40 μm (length in the sub-scanning direction), and a square wave pulse was applied to the heater elements for 800 μs at a mean heater drive power of 120 mW. The perforating cycle was 4 ms. This stencil master making condition was severe to perforate the 3.5 μm thick thermoplastic film by application of a square pulse. The peak temperature of the heater elements was 480° C.

The obtained stencil master was remarkably inferior in both the resistance to energy (0% or less) and the SN ratio of the area of perforations (9.9 db).

Embodiment 6

A stencil master was made by use of stencil master material comprising porous support sheet and 1.7 μm thick polyethylene terephthalate film laminated on the porous support sheet. The resolution was 600 dpi in both the main scanning direction and the sub-scanning direction, the size of each heater element was 20 μm (length in the main scanning direction) by 25 μm (length in the sub-scanning direction), and a main heating continuous pulse and main heating chopped pulses were applied to the heater elements at a mean heater drive power of 120 mW. The perforating cycle was 2.5 ms. The temperature of the heater elements was held in the range of 280° C. to 344° C. during application of the chopped pulses. The initial perforation temperature was set higher (344° C.) and the chopped pulses are controlled so that the temperature of the heater element gradually lowered (280° C. to 300° C.).

The obtained stencil master was very excellent in resistance to energy (142.9%). Further the stencil master was improved in fluctuation of the perforation size and was excellent in the SN ratio of the area of perforations (16.5 db) as compared with that, for instance, in the comparative example 2 (11.5 db).

Comparative Example 5

As a comparative example for embodiment 1 described above where the mean heater drive power was excessive, a stencil master was made by use of stencil master material comprising porous support sheet and 1.7 μm thick polyethylene terephthalate film laminated on the porous support sheet. The resolution was 400 dpi in both the main scanning direction and the sub-scanning direction, the size of each heater element was 30 μm (length in the main scanning direction) by 40 μm (length in the sub-scanning direction), and a main heating continuous pulse and main heating chopped pulses were applied to the heater elements at a mean heater drive power of 330 mW. The perforating cycle was 1.5 ms. The temperature of the heater elements was held in the range of 344° C. to 385° C. during application of the chopped pulses. The mean heater drive power in this example was about 1.4 times that in embodiment 1 and about 2.8 times that in comparative example 1. The temperature of the heater element was increased at a very high rate and increased to about 385° C. from the room temperature in 56 μs for which the main continuous pulse was applied to the heater element. Though the temperature increasing rate during application of the main continuous pulse was not uniform and the temperature of the heater element before application of the main continuous pulse (≈room temperatures≈25° C.) was not clear, the approximate mean temperature increasing rate was (385-25)/56≈6.4(° C./μs). The mean temperature increasing rate was 3.7° C./μs in embodiment 1 and 0.9° C./μs in comparative example 1.

The obtained stencil master was on a standard level in the SN ratio of the area of perforations (11.3 db) but was inferior to the standard level in resistance to energy (22.2%).

Comparative Example 6

As a comparative example for embodiment 2 described above where the mean heater drive power was excessive, a stencil master was made by use of stencil master material comprising porous base film and 1.7 μm thick polyethylene terephthalate film laminated on the porous base film. The resolution was 600 dpi in both the main scanning direction and the sub-scanning direction, the size of each heater element was 20 μm (length in the main scanning direction) by 25 μm (length in the sub-scanning direction), and a main heating continuous pulse and main heating chopped pulses were applied to the heater elements at a mean heater drive power of 240 mW. The perforating cycle was 1.5 ms. The temperature of the heater elements was held in the range of 371° C. to 409° C. during application of the chopped pulses. The mean heater drive power in this example was about 2.5 times that in embodiment 2 and about 3 times that in comparative example 2. The temperature of the heater element was increased at a very high rate and increased to about 409° C. from the room temperature in 44 μs for which the main continuous pulse was applied to the heater element. Though the temperature increasing rate during application of the main continuous pulse was not uniform and the temperature of the heater element before application of the main continuous pulse (≈room temperatures≈25° C.) was not clear, the approximate mean temperature increasing rate was (409-25)/44≈8.7 (° C./μs). The mean temperature increasing rate was 4.3° C./μs in embodiment 2 and 0.9° C./μs in comparative example 2.

The obtained stencil master was on a standard level in the SN ratio of the area of perforations (10.7 db) but was much inferior to the standard level in resistance to energy (9.1%).

What is claimed is:

1. A heat-sensitive stencil master making apparatus which makes a stencil by imagewise perforating thermoplastic film of heat-sensitive stencil master material according to image data comprising a thermal head which has an array of a plurality of heater elements and is brought into thermal contact with the thermoplastic film of the heat-sensitive stencil master material, and an electric voltage applying means which applies an electric voltage to heater elements selected form the array of the heater elements according to the image data so that perforations are formed in the parts of the thermoplastic film of the heat-sensitive stencil master material in contact with the selected heater elements, wherein the electric voltage applying means applies a continuous electric voltage to each of the selected heater elements to heat the heater element to a predetermined temperature in a predetermined temperature range adequate to thermally perforate the thermoplastic film and then applies an intermittent electric voltage to the heater element so that the temperature of the heater element is held in said predetermined time interval adequate to thermally perforate the thermoplastic film, and the electric voltage applying means applies said continuous electric voltage so that at least one of the following two heating rate conditions is satisfied, one being a condition that it takes 25 μsec or more as measured from the initiation of application for the temperature of the center of the surface of the heater element at a room temperature to reach 200° C. and the other heating condition being a condition that it takes 50 μsec or more as measured from the initiation of application for the temperature of the center of the surface of the heater element at a room temperature to reach 300° C.

2. A stencil master making apparatus as defined in claim 1 in which the electric voltage applying means applies said intermittent electric voltage so that the temperature of the center of the surface of the heater element during application of the intermittent voltage minus the periodic variation of the temperature of the center of the surface of the heater element due to application of the intermittent voltage is held in a temperature range not lower than the melting point of the thermoplastic film of the heat-sensitive stencil master material and not higher than a maximum set temperature determined for the heater element.

3. A stencil master making apparatus as defined in claim 2 in which said maximum set temperature is 400° C.

4. A stencil master making apparatus as defined in claim 1 in which the electric voltage applying means applies said continuous electric voltage so that at least one of the following heating rate conditions is satisfied, one being a condition that the temperature of the center of the surface of the heater element at a room temperature reaches 200° C. within 150 μsecs as measured from the initiation of application and the other being a condition that the temperature of the center of the surface of the heater element at a room temperature reaches 300° within 300 μsec as measured from the initiation of application.

5. A stencil master making apparatus as defined in claim 1 in which the thermal head is moved relatively to the stencil master material in a sub-scanning direction substantially perpendicular to a main scanning direction which is equal to the direction of the array of the heater elements, the resolution of the picture elements of the stencil master to be made is in the range of 200 dpi to 800 dpi in both the main scanning direction and the sub-scanning direction, and the continuous electric voltage applied by the electric voltage applying means satisfies the following formula (1), $$0.005 \le \frac{v^2\sqrt{P_x P_y}}{r l_x l_y} \le 0.015 \qquad (1)$$

wherein v represents the electric voltage (V) to be applied, r represents the mean resistance (Ω) of the heater elements, $P_x$ represents the pitches (μm) of the picture elements in the main scanning direction, $P_y$ represents the pitches (μm) of the picture elements in the sub-scanning direction, $l_x$ represents the length (μm) of the heater element in the main scanning direction, and $l_y$ represents the length (μm) of the heater element in the sub-scanning direction.

6. A stencil master making apparatus as defined in claim 1 further comprising a preheating means which carries out preheating on at least said selected heater elements before said electric voltage applying means applies said continuous electric voltage, wherein the preheating includes applying a preheating continuous electric voltage to each of the heater elements until the temperature of the heater element reaches a predetermined temperature in a predetermined temperature range adequate to preheat the stencil master material and then applying a preheating intermittent electric voltage to the heater element so that the temperature of the heater element is held in said predetermined temperature range for a predetermined time interval adequate to preheat the stencil master material.

7. A stencil master making apparatus as defined in claim 6 in which the heater elements of the thermal head are divided into a plurality of blocks so that the heater elements are driven block by block, and the preheating means carries out the preheating on the heater elements in one block while the heater elements in one of the other blocks are perforating the thermoplastic film.

8. A stencil master making apparatus as defined in claim 6 in which the preheating means applies said preheating intermittent electric voltage so that the temperature of the center of the surface of the heater element during application of the preheating intermittent voltage minus the periodic variation of the temperature of the center of the surface of the heater element due to application of the preheating intermittent voltage is held in a temperature range between the melting point of the thermoplastic film minus 50° C. and that plus 50° C.

9. A heat-sensitive stencil master making apparatus which makes a stencil by imagewise perforating thermoplastic film of heat-sensitive stencil master material according to image data comprising a thermal head which has an array of a plurality of heater elements and is brought into thermal contact with the thermoplastic film of the heat-sensitive stencil master material, and an electric voltage applying means which applies an electric voltage to heater elements selected form the array of the heater elements according to the image data so that perforations are formed in the parts of the thermoplastic film of the heat-sensitive stencil master material in contact with the selected heater elements, wherein the electric voltage applying means applies a continuous electric voltage to each of the selected heater elements to heat the heater element to a predetermined temperature in a predetermined temperature range adequate to thermally perforate the thermoplastic film and then applies an intermittent electric voltage to the heater element so that the temperature of the heater element is held in said predetermined time interval adequate to thermally perforate the thermoplastic film, and the electric voltage applying means applies said continuous electric voltage so that at least one of the following two heating rate conditions is satisfied, one being a condition that the temperature of the center of the surface of the heater element at a room temperature reaches 200° C. within 150 μsec as measured from the initiation of application and the other being a condition that the temperature of the center of the surface of the heater element at a room temperature reaches 300° C. within 300 μsec as measured from the initiation of application.

* * * * *